US011806755B2

(12) United States Patent
Colgrove et al.

(10) Patent No.: US 11,806,755 B2
(45) Date of Patent: Nov. 7, 2023

(54) APPARATUSES, METHODS, AND SYSTEMS FOR VIBRATORY SCREENING

(71) Applicant: DERRICK CORPORATION, Buffalo, NY (US)

(72) Inventors: James R. Colgrove, East Aurora, NY (US); Michael L. Peresan, Strykersville, NY (US)

(73) Assignee: DERRICK CORPORATION, Buffalo, NY (US)

( * ) Notice: Subject to any disclaimer, the term of this patent is extended or adjusted under 35 U.S.C. 154(b) by 213 days.

(21) Appl. No.: 17/386,441

(22) Filed: Jul. 27, 2021

(65) Prior Publication Data

US 2021/0354172 A1 Nov. 18, 2021

Related U.S. Application Data

(63) Continuation-in-part of application No. 17/352,885, filed on Jun. 21, 2021, now Pat. No. 11,731,167, (Continued)

(51) Int. Cl.
*B07B 1/46* (2006.01)

(52) U.S. Cl.
CPC ..... *B07B 1/4618* (2013.01)

(58) Field of Classification Search
CPC .. B07B 13/16; B07B 1/28; B07B 1/36; B07B 1/46; B07B 1/48; B07B 2201/01; B07B 2230/01; B01D 33/0376; B01D 33/37
(Continued)

(56) References Cited

U.S. PATENT DOCUMENTS 4,529,510 A 7/1985 Johnson
4,632,751 A * 12/1986 Johnson ..... B07B 1/42 74/61

(Continued)

FOREIGN PATENT DOCUMENTS

CL 2008003804 11/2009
CL 2018000974 7/2018

(Continued)

OTHER PUBLICATIONS

U.S. Office Action issued in U.S. Appl. No. 15/785,141, dated Oct. 10, 2018, 10 pages.

*Primary Examiner* — Terrell H Matthews
(74) *Attorney, Agent, or Firm* — FisherBroyles, LLP; Jason P. Mueller

(57) ABSTRACT

Disclosed embodiments include a removable support structure for a vibratory screening machine. The removable support structure is a single structure including one or more of plastic, metal, and composite materials and may be configured to provide mechanical support to one or more screening assemblies of the vibratory screening machine. The removable support structure may further be configured to be removably fastened to the vibratory screening machine. The removable support structure may be a single thermoplastic injection molded piece or may be a single injection molded piece that includes nylon, carbon, and graphite. The removable support structure may have a concave shape that is configured to mechanically support a screening assembly held under compression or may have a convex shape that is configured to mechanically support a screening assembly held under tension. A disclosed wear protective covering, made of a flexible material, provides wear protection to the removable support structure.

38 Claims, 38 Drawing Sheets

Related U.S. Application Data which is a continuation of application No. 16/460,496, filed on Jul. 2, 2019, now Pat. No. 11,052,427, which is a continuation-in-part of application No. 15/785,141, filed on Oct. 16, 2017, now Pat. No. 10,399,124.

(60) Provisional application No. 62/488,293, filed on Apr. 21, 2017, provisional application No. 62/408,514, filed on Oct. 14, 2016.

(58) Field of Classification Search
USPC ..... 209/311, 315
See application file for complete search history.

(56) References Cited

U.S. PATENT DOCUMENTS

| | | | | | |
|---|---|---|---|---|---|
| 4,732,670 | A * | 3/1988 | Nelson | B07B 1/48 | 209/403 |
| 5,037,536 | A * | 8/1991 | Koch | B07B 1/46 | 209/403 |
| 5,199,574 | A * | 4/1993 | Hollyfield, Jr. | B07B 1/42 | 209/315 |
| 5,337,901 | A * | 8/1994 | Skaer | B07B 1/28 | 209/314 |
| 5,341,939 | A * | 8/1994 | Aitchison | B07B 1/42 | 209/404 |
| 5,433,849 | A | 7/1995 | Zittel | | |
| 5,494,173 | A * | 2/1996 | Deister | F16C 33/80 | 384/473 |
| 5,673,797 | A * | 10/1997 | Bakula | B07B 1/4663 | 209/403 |
| 6,220,448 | B1 * | 4/2001 | Bakula | B07B 1/4663 | 209/403 |
| 10,399,124 | B2 | 9/2019 | Colgrove | | |
| 11,052,427 | B2 * | 7/2021 | Colgrove | B07B 1/46 | |
| 11,185,801 | B2 | 11/2021 | Colgrove | | |
| 2007/0131592 | A1 | 6/2007 | Browne | | |
| 2013/0105412 | A1 | 5/2013 | Burnett | | |
| 2015/0224541 | A1 * | 8/2015 | Dickinson | B07B 1/4645 | 209/325 |
| 2016/0158805 | A1 * | 6/2016 | Massman | B07B 1/4609 | 209/315 |
| 2017/0320098 | A1 * | 11/2017 | Knorr | B07B 13/16 | |
| 2019/0321858 | A1 * | 10/2019 | Colgrove | B07B 1/4618 | |
| 2021/0354172 | A1 * | 11/2021 | Colgrove | B07B 1/48 | |

FOREIGN PATENT DOCUMENTS

| | | | |
|---|---|---|---|
| CL | 2018000973 | | 8/2018 |
| CL | 2019001009 | | 6/2019 |
| CN | 1603012 | A | 4/2005 |
| CN | 1767908 | A | 5/2006 |
| CN | 102060339 | A | 5/2011 |
| CN | 202238600 | U | 5/2012 |
| CN | 102869458 | A | 1/2013 |
| CN | 103406267 | A | 11/2013 |
| CN | 103817075 | A | 5/2014 |
| CN | 104148278 | A | 11/2014 |
| CN | 105665268 | | 6/2016 |
| DE | 3109319 | | 9/1982 |
| EP | 1767283 | A2 | 3/2007 |
| EP | 4015096 | | 6/2022 |
| GB | 2550943 | A | 12/2017 |
| MX | 2019004358 | A | 8/2019 |
| WO | 2012140398 | A2 | 10/2012 |
| WO | 2015027321 | A1 | 3/2015 |

* cited by examiner

APPARATUSES, METHODS, AND SYSTEMS FOR VIBRATORY SCREENING

CROSS-REFERENCE TO RELATED APPLICATIONS

This application is a continuation-in-part of U.S. patent application Ser. No. 17/352,885, filed Jun. 21, 2021, which is a continuation of U.S. patent application Ser. No. 16/460,496, filed Jul. 2, 2019, which is a continuation-in-part of U.S. patent application Ser. No. 15/785,141, filed Oct. 16, 2017, which claims the benefit of U.S. Provisional Patent Application No. 62/408,514, filed Oct. 14, 2016, and U.S. Provisional Patent Application No. 62/488,293, filed Apr. 21, 2017. The disclosures of each of these applications is incorporated herein by reference in its entirety.

DETAILED DESCRIPTION

Figure 1:
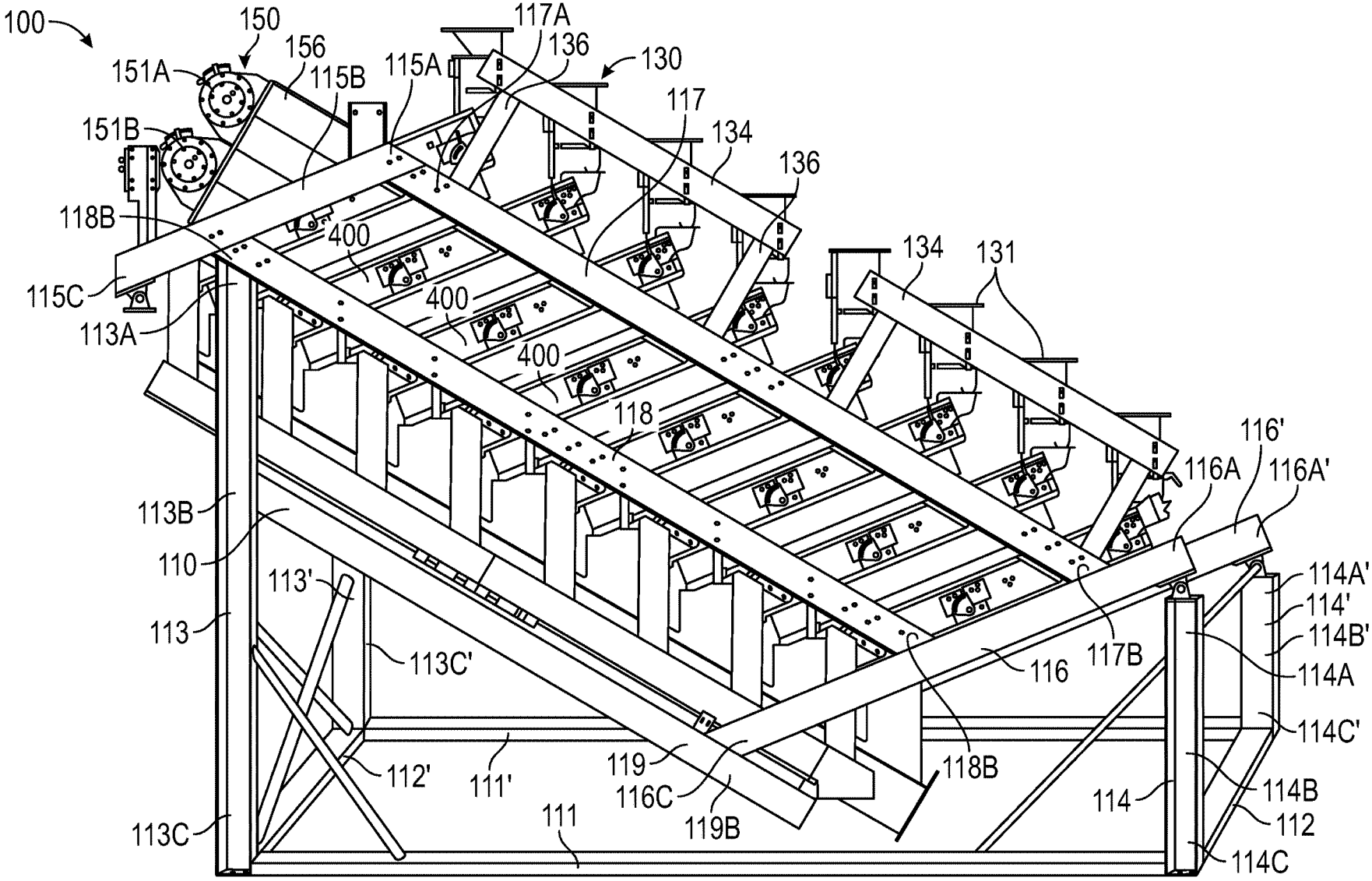
FIG. 1 is a perspective side view of a vibratory screening machine, according to one or more embodiments of the present disclosure.

Disclosed embodiments generally relate to methods and apparatuses for screening materials and for separating materials of varying sizes. Disclosed embodiments include screening systems, vibratory screening machines, and apparatuses for vibratory screening machines and screen assemblies for separating materials of varying sizes.

Vibratory screening systems are disclosed, for example, in U.S. Pat. Nos. 6,431,366 B2 and 6,820,748 B2, which are incorporated herein by reference. Advantages over previous systems include a larger screening capacity for separation of materials without an associated increase in machine size. Embodiments include improved features such as: screening deck assemblies having first and second screens; tensioning devices that tension each screen in a front-to-back direction (i.e., in the direction of flow of the material that is being screened); wash trays positioned in between the first and second screens; feed chutes configured to connect directly to an over-mounted feed system (e.g., the feed systems described in U.S. Pat. No. 9,18,008, which is incorporated herein by reference hereto); centralized discharge assemblies which collect undersized and oversized materials; and replaceable screen assemblies configured for front-to-back tensioning and impact areas for flow of material onto the screen assemblies.

These features, among others described herein, provide a compact design configured to receive material from a direct overhead feed system that has an increased screening capacity and reduced footprint. Additionally, the disclosed multiple screen assemblies that are tensioned front to back, having wash trays in between and impact areas on the screen assemblies, provide improved flow characteristics and efficiencies. The improved tensioning structures provide quick and easy replacement of screen assemblies. The improved discharge assemblies are configured for optimal or nearly optimal flow characteristics and provide a greatly reduced footprint.

Disclosed embodiments include vibratory screening machines that are configured to separate materials of varying sizes. In some embodiments, a vibratory screening machine includes a framing assembly, a plurality of screening deck assemblies mounted to the framing assembly, an undersized material-discharge assembly and an oversized material-discharge assembly. The framing assembly includes an inner frame mounted to an outer frame. A plurality of screening deck assemblies are mounted to the inner frame and are arranged in a stacked and staggered relationship. Each screening deck assembly includes a first screening deck, a second screening deck, a wash tray extending between first and second screening decks, and a tensioning assembly. A vibrating motor may be attached to the inner frame and/or to a screening deck assembly. An undersized material-discharge assembly and an oversized material-discharge assembly, each of which may include at least one vibratory motor, may be configured to be in communication with each screening deck assembly, and may be configured to receive undersized and oversized screened material, respectively, from the screening deck assemblies.

In an embodiment, a vibratory screening machine includes an outer frame, an inner frame connected to the outer frame, and a vibratory motor assembly secured to the inner frame and configured to vibrate the inner frame. A plurality of screen deck assemblies, each configured to receive replaceable screen assemblies, is attached to the inner frame in a stacked arrangement. The screen assemblies are secured to the screen deck assemblies by tensioning the screen assemblies in a direction that a material to be screened flows across the screen assemblies. An undersized material-discharge assembly is configured to receive materials that pass through the screen assemblies, and an oversized material-discharge assembly is configured to receive materials that pass over a top surface of the screen assemblies. The undersized material-discharge assembly includes an undersized chute in communication with each of the screen deck assemblies and the oversized material-discharge assembly includes an oversized chute assembly in communication with each of the screen deck assemblies.

The oversized chute assembly may include a first oversized chute assembly and a second oversized chute assembly. The undersized chute, the first oversized chute assembly, and the second oversized chute assembly may be located beneath the plurality of screen deck assemblies, and the undersized chute may be located between the first and second oversized chute assemblies. At least one of the plurality of screen deck assemblies may be replaceable. Each screen deck assembly may include a first screen assembly and a second screen assembly. A wash tray may be located between the first screen assembly and the second screen assembly. A trough may be located between the first screen assembly and the second screen assembly. The trough may include an Ogee-weir structure.

The vibratory screening machine may include a screen tensioning system that includes tensioning rods that extend in a direction that is substantially orthogonal to the direction of flow of the material being screened. The tensioning rods may be configured to mate with a portion of the screen assembly and to tension the screen assembly when rotated. The screen tensioning system may include a ratcheting assembly configured to rotate the tensioning rod such that it moves between a first open screen assembly receiving position to a second closed and secured screen assembly tensioned position.

The vibratory screening machine may include a vibratory motor that is attached to the oversized chute assembly. The vibratory screening machine may include multiple feed assembly units, each feed assembly unit located substantially directly below individual discharge pathways of a flow divider. The vibratory screening machine may include at least eight screen deck assemblies. Other embodiments may include greater or fewer numbers of screen deck assemblies.

The oversized chute assembly may include a bifurcated trough that is configured to receive materials that do not pass through the screen assemblies and are conveyed over a discharge end of the screen deck assemblies. A first section of the bifurcated trough may feed the first oversized chute assembly, and a second section of the bifurcated trough may feed the second oversized chute assembly.

In one embodiment, a screen deck assembly includes a first screen deck configured to receive a first screen assembly, a second screen deck configured to receive a second screen assembly located downstream from the first screen deck assembly; and a trough located between the first and second screen deck assemblies, wherein the first screen deck assembly is configured to receive a material to be screened and the trough is configured to pool the material to be screened before it reaches the second screen deck assembly.

The trough may include at least one of an Ogee-weir and a wash tray. The screen deck assembly may include a first and a second screen tensioning system, each having tensioning rods that extend in a direction that is substantially orthogonal to the direction of flow of the material to be screened. The first tensioning rod may be configured to mate with a first portion of the first screen assembly when rotated and the second tensioning rod may be configured to mate with a second portion of the second screen assembly when rotated.

The first screen tensioning system may include a first ratcheting assembly configured to rotate the first tensioning rod such that the first tensioning rod moves between a first open screen assembly receiving position to a second closed and secured screen assembly tensioned position. The second screen tensioning system may include a second ratcheting assembly configured to rotate the second tensioning rod such that the second tensioning rod moves between a first open screen assembly receiving position to a second closed and secured screen assembly tensioned position.

In one embodiment, a method of screening a material includes feeding the material on a vibratory screening machine having a plurality of screen deck assemblies that are configured in a stacked arrangement, each of the screen deck assemblies configured to receive replaceable screen assemblies, the screen assemblies secured to the screen deck assemblies by tensioning the screen assemblies in the direction the material flows across the screen assemblies; and screening the materials such that a undersized material that passes through the screen assemblies flows into an undersized material-discharge assembly, and an oversized material flows over an end of the screen deck assembly into an oversized material-discharge assembly. The undersized material-discharge assembly includes an undersized chute in communication with each of the screen deck assemblies and the oversized material-discharge assembly includes an oversized chute assembly in communication with each of the screen deck assemblies.

The oversized chute assembly may include a first and second oversized chute assembly. The undersized chute and first and second oversized chute assemblies may be located beneath the plurality of screen deck assemblies, and the undersized chute may be located between the first and second oversized chute assemblies.

At least one of the plurality of screen deck assemblies may be replaceable. Each screen deck assembly may include a first and a second screen assembly. A. trough may be located between the first and second screen assemblies. The trough may include an Ogee-weir structure.

A screen tensioning system may be included having tensioning rods that extend substantially orthogonal to the direction of flow of the material being screened. The tensioning rods may be configured to mate with a portion of the screen assembly and tension the screen assembly when rotated.

FIGS. 1 to 4 illustrate a vibratory screening machine 100. Vibratory screening machine 100 includes a framing assembly having an outer frame 110, and an inner frame 120 (e.g., see FIG. 2), a feed assembly 130, a plurality of screening deck assemblies 400, a top vibratory assembly 150, an undersized collecting assembly 160 and an oversized collecting assembly 170.

Figure 2:
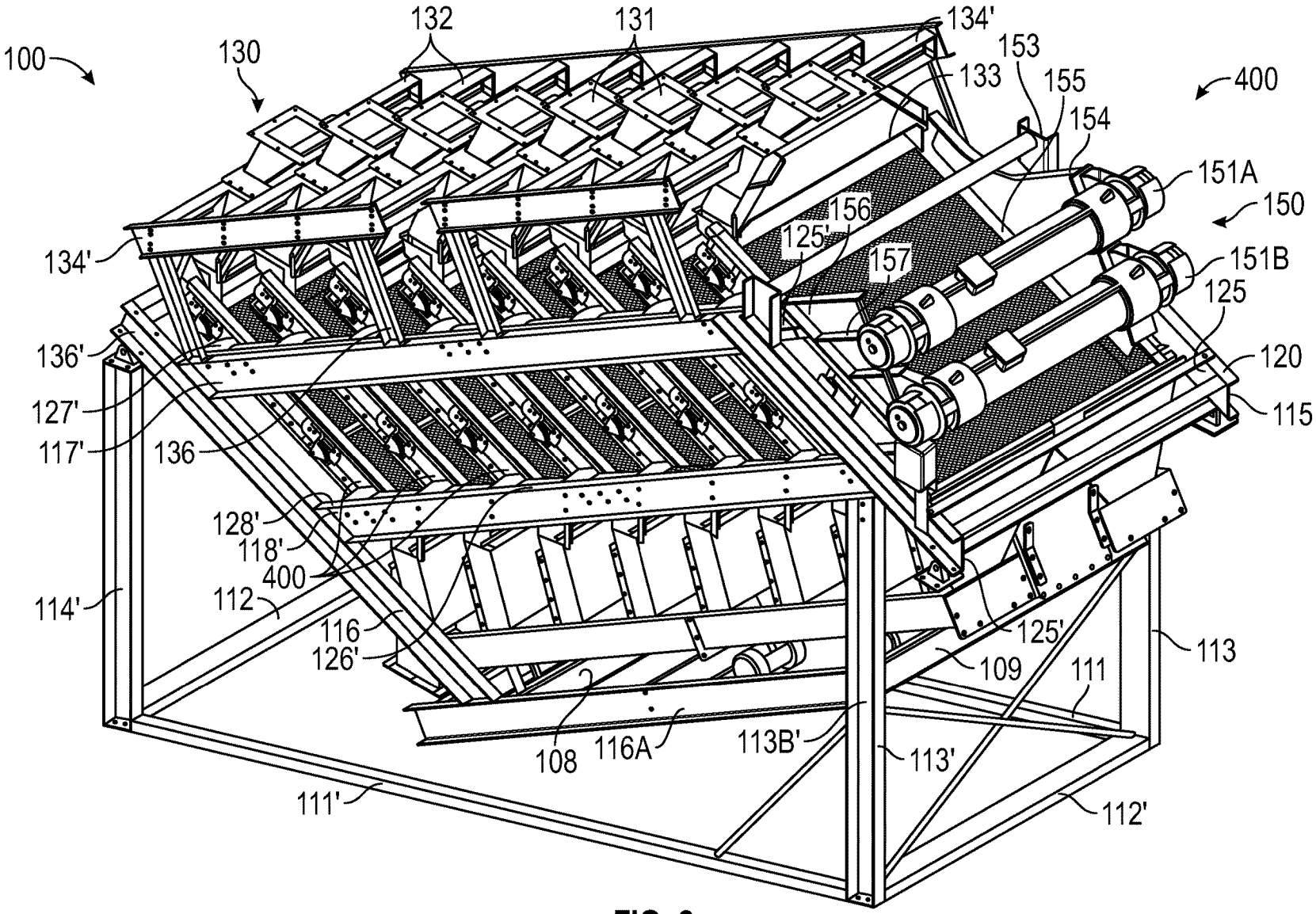
FIG. 2 is a perspective top view of the vibratory screening machine shown in FIG. 1, according to one or more embodiments of the present disclosure.

FIG. 1 illustrates a side perspective view of vibratory screening machine 100. FIG. 2 illustrates a top perspective view of vibratory screening machine 100, shown from the opposite side of vibratory screening machine 100 as is illustrated in FIG. 1. As is shown in FIG. 2, the opposite side of vibratory screening machine 100 includes mirror image components of outer frame 110 as is shown in FIG. 1. The mirror-image outer frame components are denoted by the addition of a prime (') at the end of the corresponding component reference number.

As is shown in FIGS. 1 and 2, outer frame 110 includes a longitudinal set of base supports 111 and 111', a latitudinal set of base supports 112 and 112', and two sets of upstanding channels, 113 and 113' and 114 and 114'. Upstanding channels 113 and 113' and 114 and 114' each have first ends 113A and 113'A and 114A and 114'A, mid-portions 113B and 113'B and 114B and 114'B, and second ends 113C and 113'C and 114C and 114'C, respectively. Each of first ends 113A and 113'A and 114A and 114'A are elevated relative to second ends 113C and 113'C and 114C and 114'C, with mid-portions 113B and 113'B and 114B and 114'B extending the length between the first and second ends, respectively. Outer frame 110 further includes upper angled channels 115 and 115' and lower angled channels 116 and 116'. Upper angled channels 115 and 115' and lower angled channels 116 and 116' each have first ends 115A and 116A, mid-portions 115B and 116B, and second ends 115C and 116C, respectively. First ends 115A and 116A are elevated relative to second ends 115C and 116C, and mid-portions 115B and 116B extend the length between first ends 115A and 116A and second ends 115C and 116C, respectively. Outer frame 110 also includes three sets of declining channels: 117 and 117', 118 and 118', and 119 and 119'. Each declining channel has a first end, 117A, 118A, and 119A, which is elevated relative to its respective second end, 117B, 118B, 119B.

Referring to FIGS. 1 and 2, the opposite ends of longitudinal base supports 111 and 111' attach to the opposite ends of latitudinal base supports 112 and 112' such that the four base supports create a rectangular shape. Second ends 113C and 113'C and 114C and 114'C of each respective upstanding channel attach to the four corners where base channels 111 and 111' meet base channels 112 and 112'. Mid-portion 113B and 113'B of upstanding channel 113 attaches to first end 119A of declining channel 119. Second end 119B of declining channel 119 rests above longitudinal base support 111. First end 113A of upstanding channel 113 attaches to mid-portion 115B of upper angled channel 115 and first end 118A of declining channel 118. First end 115A of upper angled channel 115 attaches to first end 117A of declining channel 117. Second end 117B of declining channels 117 attaches to mid-portion 116B of lower angled channel 116 towards first end 116A. Second end 118B of declining channel 118 attaches to mid-portion 116B of lower angled channel 116 toward second end 116C. Second end 116C of lower angled channel 116 attaches to and terminates at second end 119B of declining channel 119.

Referring to FIG. 2, outer frame 110 further includes a rear channel 109 having opposite ends that attach to one of each of mid-portions 113B and 113B' of upstanding channel 113. Additional rear channels 108 run parallel to rear channel 109, each with opposite end attached to lower angled channel 116 and its counterpart lower angled channel 116' from mid-portion 116B toward second end 116C to provide structural support to outer frame 110.

As is shown in FIG. 2, inner frame 120 mounts top vibratory assembly 150 and screening deck assemblies 400 via securing mechanisms, such as bolts. Inner frame 120 includes upper angled channels 125 and 125', lower angled channels 126 and 126', upper declining channels 127 and 127', and lower declining channels 128 and 128'. Upper and lower angled channels 125 and 126 of inner frame 120 run parallel to upper and lower angled channels 115 and 116 on the medial side of outer frame 110. Upper and lower declining channels 127 and 128 of inner frame 120 run parallel to declining channels 117 and 118 on the medial side of outer frame 110. Though not shown in FIGS. 1 and 2, inner frame 120 may be mounted to outer frame 110 with elastomeric mountings, or other similar mountings, which permit inner frame 120 to maintain vibratory motion while dampening the effects of vibration on the structural integrity of fixed outer frame 110. In an embodiment, elastomeric mountings are made of a composite material including rubber and have female threads that accept male bolts from the inner frame and outer frame. The elastomeric mountings may be replaceable parts. While outer frame 110 is shown in the specific configuration described, it may have different configurations as long as it provides the structural support necessary for inner frame 120. In embodiments, vibratory screening machine 100 may have an outer frame that includes feet that are configured to attach to an existing structure.

In some embodiments, top vibratory assembly 150 includes side plates 153 and 153', a first vibrating motor 151A and a second vibrating motor 151B. Side plates 153 and 153' have a top angled edge 154, a bottom edge 155, and an exterior surface 156. Bottom edge 155 of side plate 153 is secured to a side channel 430 of screening deck assembly 400 via securing mechanisms, such as bolts. Exterior surface 156 includes ribs 157 that provide structural support to top vibratory assembly 150. The opposing sides of vibrating motor 151A and second vibrating motor 151B are mounted to top angled edges 154 of side plates 153 and 153'. First and second vibrating motors 151A and 151B are configured such that they may vibrate all screening deck assemblies 400 mounted to inner frame 120. While shown with a particular configuration in FIGS. 1 and 2, it is noted that top vibratory assembly 150 may have other arrangements that retain the functionality described herein.

As is shown in FIG. 2, vibratory screening machine 100 includes a feed assembly 130. Feed assembly 130 includes support frame 134, a plurality of vertical supports 136, feed inlet ducts 131, mounting arms 132, and feed outlet ducts 133. Mounting arms 132 are secured to support frame 134 and 134' with securing mechanisms, such as bolts. Support frame 134 and 134' is located above and parallel to declining channels 117 and 117' of outer frame 110. Vertical supports 136 secure support frame 134 and 134' to declining channels 117 and 117' of outer frame 110 such that feed assembly 130 is fixed relative to vibrating inner frame 120. Inlet ducts 131 are configured to receive a flow of slurry from a flow divider device, such as shown in U.S. Pat. No. 9,718,008, which is incorporated herein by reference in its entirety. Other embodiments may incorporate other material flow assemblies. Material entering the flow divider device may be fed it to outlet ducts 133. Outlet ducts 133 are positioned above elevated sides of screening deck assemblies 400 such that each outlet duct 133 is configured to discharge a flow of materials 500 to each screening deck assembly 400. Earlier systems have hoses located a story above vibratory machines, whereas in assemblies of this disclosure, configurations of inlets on the vibratory machine provide substantially distributed drops in flow and greatly reduce the height of the machine. This is an important space saving feature of at least some embodiments of the present disclosure.

Figure 3:
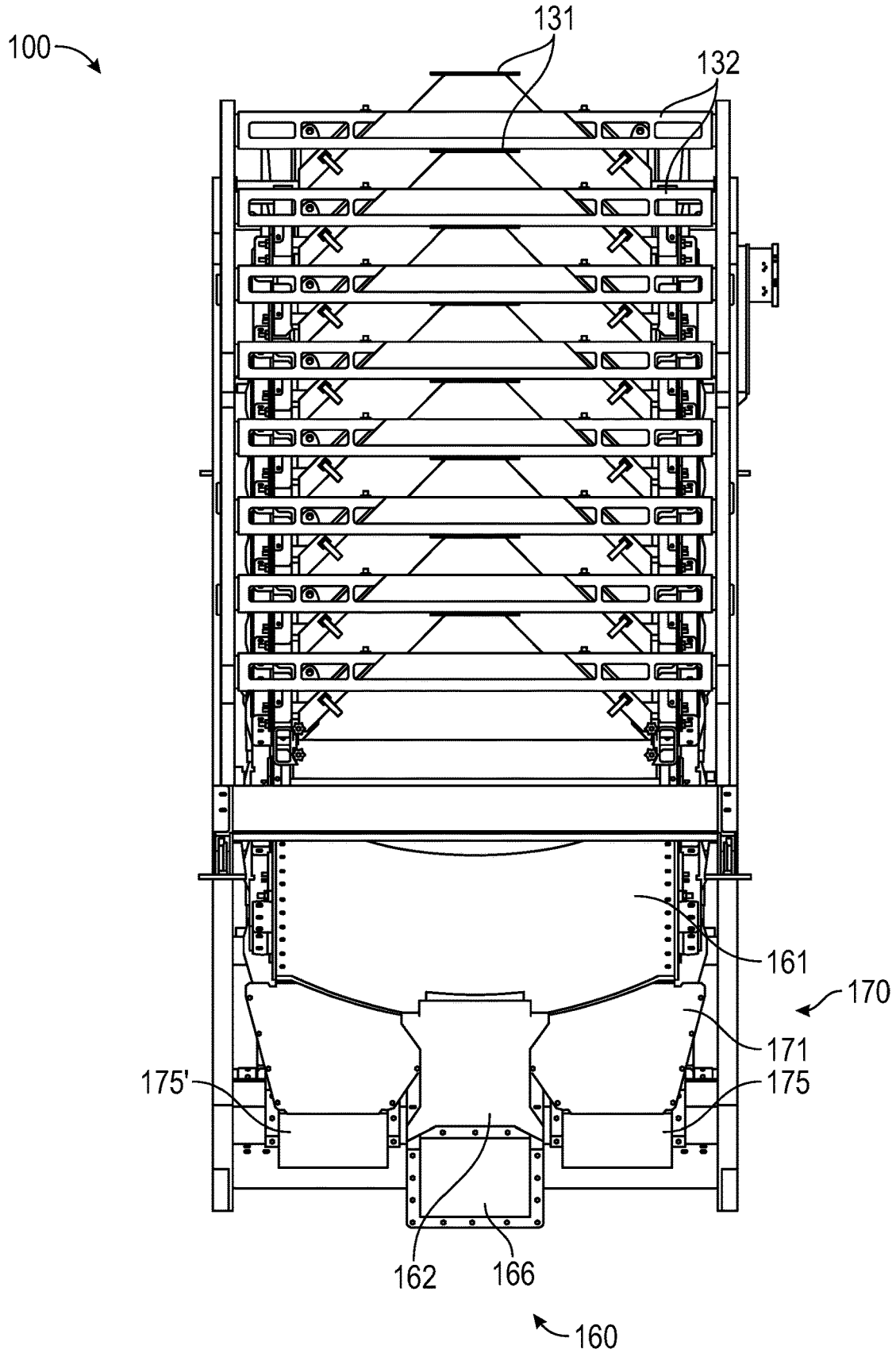
FIG. 3 is a front view of the vibratory screening machine shown in FIGS. 1 and 2, according to one or more embodiments of the present disclosure.
Figure 4:
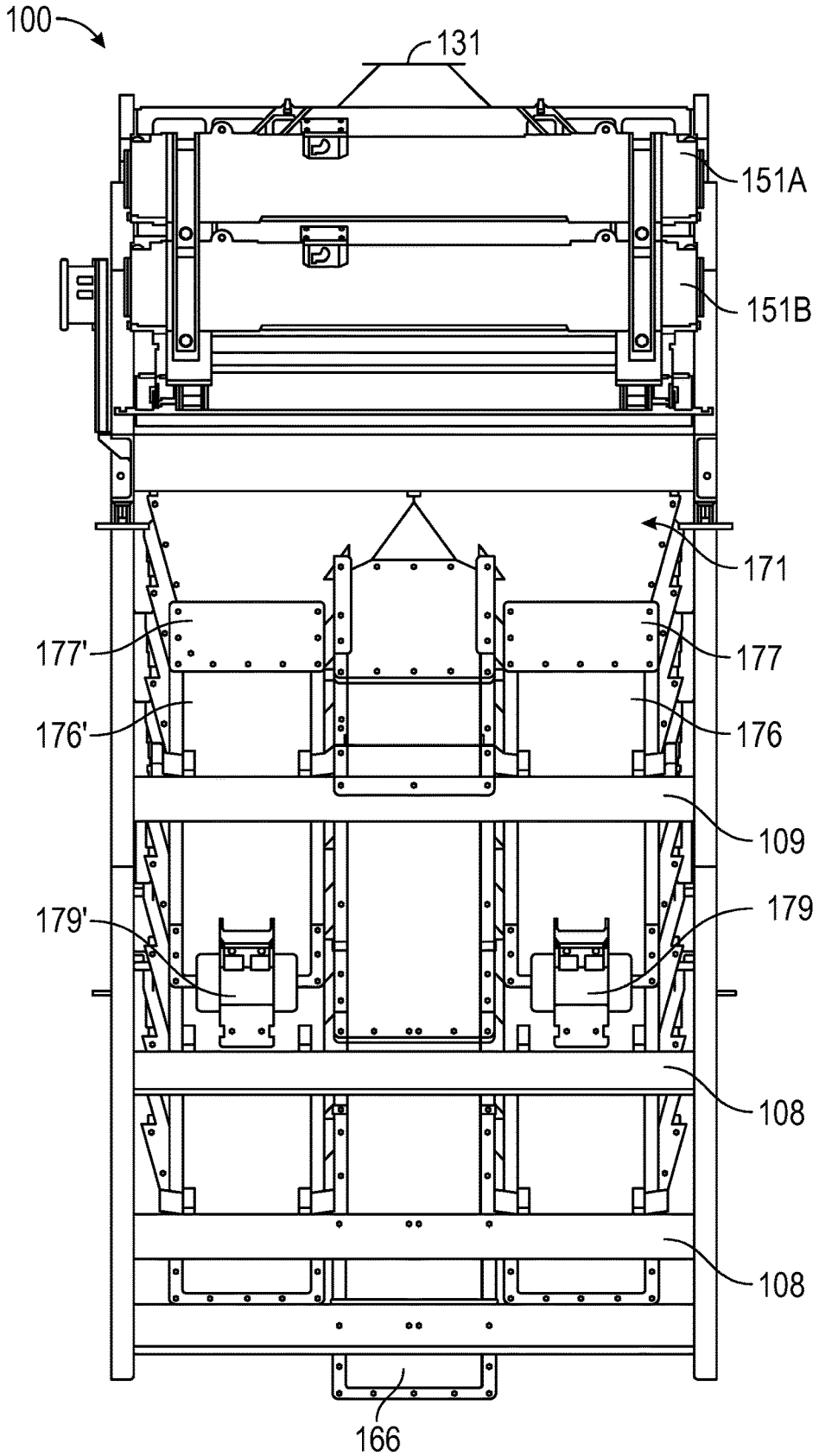
FIG. 4 is a rear view of the vibratory screening machine shown in FIGS. 1, 2, and 3, according to one or more embodiments of the present disclosure.

FIG. 3 illustrates a front view of the vibratory screening machine 100. FIG. 4 illustrates a rear view of the vibratory screening machine 100. As is shown in FIGS. 3 and 4, the vibratory screening machine 100 includes an undersized material collection assembly 160 and an oversized material collection assembly 170. Referring to FIG. 3, undersized material collection assembly 160 includes a plurality of collecting pans 161 secured to the underside of each screening deck assembly 400, a plurality of ducts 162 in communication with collecting pans 161, and an undersized collecting chute 166. Oversized material collection assembly 170 includes a plurality of oversized collecting chutes 171 mounted to lower end plate 428 of each screening deck assembly 400, and two oversized collecting troughs 176 and 176' in communication with oversized collecting chutes 171. As is shown in FIG. 4, oversized collecting troughs 176 and 176' include vibratory motors 179 and 179'. As is shown in FIGS. 3 and 4, undersized collecting chute 166 extends between oversized collecting chute 171 and oversized collecting troughs 176 and 176' beneath screening deck assemblies 400 of vibratory screening machine 100. Though shown in a specific configuration, oversized collecting troughs 176 and 176' and vibratory motors 179 and 179' may have different arrangements that aid in conveying oversized material 500 discharged from screening deck assemblies across oversized collecting troughs 176 and 176'.

Figure 5:
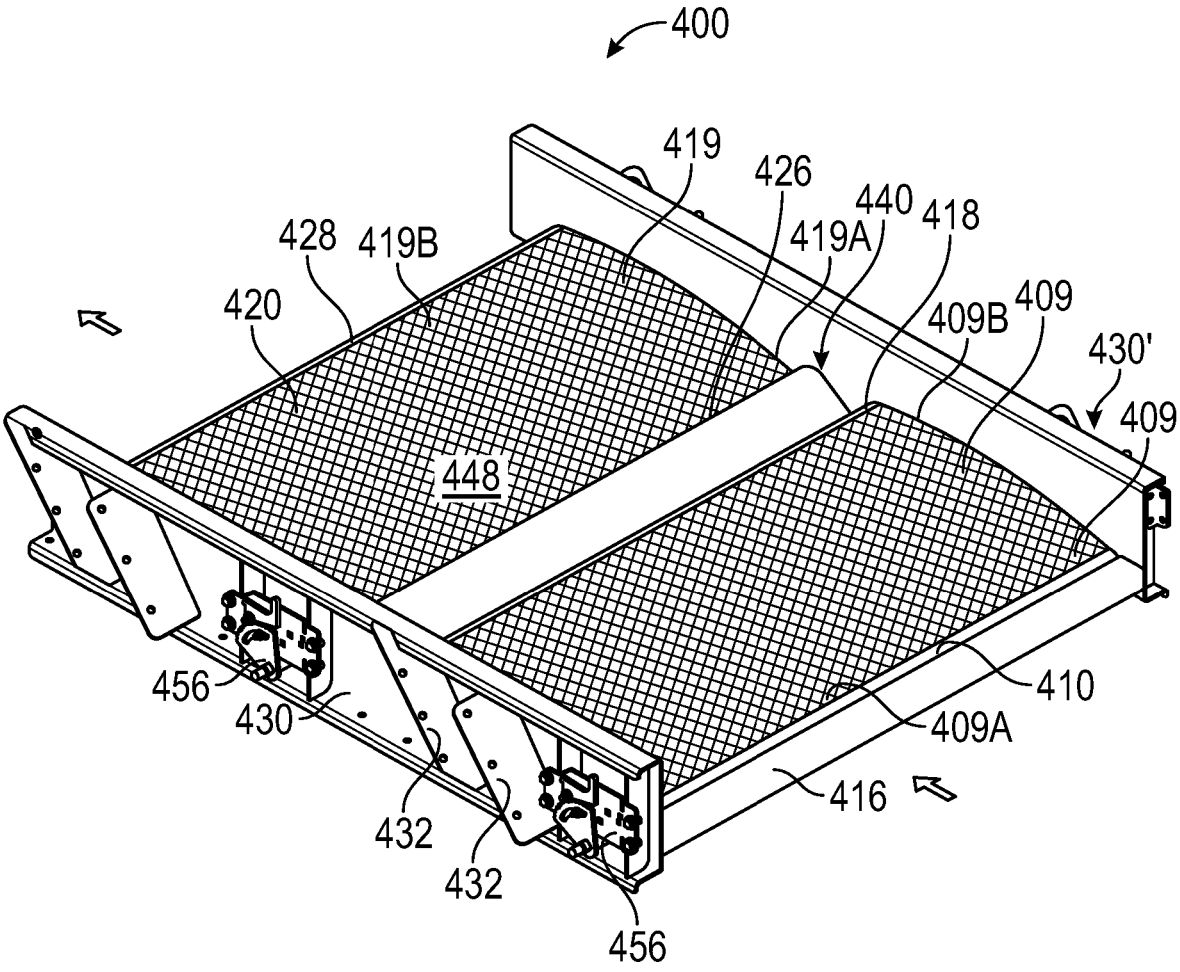
FIG. 5 is an isometric view of a screening deck having screen assemblies mounted thereon, according to one or more embodiments of the present disclosure.

FIGS. 5 to 10 illustrate various views of a screening deck 400. FIG. 5 illustrates an enlarged isometric perspective view of screen assembly 400. Screening deck assembly 400 includes a first screening deck 410, a second screening deck 420, side channels 430 and 430', a wash tray 440, and a tensioning device 450. As is shown in FIG. 5, first screening deck 410 and second screening deck 420 are covered by a first screen assembly 409 and a second screen assembly 419, respectively. First screen assembly 409 and second screen assembly 419 are replaceable screen assemblies which are attached to first and second screening decks 410 and 420. When in operation, material to be screened 500 by vibratory screening machine 100 is discharged from feed outlet ducts 133 of feed assembly 130 to the elevated side of first screen assembly 409, along feed end 409A of first screen assembly 409, and is vibrated across first screen assembly 409 of first screening deck 410, over discharge end 409B of first screen assembly 409, and into wash tray 440.

Vibration carries material 500 over wash tray 440, where material passes over feed end 419A of second screen assembly 419. As is described herein, material 500 hits second screen assembly 419 in screen impact area 448, then vibrates across second screen assembly 419 of second screening deck 420, and over discharge end 419B of second screen assembly 419 along lower end plate 428. First screen assembly 409 and second screen assembly 419 are configured such that undersized materials fall through first screen assembly 409 and second screen 419 into undersized material collecting pans 161, and are funneled into undersized collecting chute 166 via ducts 162. Oversized materials do not pass through screens 409 and 419 and are vibrated off lower end plate 428 and funneled through oversized collecting chutes 171 and 171' to oversized collecting troughs 176 and 176'. Direction of the flow of material is represented with large arrows.

While illustrated in this particular configuration in the figures, oversized collecting chutes 171 and 171' and oversized collecting troughs 176 and 176' may have different arrangements that receive oversized materials discharged from each screening deck assembly and provide functionality as described herein. The flow of material through split outside oversized collecting chutes 171, 171' and a central undistributed undersized collecting chute 166 allows efficient flows in reduced space. The configuration of the chutes 166, 171, 171' reduces the footprint of the machine 100 while providing direct and efficient flow.

First screening deck 410 includes an upper end plate 416 and a lower end plate 418. Second screening deck 420 includes an upper end plate 426 and a lower end plate 428. Opposite sides of first screening deck 410 and second screening deck 420 are secured to the medial sides of side channels 430 and 430' with securing mechanisms (e.g., bolts or welding). The lateral sides of side channels 430 and 430' include a plurality of angled plates 432. Angled plates 432 include holes through which securing mechanisms, such as bolts, may extend to secure side channels 430 and 430' to upper declining channel 127 and 127' and lower declining channel 128 and 128' of inner frame 120. While illustrated in this particular arrangement, side channels 430 and 430' and angled plates 432 may have different configurations that permit screening deck assembly 400 to vibrate such that materials 500 of varying sizes are separated as desired.

Figure 6:
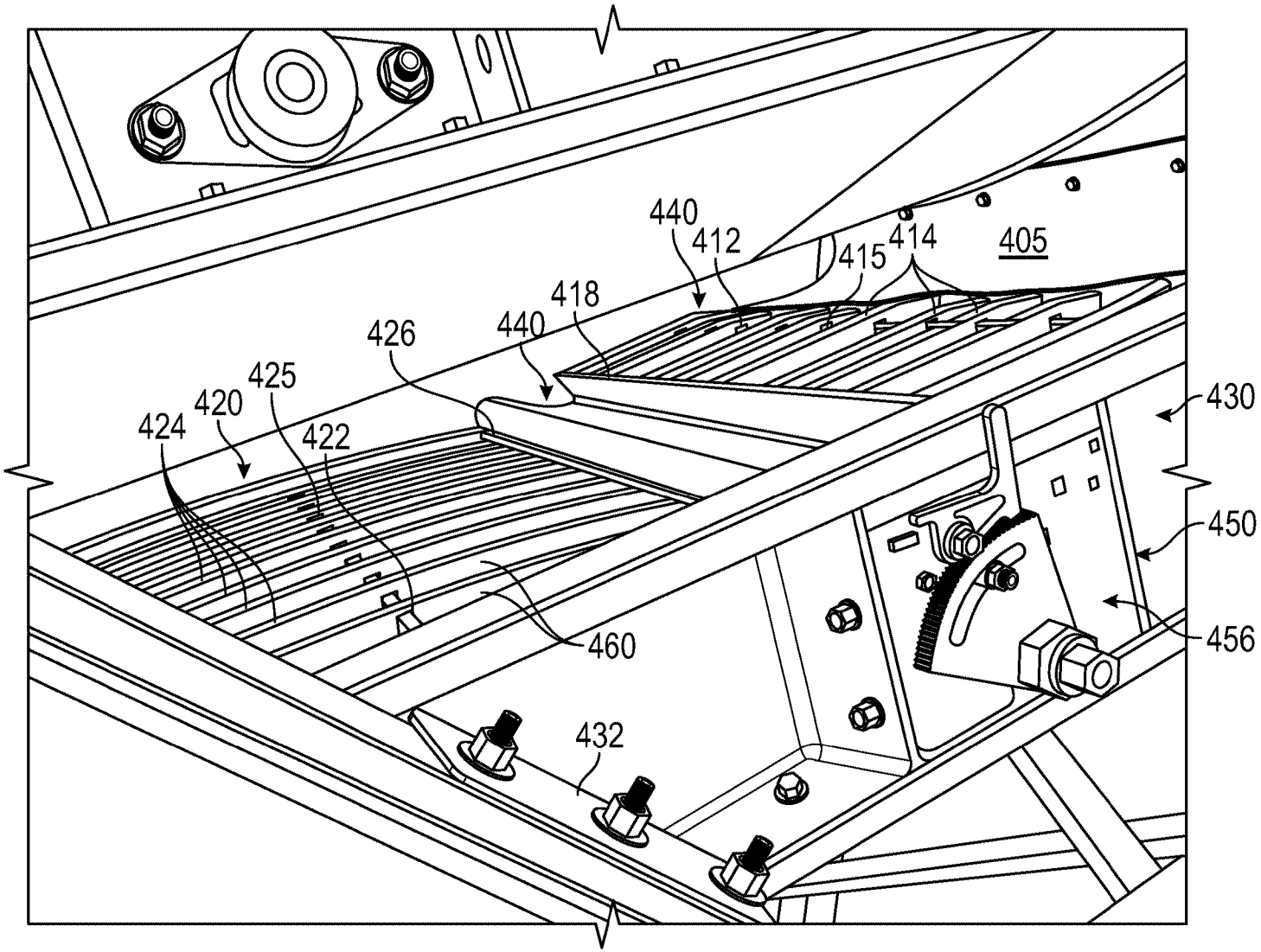
FIG. 6 is an enlarged partial isometric view of the screening deck shown in FIG. 5, without screen assemblies mounted thereon, incorporated into the vibratory screening machine shown in FIGS. 1, 2, 3, and 4, according to one or more embodiments of the present disclosure.

FIG. 6 illustrates a partial side perspective view of screening decks 410 and 420, wash tray 440, side channel 430, and a portion of tensioning device 450. As is shown in FIG. 6, a flexible material 405 covers outlet duct 133 of feed assembly 130. Flexible material 405 is configured to control the flow of materials from outlet duct 133 to screening deck assembly 400 so that the flow of material is uniformly distributed across screening deck assembly 400, thereby maximizing efficiency of vibratory screening machine 100. As is shown in FIG. 6, first screening deck 410 and second screening deck 420 do not include screens 409 and 419, but it will be appreciated that first and second screening decks 410 and 420 are covered by screens 409 and 419 when vibratory screening machine 100 is employed to separate materials of varying sizes, and can be replaced, as described herein, when worn or damaged.

Referring to FIG. 6, first screening deck 410 includes a rib 412, stringers 414 (e.g., support structures), an upper end plate 416 and a lower end plate 418. Second screening deck 420 includes a rib 422, stringers 424, an upper end plate 426 and a lower end plate 428. Opposite ends of ribs 412 and 422 extend from side channel 430 and 430' at each of the midpoints between upper end plate 416 (e.g., see FIG. 5) and lower end plate 418 of first screening deck 410, and upper end plate 426 and lower end plate 428 (e.g., see FIG. 5) of second screening deck 420, respectively. A plurality of stringers 414 and 424 extend from upper end plates 416 and 426 to lower endplates 418 and 428, respectively. A midpoint 415 of each stringer 414 and a midpoint 425 of each stringer 424 traverses the top surface of ribs 412 and 422. Midpoints 415 and 425 are elevated with respect to opposite ends of stringers 414 and 424 such that stringers 414 and 424 create a "crown" or convex curvature across first and second screening decks 410 and 420. Though first screening deck 410 and second screening deck 420 are shown with a single rib 412 and 422 respectively, it will be appreciated that first screening deck 410 and second screening deck 420 may include other configurations. First screening deck 410 and second screening deck 420 may include, respectively, a first plurality of ribs and a second plurality of ribs, as long as the additional ribs provide the functionality as described herein. In some embodiments at least one (or, in some embodiments, each one) of the first plurality of ribs and the second plurality of ribs can be assembled similarly to rib 412 or rib 422.

Distinct from screening assemblies of other systems, such as those disclosed in U.S. Pat. No. 6,431,366, stringers 414 and 424 may be replaceable units, and may be fastened to ribs 412 and 422 rather than welded to ribs 412 and 422. Stringers 414 and 424 may be fastened to ribs 412 and 422 using various fasteners, such as bolts. This configuration eliminates closely spaced weld joints between ribs 412 and 422 and stringers 414 and 424 that are commonly found in welded screening decks. This arrangement eliminates the shrink, heat distortion and drop associated with closely spaced weld joints, and enables rapid replacement of worn or damaged stringers 414 and 424 in the field. Replaceable stringers 414 and 424 may include plastic, metal, and/or composite materials and may be constructed by casting and/or injection molding. While not shown in FIG. 6, screening decks 410 and 420 are configured to support screens 409 and 419 (e.g., see FIG. 5), which extend across the surface of first screening deck 410 and second screening deck 420, covering ribs 412 and 422 and stringers 414 and 424, respectively, as is shown in FIG. 5.

With further reference to FIG. 6, upper end plate 416 (e.g., see FIG. 5) of first screening deck 410 is elevated relative to lower end plate 418. Similarly, upper end plate 426 of second screening deck 420 is elevated relative to lower end plate 428 (e.g., see FIG. 5). Wash tray 440 extends between lower endplate 418 of first screening deck 410 and upper endplate 426 of second screening deck 420. First screening deck 410, wash tray 440, and second screening deck 420 are configured such that a flow of material from outlet duct 133

(e.g., see FIG. 2) and flexible material 405 of feed assembly 130 traverses first screening deck 410 and wash tray 440 before traversing second screening deck 420. This configuration enables a flow of materials to be effectively separated by increasing the surface area on which the flow of materials is screened into oversized material collecting assembly 170 (e.g., see FIG. 3) and undersized material collecting assembly 160 (e.g., see FIG. 3) without increasing the footprint of vibratory screening machine 100 (e.g., see FIGS. 1 and 2).

Figure 7:
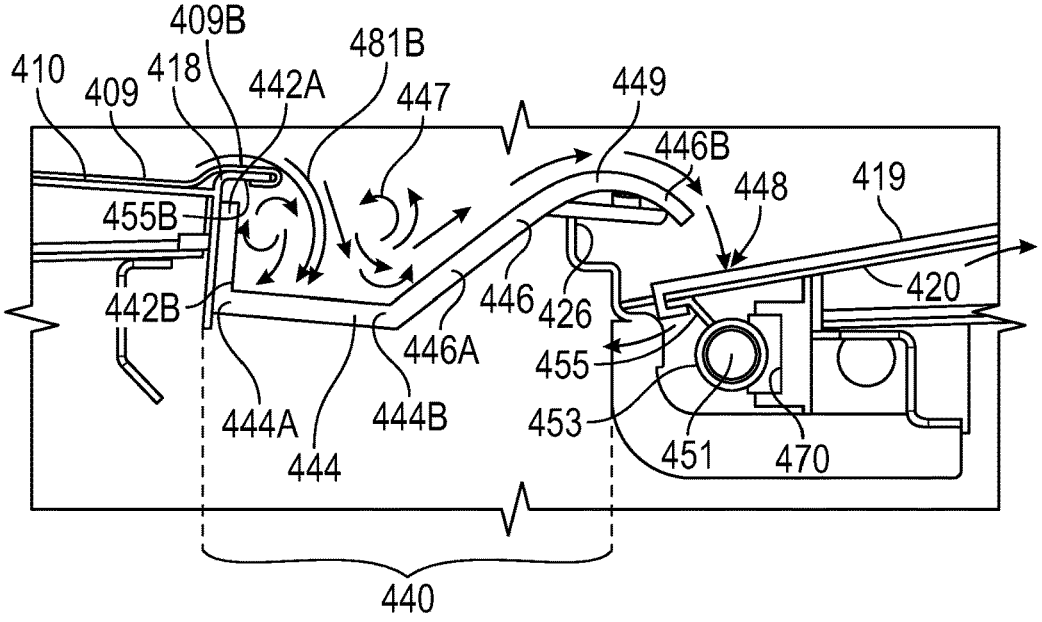
FIG. 7 is an enlarged side view of a wash tray, which may be incorporated into the screening deck shown in FIGS. 5 and 6, according to one or more embodiments of the present disclosure.

FIG. 7 illustrates an isometric side view of wash tray 440 interfacing with first screening deck 410 and second screening deck 420. As is shown in FIG. 7, wash tray 440 includes an upper side member 442 having a top portion 442A and a bottom portion 442B, a lower member 444 having a first end 444A and a second end 444B, and a curved side member 446 including a first end 446A and a second end 446B. Curved side member 446 includes an S-shape curve referred to as an "Ogee," discussed in more detail below. Top portion 442A of upper side member 442 connects to lower end plate 418 of first screening deck 410. Bottom portion 442B of upper side member 442 connects to first end 444A of lower member 444. Second end 444B of lower member 444 connects to first end 446A of curved side member 446. Second end 446B of curved side member 446 curves over upper end plate 426 of second screening deck 420.

The resulting configuration of wash tray 440 generates a weir 447, which is a trough or depression that provides a structure for pooling a flow of liquid or slurry material to be screened 500. Embodiments of a wash tray 440 having an Ogee-weir structure possess functional significance in the field of fluid dynamics. An Ogee-weir structure is generally described as slightly rising up from the base of a weir and reaching a maximum rise 449 at the top of the S-shaped curve of the Ogee structure. Upon or after reaching maximum rise point 449, fluid falls over the Ogee structure in a parabolic form. The discharge equation for an Ogee-weir is:

$$Q = \frac{2}{3} C_d \times L \sqrt{2g(H)^{\frac{3}{2}}}$$

As is shown in FIG. 7, incorporating wash tray 440 with an Ogee-weir curved side member 446 between first screening deck 410 and second screening deck 420 of screening deck assembly 400 may direct the flow of material screened by first screening deck 410 onto a desired impact point or impact area 448 near upper end plate 426 of second screening deck 420, or another desired location, such that the discharge flow impacts the downstream screen panel at a predetermined wear surface as opposed to non-uniformly impacting downstream screen surfaces such as the screen openings. In this configuration, impact point/area 448 may remain unchanged despite changes in fluid parameters such as, e.g., flowrate and/or viscosity. Incorporation of Ogee-weir shaped curved side member 446 into wash tray 440 improves screening efficiency and consistency and reduces wear on second screening deck 420. Flows of materials after impact are represented with large arrows in FIG. 7.

Figure 8:
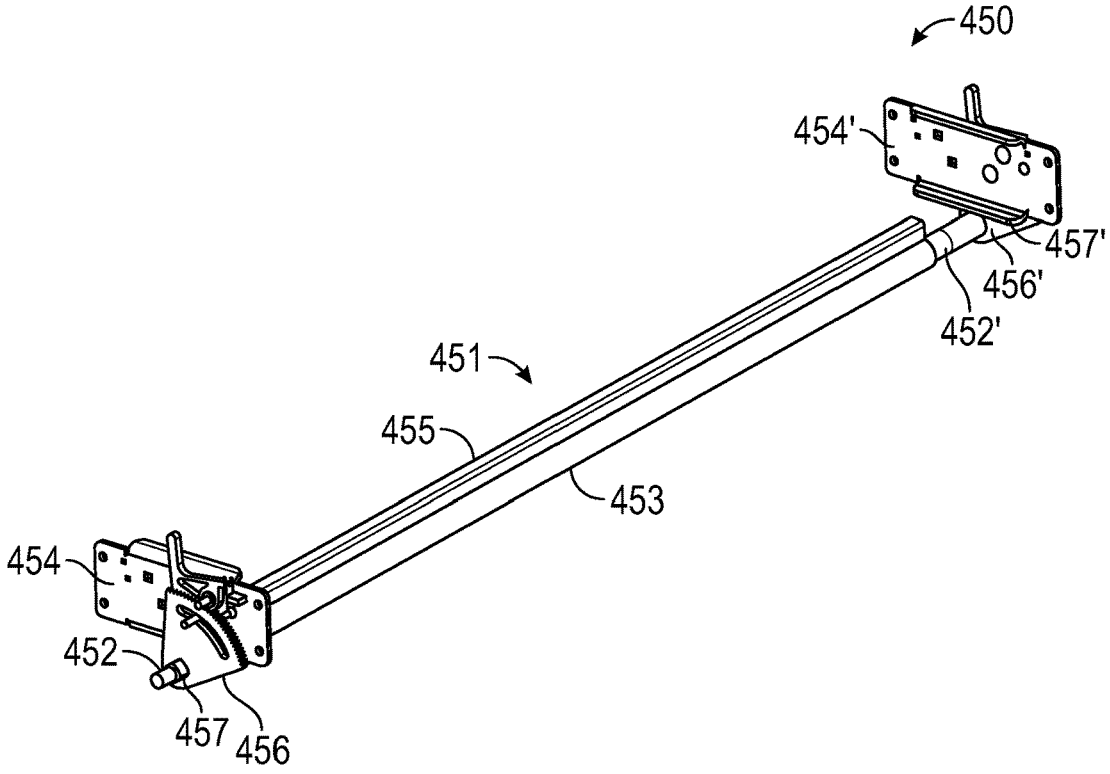
FIG. 8 is an isometric view of a tensioning device with a ratchet mechanism, according to one or more embodiments of the present disclosure.
Figure 9A:
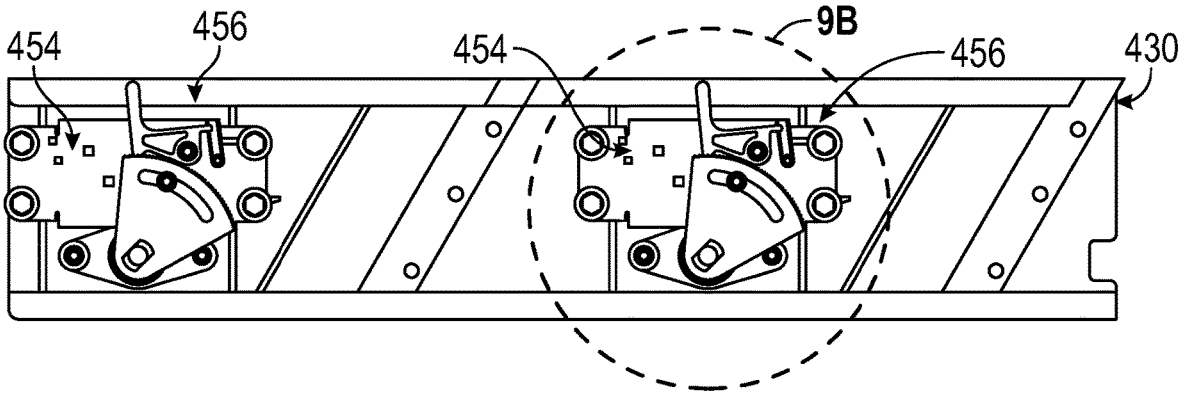
FIG. 9A is a side view of the screening deck shown in FIGS. 5, 6, and 7 with the ratchet mechanism shown in FIG. 8, according to one or more embodiments of the present disclosure.
Figure 9B:
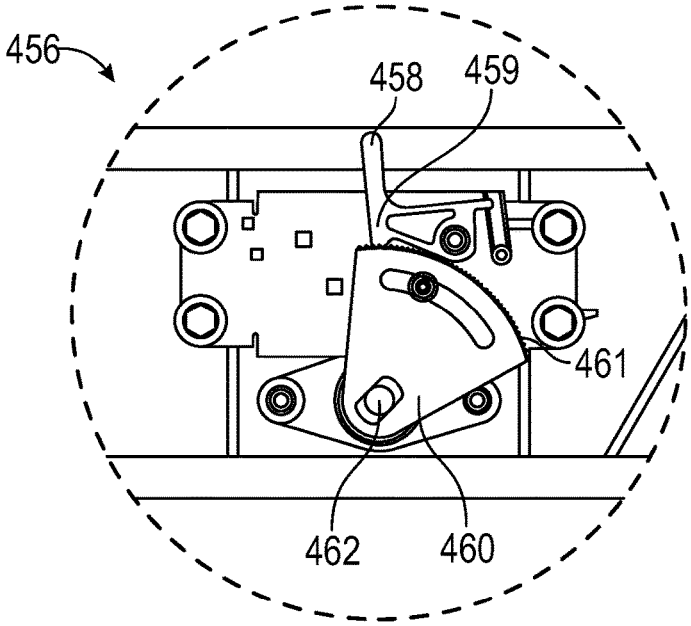
FIG. 9B is an enlarged view of the ratchet mechanism shown in FIG. 9A, according to one or more embodiments of the present disclosure.

FIGS. 8, 9A and 9B illustrate tensioning device 450. FIG. 8 illustrates an isometric perspective view of tensioning device 450. Tensioning device 450 includes a tensioning rod 451, brackets 454 and 454', and ratchet mechanisms 456 and 456'. FIG. 9A illustrates a partial side view of two ratchet mechanisms 456 and two brackets 454 mounted to side channel 430 of screening deck assembly 400. FIG. 9B illustrates an enlarged view of one of two ratchet mechanisms 456 and brackets 454 shown in FIG. 9A. As described in more detail below, each screening deck assembly 400 includes two tensioning devices 450, one configured to enable tensioning of screen assembly 409 of first screening deck 410, and the other configured to enable tensioning of screen 419 of second screening deck 420.

Referring to FIG. 8, tensioning device 450 includes a tensioning rod 451, brackets 454 and 454', and ratchet mechanisms 456 and 456'. Tensioning rod 451 includes opposing, mirror image ends 452 and 452,' a tubular mid-portion 453, and a tensioning strip 455. Opposing ends 452 and 452' of tensioning rod 451 extend through holes 457 and 457' in ratchet mechanisms 456 and 456', respectively, and are secured to ratchet mechanisms 456 and 456' by securing mechanisms, such as bolts. Ratchet mechanisms 456 and 456' are secured to brackets 454 and 454', which are in turn secured to side channels 430 and 430', respectively, of screening deck assembly 400, by securing mechanisms, such as bolts, as is shown in FIGS. 9A and 9B.

While not shown in FIG. 8, tubular mid-portion 453 of tensioning rod 451 extends the width of screening deck assembly 400 from side channel 430 to side channel 430'. Tensioning rods 451 of each tensioning device 450 are located beneath upper end plate 416 of first screening deck 410 and upper end plate 426 of second screening deck 420. Tubular mid-portion 453 and tensioning strip 455 of tensioning device 450 are configured to receive an end of screen assembly 409 and/or 419. Opposing end 452, tubular mid-portion 453, and tensioning strip 455 of tensioning rod 451 are arranged so that when opposing end 452 and tubular mid-portion 453 rotate in a counter-clockwise direction, tensioning strip 455 rotates in a clockwise direction, thereby pulling screen assembly 409 and/or 419 towards upper end plate 416 of first screening deck 410 and/or upper end plate 426 of second screening deck 420. While shown in FIG. 8 as having tubular mid-portion 453 and tensioning strip 455, tensioning device 450 may include other components that are configured receive an end of screen assembly 409 and/or 419 and that are connected to ratchet mechanism 456 to permit ratchet mechanism 456 to rotate tensioning rod 451 and pull screen assembly 409 and/or 419 toward upper end plates 416 and/or 426.

FIG. 9A illustrates a partial side view of two ratchet mechanisms 456 and two brackets 454 of two tensioning devices 450 mounted to side channel 430 of screening deck assembly 400. FIG. 9B illustrates an enlarged view of ratchet mechanism 456 and bracket 454. Though not shown, tensioning rods 451 extend from each ratchet mechanism 456 on side channel 430 of screening deck assembly 400 to each ratchet mechanism 456' on opposing side channel 430' beneath upper end plates 416 and 426 of screening deck assembly 400.

Figure 10:
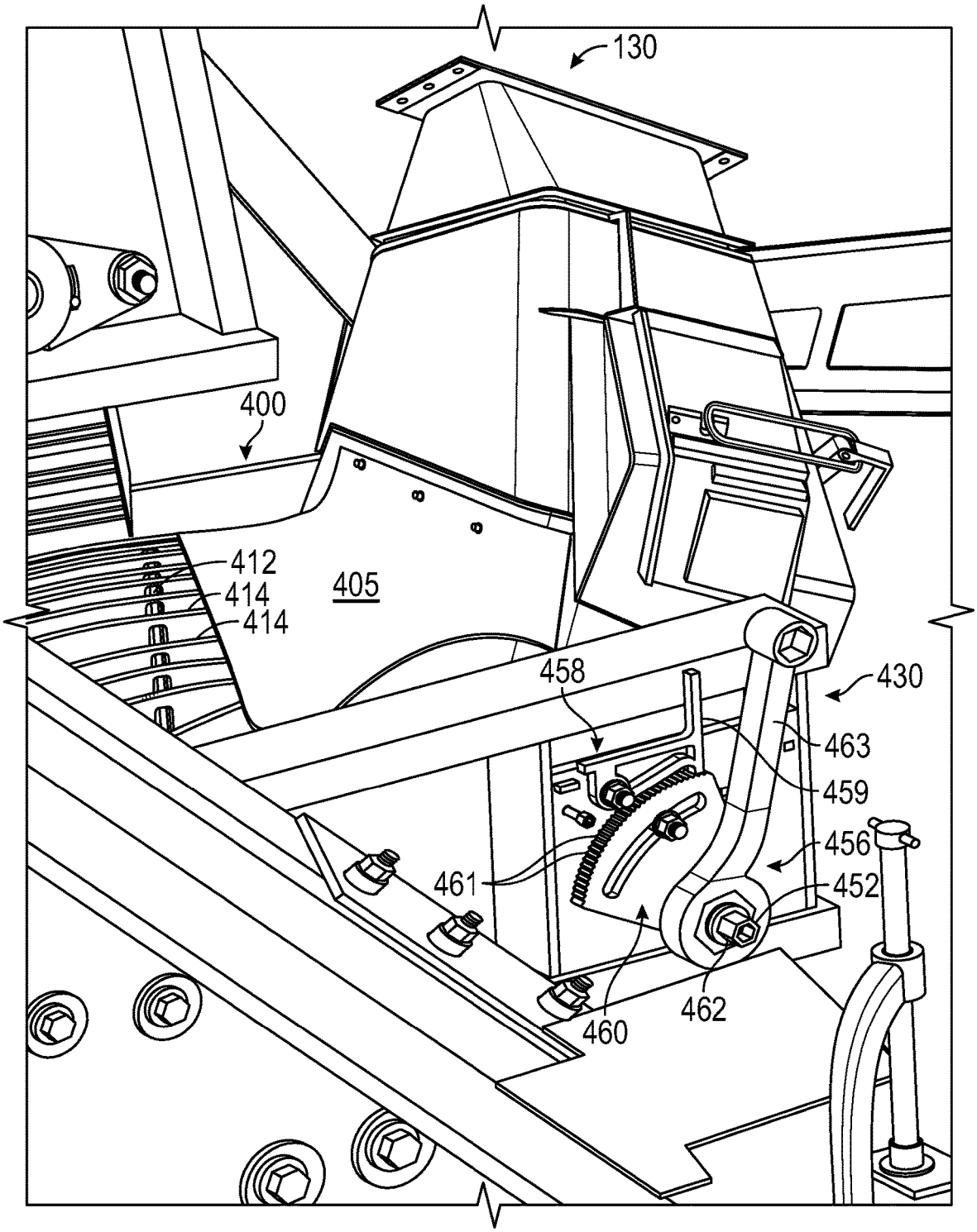
FIG. 10 is an enlarged partial isometric view of a feed assembly and the screening deck shown in FIGS. 5, 6, and 7 secured to the vibratory screening machine shown in FIGS. 1, 2, 3 and 4, according to one or more embodiments of the present disclosure.

FIG. 10 illustrates an enlarged partial perspective view of ratchet mechanism 456 mounted to side channel 430 below first screening deck 410. First screening deck 410 is shown interfacing with feed assembly 130 and flexible flow controlling material 405. As is shown in FIG. 10, ratchet mechanism 456 includes an upper portion 458 and a lower portion 460. Upper portion 458 includes a locking bar 459 that interfaces with a multitude of teeth 461 on lower portion 460. Lower portion 460 includes an actuation point 462 where second end 452 of tensioning rod 451 extends through hole 457 of ratchet mechanism 456. Referring to FIG. 10, a wrench 463 is configured to rotate actuation point 462 of ratchet mechanism 456. In response to application of a counter-clockwise rotational force to wrench 463, actuation point 462 and tubular mid-portion 453 of tensioning rod 451 are configured to rotate in a counter-clockwise direction, and tensioning strip 455 is configured to rotate in a clockwise direction such that tensioning device 450 pulls an end of screen assembly 409 toward upper end plate 416.

In response to rotation of wrench 463 and actuation point 462 of ratchet mechanism 456, locking bar 459 of upper portion 458 and teeth 461 of lower portion 460 are configured to lock the tensioning device in place and retain tension. Whereas conventional tensioning devices used in vibratory screening machines apply tension in a side-to-side direction, or towards side channels 430 and 430' relative to vibratory screening machine 100, tensioning device 450 disclosed herein applies tension in a front-to-back direction, or towards upper end plate 416 and lower end plate 418 of first screening deck 410 and/or upper end plate 426 and lower end plate 428 of second screening deck 420 relative to vibratory screening machine 100. Unlike conventional tensioning devices, the front-to-back direction of tensioning provided by tensioning device 450 corresponds with the direction of the flow of material (e.g., slurry), across first and second screening decks as it is separated by vibratory screening machine 100. Though shown with wrench 463 in FIG. 10, other tools may be employed to rotate actuation point 462 of ratchet mechanism 456, provide functionality as described herein.

Figure 11A:
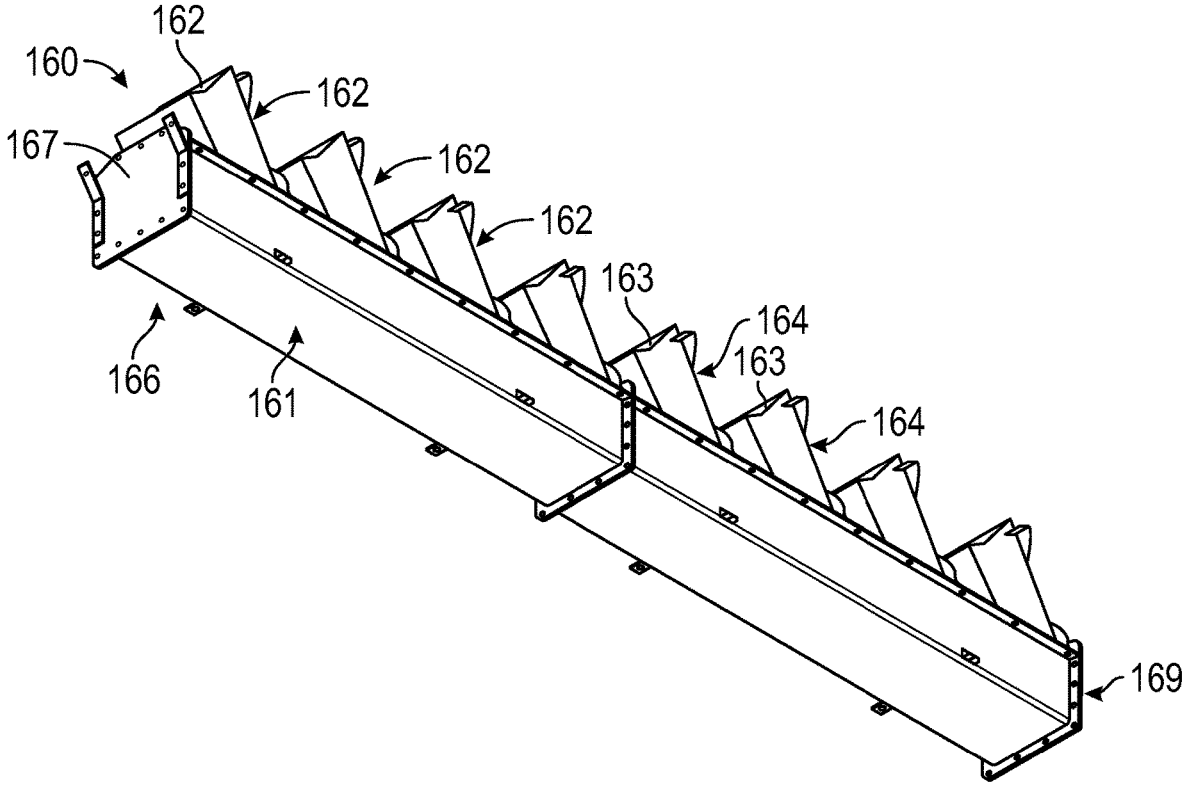
FIG. 11A is an isometric bottom view of an undersized material-discharge assembly, according to one or more embodiments of the present disclosure, according to one or more embodiments of the present disclosure.
Figure 11B:
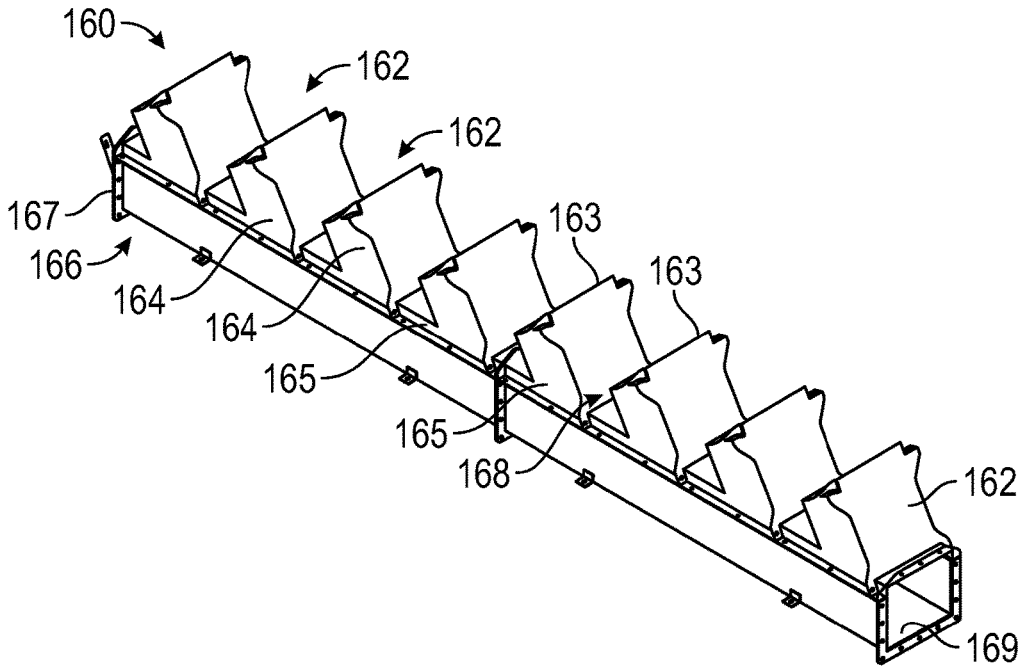
FIG. 11B is an isometric top view of the undersized material-discharge assembly shown in FIG. 11A, according to one or more embodiments of the present disclosure.

FIGS. 11A and 11B illustrate an embodiment of undersized material collection assembly 160. Undersized material collection assembly 160 includes a plurality of collecting pans 161 secured to the underside of each screening deck assembly 400 (see FIGS. 3 and 4), a plurality of ducts 162 in communication with collecting pans 161, and an undersized collecting chute 166. As is shown in FIGS. 11A and 11B, undersized collecting chute 166 includes a mounting end 167, which may be secured to outer frame 110 of vibratory screening machine 100 by securing mechanisms, such as bolts, a top surface 168 that runs the length of collecting chute 166, and a discharge port 169. Each duct 162 includes an inlet 163, a chamber 164, and an outlet 165. Inlet 163 of each duct 162 is configured to receive undersized material from collecting pans 161 and funnel the material through chamber 164 of duct 162 to outlet 165.

Each outlet 165 communicates with a portion of top surface 168 of undersized collecting chute 166 such that material discharged from outlets 165 of ducts 162 enters collecting chute 166 and exits through discharge port 169. An undersized material feeder may be configured to receive undersized material discharged from discharge port 169. Though not shown, inlets 163 of ducts 162 may include radial clearances to accommodate vibratory motion from collecting pans 161 (see FIGS. 3 and 4), which are mounted to screening deck assemblies 400, whereas ducts 162 and collecting chute 166 are mounted to fixed outer frame 110. The placement of the undersized collecting chutes directly beneath ducts 162 increases the efficiency of vibratory screening machine 100 and saves space by centralizing the flow of all undersized material into a central channel.

FIGS. 12A to 13B illustrate oversized material collection assembly 170. Oversized material collection assembly 170 includes a plurality of oversized collecting chutes 171 mounted to lower end plate 428 of each screening deck assembly 400, and two oversized collecting troughs 176 and 176' in communication with oversized collecting chutes 171 (see FIGS. 3 and 4, for example).

Figure 12A:
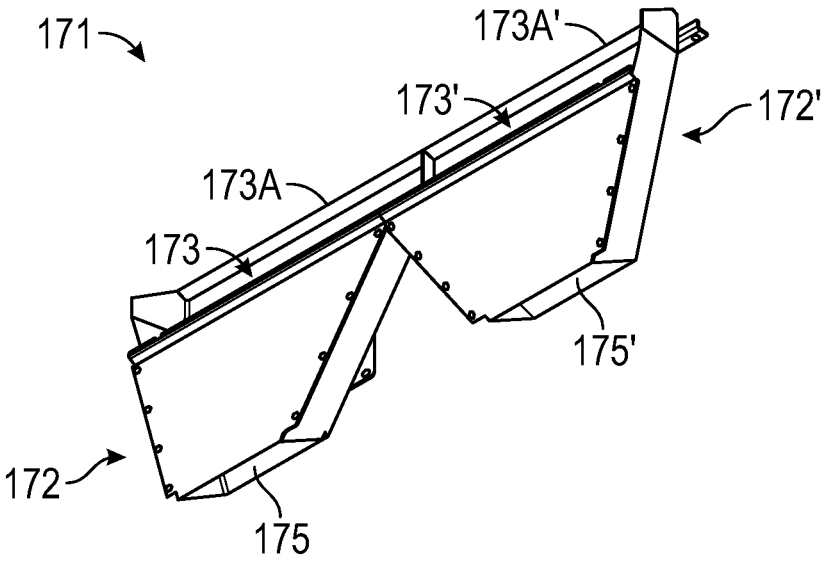
FIG. 12A is an isometric bottom view of an oversized material-discharge chute, according to one or more embodiments of the present disclosure, according to one or more embodiments of the present disclosure.
Figure 12B:
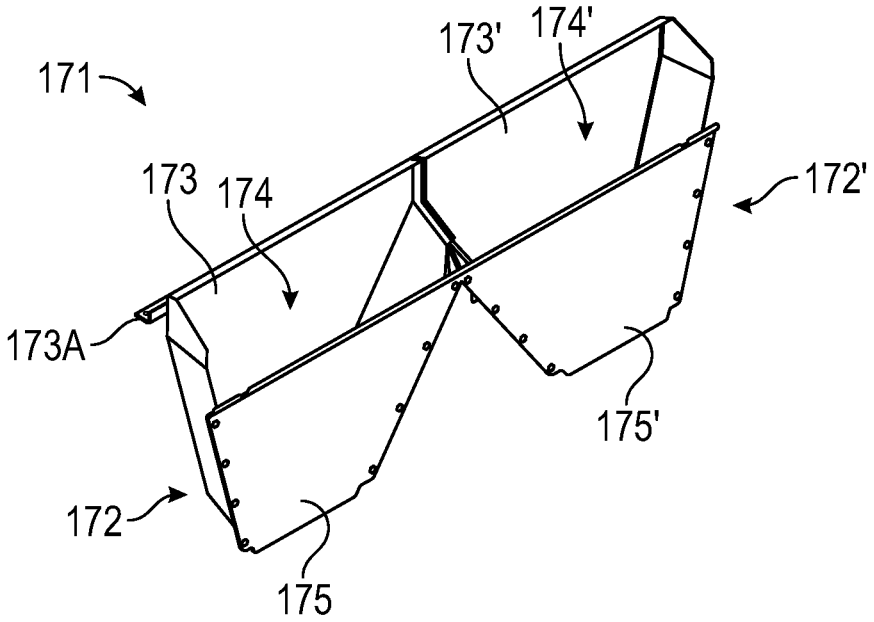
FIG. 12B is an isometric top view of the oversized material-discharge chute shown in FIG. 12A, according to one or more embodiments of the present disclosure.
Figure 13A:
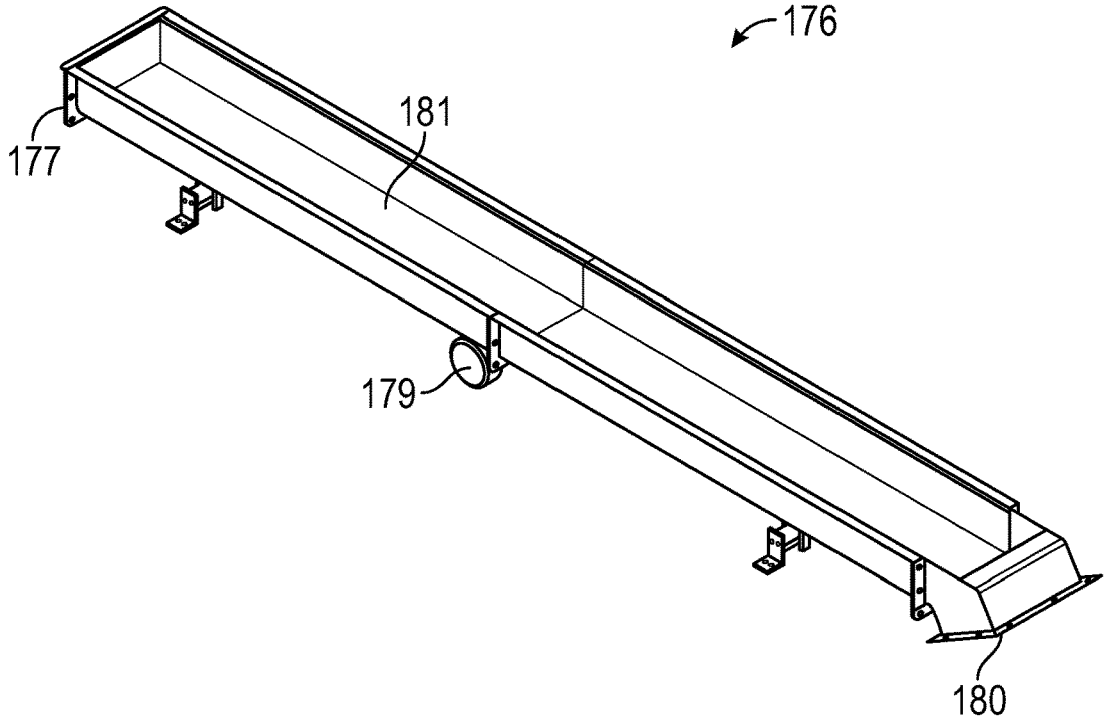
FIG. 13A is an isometric top view of an oversized material-discharge trough, according to one or more embodiments of the present disclosure, according to one or more embodiments of the present disclosure.
Figure 13B:
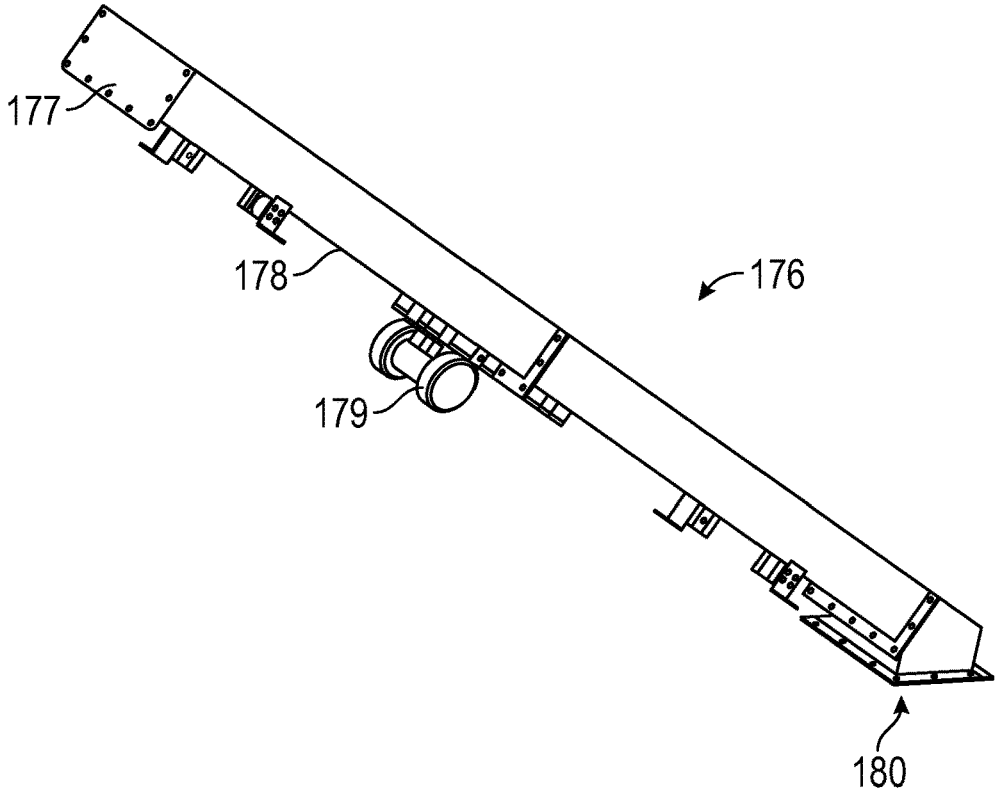
FIG. 13B is an isometric bottom view of the oversized material-discharge trough shown in FIG. 13A, according to one or more embodiments of the present disclosure.

FIGS. 12A and 12B illustrate an embodiment of oversized collecting chute 171. FIGS. 13A and 13B illustrate an embodiment of oversized collecting trough 176. Referring to FIGS. 12A & 12B, each oversized collecting chute 171 includes a first side 172 and a second side 172' mirroring first side 172, both having an inlet 173 with a mounting arm 173A, a chamber 174, and an outlet 175. Mounting arms 173A of each oversized collecting chute 171 are secured to each lower endplate 428 of screening deck assemblies 400 with securing mechanisms, such as bolts, such that material that does not pass through screens 409 and/or 419 to undersized discharge assembly rolls off lower endplate 428 of screening deck assemblies 400 into inlet 173 of oversized material collecting chute 171 (see FIGS. 3 to 4, for example). Upon or after entry into inlet 173, oversized material is funneled through chamber 174, and discharged from outlet 175 into oversized collecting trough 176. While shown having a trapezoidal shape, it will be appreciated that oversized collecting chute 171 is not limited to this configuration. Oversized collecting chute 171 may have other arrangements, so long as such a chute can receive oversized material from lower endplate 428 of screening deck assemblies 400 and can transfer oversized material to one of oversized collecting troughs 176 and 176'.

Referring to FIGS. 13A and 13B, oversized collecting trough 176 includes a mounting end plate 177, a back surface 178, an outlet 180, and a channel 181. Mounting end plate 177 is secured to rear channel 129 of inner frame 120 with securing mechanisms, such as bolts (see FIGS. 3 and 4, for example). Channel 181 extends from mounting end plate 177 to outlet 180 beneath each outlet 175 of oversized collecting chutes 171 such that oversized material discharged from each of oversized collecting chutes 171 falls into channel 181 of oversized collecting trough 176. A vibratory motor 179 is mounted to back surface 178 of oversized collecting trough 176 with securing mechanisms, such as bolts, to increase the rate at which oversized material passes through channel 181 to outlet 180, thus increasing the volume of material that vibratory screening machine 100 may process overall. Though not shown, an oversized material feeder may be configured to receive oversized materials discharged from outlet 180 of oversized collecting trough 176.

Figure 14:
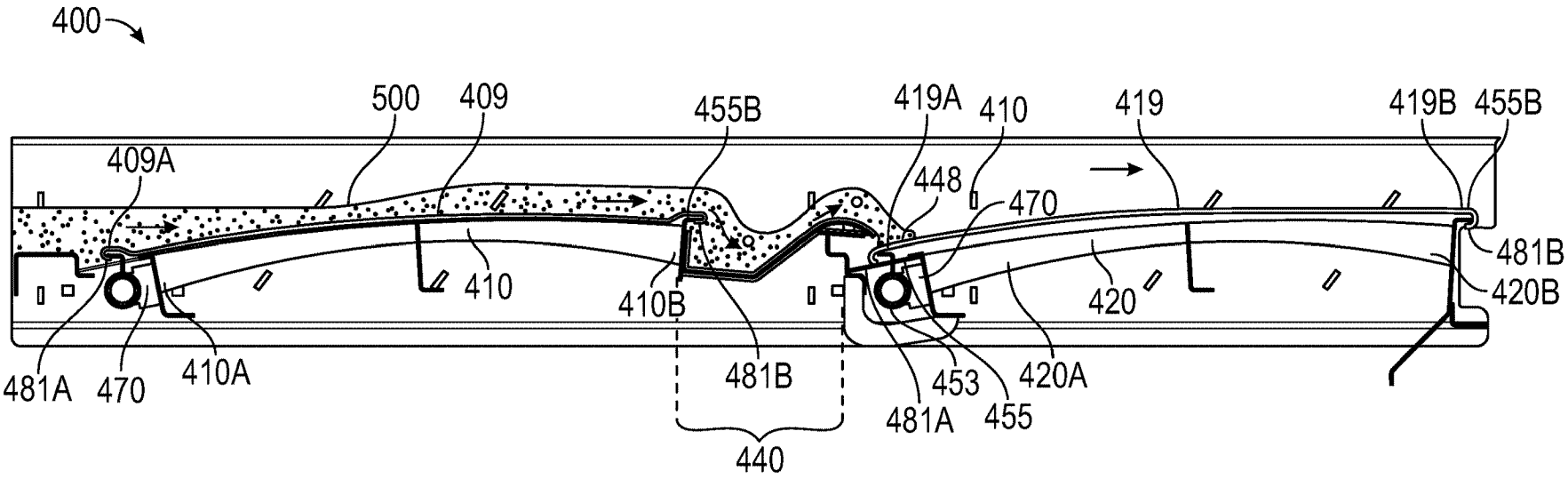
FIG. 14 is a cross-sectional side view of a screening deck having material flowing across the screening deck and featuring an impact area of a screen assembly incorporated into a screening deck assembly, according to one or more embodiments of the present disclosure.

FIG. 14 is a side view similar to FIG. 7 of screening deck assembly 400 showing details of tensioning assembly 450 tensioning second screen 419 along second screening deck 420. As indicated in FIG. 14, material to be screened 500 flows via vibration across first screen assembly 409 toward discharge end 409B of first screen assembly 409. During passage, appropriately sized particles of material 500 pass through openings or pores 488A of first screen assembly 409. After passing over the discharge end 409B of first screen assembly 409B, material 500 passes into wash tray 440 and over curved side member 446 and maximum rise 449. After passing over maximum rise 449, the material 500 lands on an impact area 448 of second tray 419, and then vibrates across second screen 419, passing from input end 419A to discharge end 419B, with appropriately sized particles of material 500 passing through second screen 419 along the way. Screens 409, 419 are selectively affixed to decks 410, 420 via deck clips 455B of the decks 410, 420 and tensioning strips 455 of the tensioning devices 450, in a manner described in greater detail below.

As it can be understood from FIG. 14, and as is explained in further detail below, a discharge end 409B, 419B of screen assemblies 409, 419 is attached to a fixed deck clip 455B, while an opposing input end 409A, 419A is attached to a tensioning strip 455 of tensioning device 450. When tensioning strip 455 is rotated, the screen assembly 409, 419 is tensioned front-to-back across the associated deck 410, 420, in the same direction that material to be screened flows across the screen deck assembly 400. This is an improvement over earlier systems, where screen assemblies were tensioned from the sides, leaving a crown that was perpendicular to the flow of the material to be screened, creating valleys and inefficiencies in flows.

Figure 15:
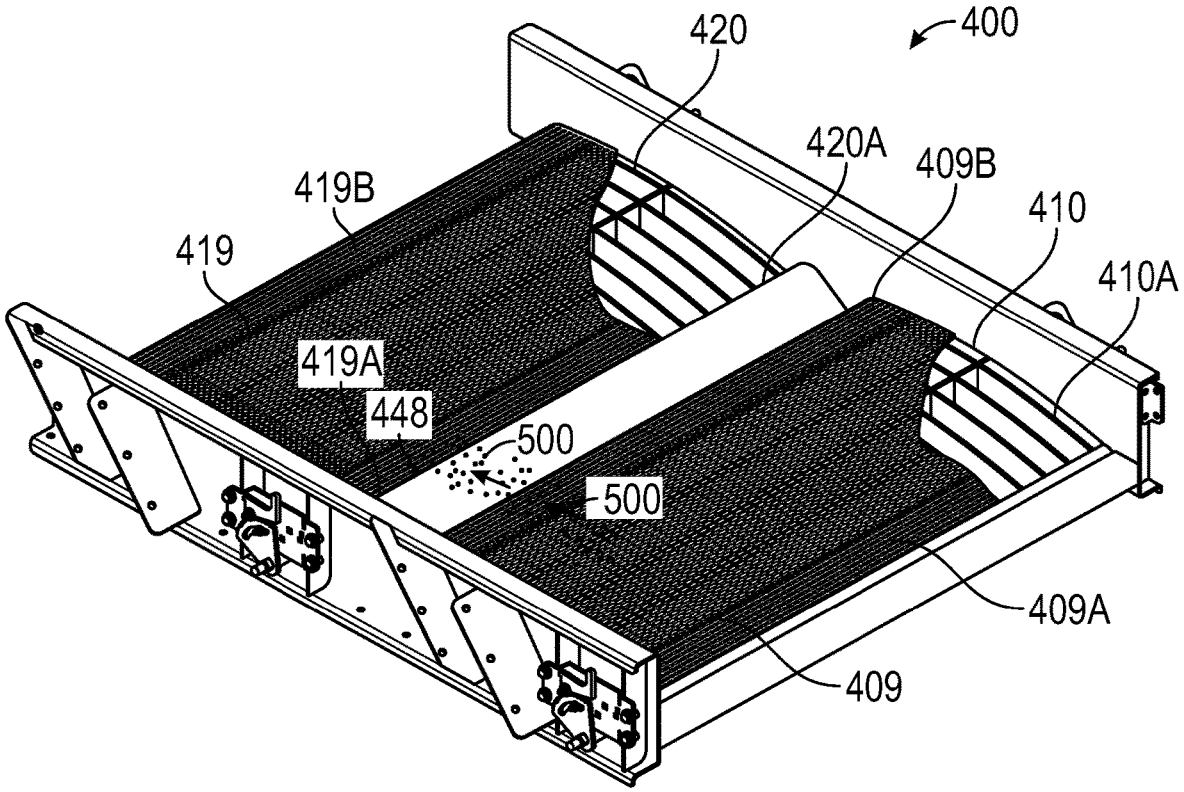
FIG. 15 a side view of a tray showing material to be filtered falling on an impact area of a filter member, according to one or more embodiments of the present disclosure.

FIG. 15 is a side perspective view of a screening deck assembly 400 (e.g. also see FIGS. 5, 6, and 10) showing additional details of first and second screen assemblies 409, 419 tensioned over first and second screening decks 410, 420, respectively. In FIG. 15, portions of screens 409, 419 have been cutaway to show aspects of decks 410, 420 below the screens (including removable and replaceable stringers as described above with reference to FIGS. 6 and 10). Material 500 is shown passing over wash tray 440 and landing on impact area 448 of second filter 419.

Figure 16B:
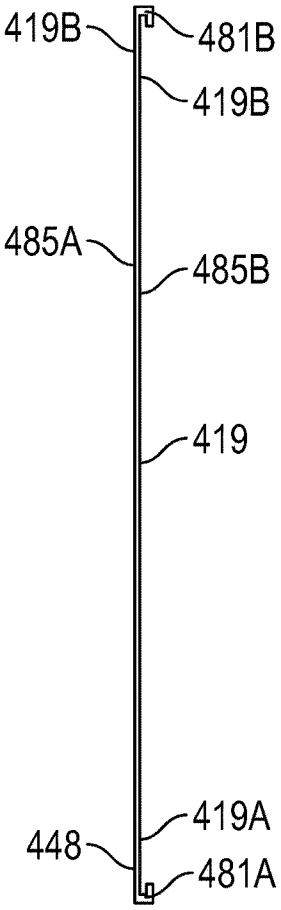
FIG. 16B is a side view of a screen filter, according to one or more embodiments of the present disclosure.
Figure 16A:
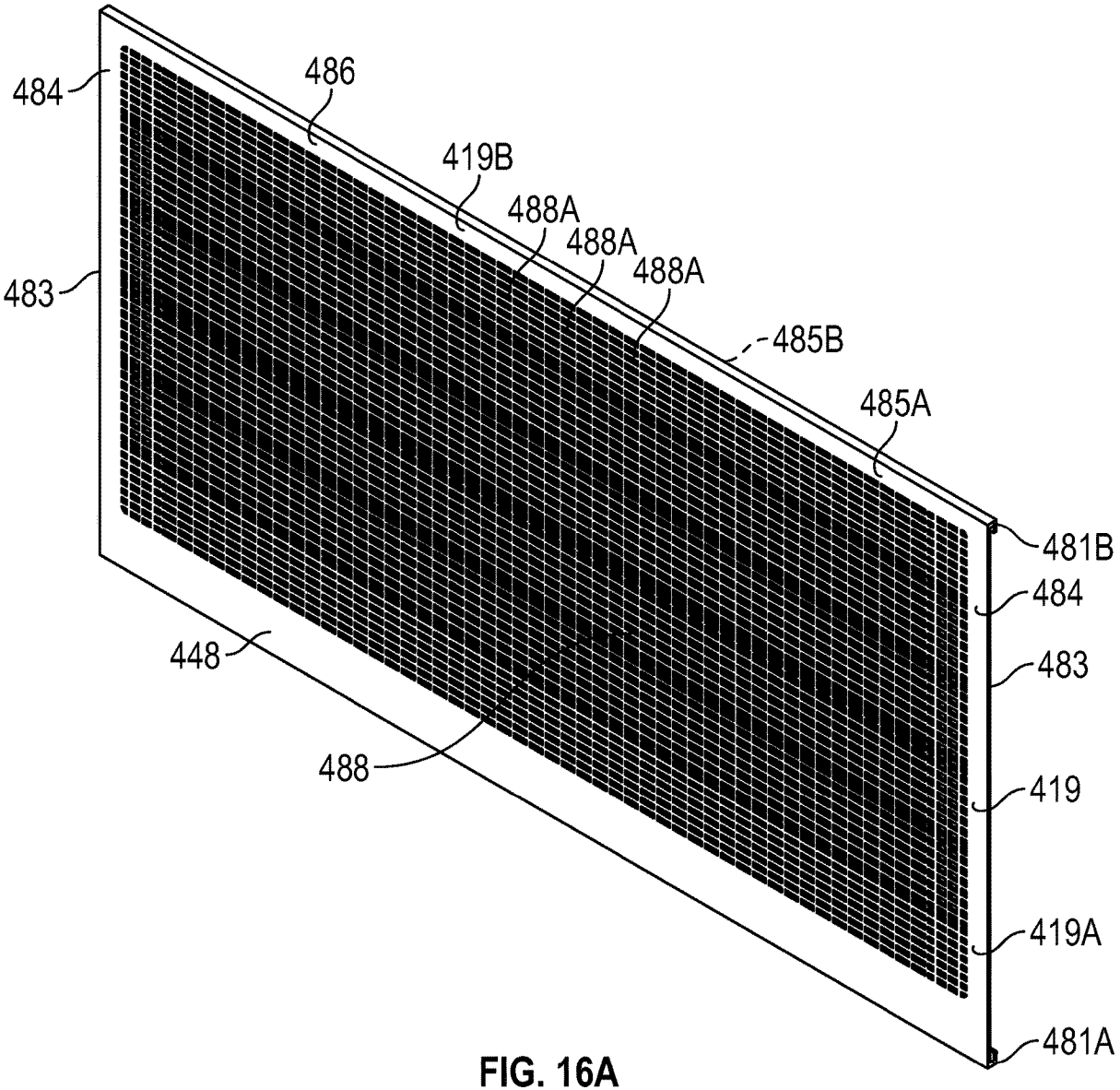
FIG. 16A is a front-side perspective view of a screen assembly, according to one or more embodiments of the present disclosure.

FIGS. 16A and 16B show views of a screen assembly 419 for use with the vibratory screening machine 100 and screening deck assembly 400 described above. While the following description of embodiments depicted in FIGS. 16A and 16B is made with reference to second screen assembly 419, it is noted that this discussion applies equally to first screen assembly 409; first screen assembly 409 can typically be identical to screen assembly 419, but optionally may have different sizes and configurations, e.g., different sized impact area 448 (smaller or larger), different size opening configurations, a combination thereof, or the like.

FIG. 16A is a front-side perspective view of screen 419 in accordance with one or more embodiments of the disclosure. Screen 419 is configured for removably securing to deck 420 under tension in the manner described herein. Screen 419 includes feed end 419A and opposing discharge end 419B. Screen 419 has a widthwise dimension between ends 419A and 419B, and a lengthwise dimension between opposing side edges 483. A filter area 488 is defined by a plurality of individual openings or pores 488A extending substantially across the surface of the screen 419. The openings 488A are of a selected size, such as a size determined by side lengths having respective magnitudes in a range from about 20 microns and about 100 microns. In some embodiments, the openings 488A can be rectangular shaped and can have a substantially uniform width or substantially uniform thickness in a range between about 43 microns to about 100 microns, and a substantially uniform length in a range between about 43 microns to about 2000 microns.

In the embodiment of FIG. 16A, the filter area 488 is framed by an impact zone 448 formed along feed end 419A, a strip 486 along discharge end 419B, and opposing side strips 484 along respective side edges 483. Ends of the impact zone 448, strip 486, and side strips 484 integrally join together at abutment points, and together provide structural support to the filter area 488, preventing tearing and the like during placement and use on the machine 100. With reference to FIG. 14, as material 500 flows over the curved member 446 of the wash tray 440, the material 500 lands on impact zone 448. Impact zone 448 protects the integrity of the individual openings 488A and prevents or decreases the likelihood of large particles becoming lodged in the openings 488A. As indicated in FIG. 14, as material 500 flows from feed end 419A to discharge end 419B, appropriately sized particles of material 500 pass through openings 488A. Impact zone 448 may have different sizes and configurations depending on the screening application and desired flow characteristics.

As is shown in FIGS. 16A and 16B, a first binder strip 481A is provided along feed end 419A, while a second binder strip 481B is provided along discharge end 419B. Each binder strip 481A, 481B may be a generally U-shaped strip of metal that is integrated into feed ends 419A, 419B, substantially along the length of each respective end 419A, 419B. While alternative means may be used to attach binder strips 481A, 481B to screen 419, the binder strips 481A, 481B are configured to withstand substantial forces during operation of the vibratory screening machine 100 without separating from screen 419 or otherwise allowing screen 419 to come loose from deck 420.

FIG. 16B is a side view of a screen filter 419 for use in an exemplary embodiment of the present disclosure. When viewed from the side as in FIG. 16B, screen 419 presents a thin profile. As seen in FIG. 16B, the screen filter 419 includes a material input surface 485A on an upper side, and a material output surface 485B on an opposing lower side thereof. Individual screen openings 488A extend from input side 485A to output side 485B, such that during vibratory screening, individual particles pass through the screen area 488. In the embodiment depicted in FIG. 16B, first and second binder strips 481A, 481B extend downwardly from the lower side of screen 419. Each binder strip 481A, 481B curves back toward a center of screen 419, such as in an L-shape or C-shape.

The screen assembly 409, 419 is dimensioned to match the size of deck 410, 420. In some embodiments, screen assembly 409, 419 may have a length of about 56 cm, a width of about 30 cm, and a thickness of about 0.25 cm. Impact area 448 is about 3 cm wide; narrower or wider impact areas 448 can be used, with the former decreasing protection and the latter decreasing the number of openings 488A. Strip 486 and side strips 484 are about 1 cm wide. The screens 409, 419 may be made of polyurethane or thermoplastic polyurethane (TPU). While exemplary embodiments of screens 419 are depicted in FIG. 16A and FIG. 16B for use with the vibratory screening machine 100 described herein, it will be appreciated that the machine 100 can be configured for use with alternative configuration of screens, screen materials, and screen characteristics (opening/pore size, connection mechanisms, and the like). Examples of screens, screen materials and screen characteristics that can be incorporated into screens 409, 419 for use with machine 100 are found in applicant's U.S. Pat. Nos. 10,046,363; 9,409,209; and 9,884,344; the disclosures of each of which are incorporated herein by reference in their entirety.

A method of attaching a screen assembly 409, 419 to a deck 410 420 is described as follows. As is seen in FIG. 14, deck clips 455B are fixed adjacent to respective output ends 410B, 420B of decks 410, 420. Deck clips 455B are sized and configured for attaching output ends 409B, 419B of screens 409, 419 to screening decks 410, 420. In an embodiment, deck clips 455B extend substantially along a length of discharge end 410B, 420B, in a manner analogous to binder strips 481A, 481B extending along lengths of screen assembly 409, 419. In FIG. 14, deck clip has an L-shaped aspect when viewed in side profile, although other engagement configurations, such as curved C-shaped aspects, can be used. As can be understood from FIG. 14, second binder strip 481B along discharge end 409B, 419B of a screen assembly 409, 419 is engaged to deck clip 455B, such that the L- or C-shaped aspect of binder strip 481B interdigitates with L- or C-shaped aspect of deck clip 455B. Tension is applied to spread screen assembly 409, 419 across the deck 410, 420 toward input end 410A, 420A, such that binder clip 481B remains interconnected with deck clip 455B. With screen assembly 409, 419 spread across deck 410, 420, first binder strip 481A of screen assembly 409, 419 is then engaged to tensioning strip 455 of tensioning device 450, such that an L- or C-shaped aspect of tensioning strip 455 interconnects with first binder strip 481A. Tension is then applied to screen assembly 409, 419 via tensioning device 450 to thereby selectively lock first binder strip 481A to tensioning strip 455, whereby filter 409, 419 is tensioned tightly along deck 410, 420 for use in screening particles of material 500 during operation of the machine 100.

After a period of use, screens 409, 419 can be selectively removed from deck 410, 420 for replacement with new screens 409, 419. In a method of screen removal, tensioning device 450 is used to release tension strip 455 from first strip 481A. Screen assembly 409, 419 is then pulled or slid toward discharge end 410A, 420A of deck 410, 420 to release second binder strip 481B from deck clip 455B.

Figure 17:
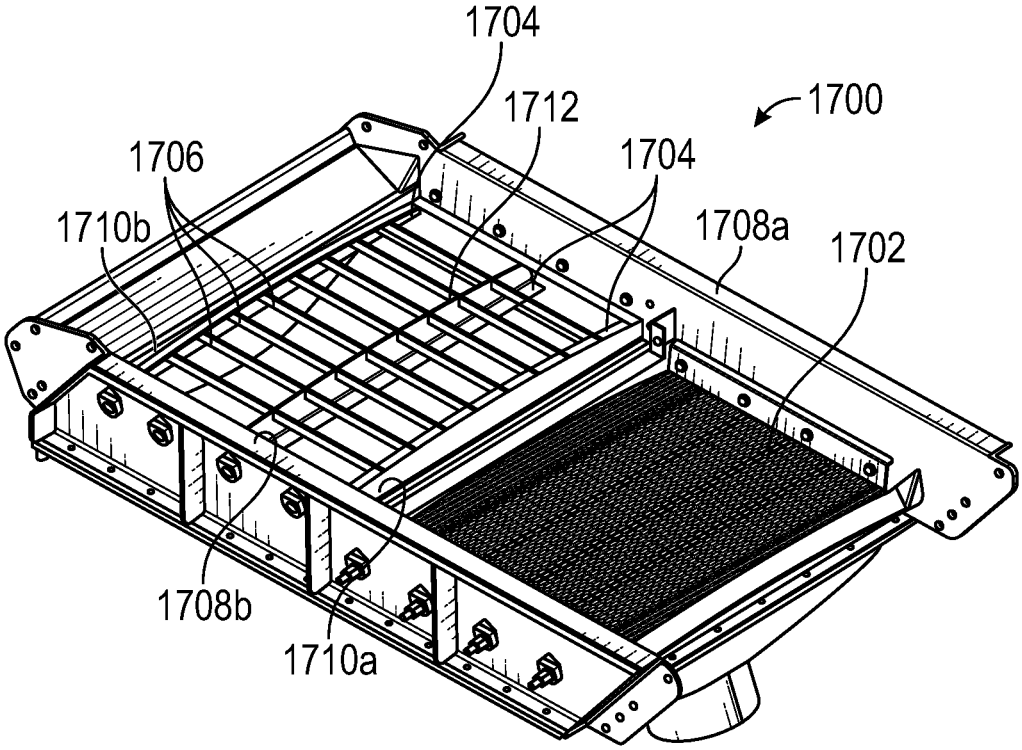
FIG. 17 is an isometric view of a screening deck having a screen assembly mounted thereon, according to one or more embodiments of the present disclosure.

FIG. 17 is an isometric view of a screening deck 1700 having a screen assembly 1702 mounted thereon, according to one or more embodiments of the present disclosure. In this embodiment, screening deck 1700 may employ a tensioning mechanism that holds screen assembly 1702 by providing side-to-side tension, in contrast to the above-described embodiments shown, for example, in FIGS. 5 and 15 that provide front-to-back tensioning. In this example, a tensioning mechanism provides tension to screen assembly 1702 from above, as described in greater detail in U.S. Pat. No. 9,010,539, the disclosure of which is incorporated by reference herein in its entirety. The tensioning mechanism in screening deck 1700, in which tension is applied from above, is also in contrast to the embodiments of FIGS. 5 and 15 in which tension is applied from below.

Screening deck 1700 includes screen assembly 1702 in a first screening portion of screening deck 1700. A second screening portion of screening deck 1700 is shown without a screen assembly to reveal a plurality of ribs 1704 that provide structural support for a plurality of stringers 1706. As described above with reference to FIG. 6, stringers 1706 provide structural support of a screening assembly such as screening assembly 1702. In this example, ribs 1704 extend between side channels 1708*a* and 1708*b*. Stringers 1706 extend from end plate 1710*a* to 1710*b*. A midpoint 1712 of each stringer 1706 traverses a top surface of a central rib of ribs 1704. In this example, midpoints 1712 are elevated with respect to opposite ends of stringers 1706 such that stringers 1706 create a "crown" or convex curvature across screening portions of screening deck 1700.

As with the example of FIG. 6, described above, stringers 1706 may be replaceable units, and may be fastened to ribs 1704 rather than welded to ribs 1704. Stringers 1706 may be fastened to ribs 1704 using various fasteners such as bolts. This configuration eliminates closely spaced weld joints between ribs 1704 and stringers 1706 that are commonly found in welded screening decks. This arrangement eliminates the shrink, heat distortion, and drop associated with closely spaced weld joints, and enables rapid replacement of worn or damaged stringers 1706 in the field. Replaceable stringers 1706 may include plastic, metal, and/or composite materials and may be constructed by casting and/or injection molding. Other embodiment screening systems may include removable and replaceable stringers, as described in the following examples.

Figure 18:
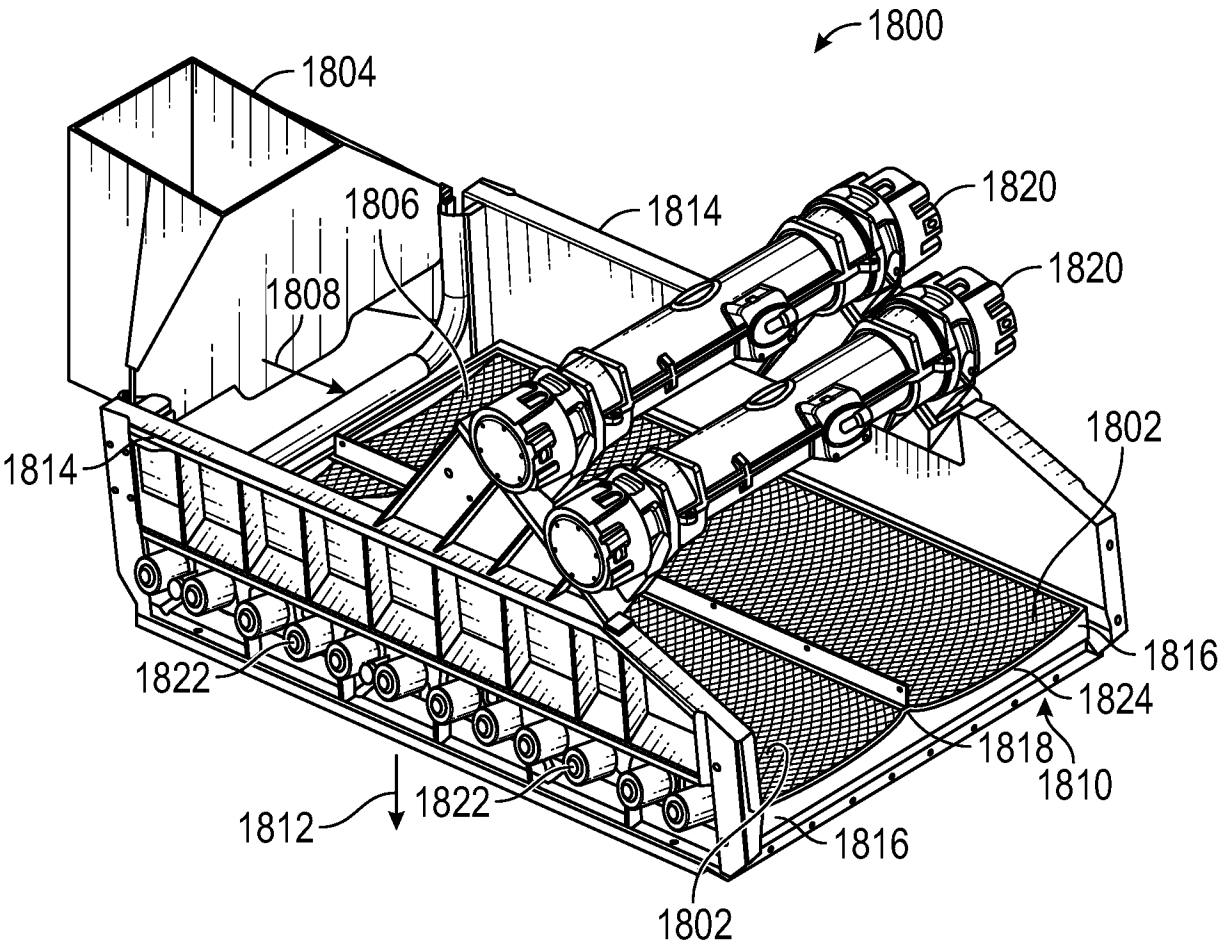
FIG. 18 illustrates a perspective view of a vibratory screening machine with installed replaceable screen assemblies having dual concave screening areas, according to an example embodiment of the present disclosure.

FIG. 18 illustrates a perspective view of a vibratory screening machine 1800 with installed replaceable screen assemblies 1802, according to an example embodiment of the present disclosure. Vibratory screening machine 1800 is described in greater detail, for example, in U.S. Pat. No. 7,578,394, the disclosure of which is incorporated by reference herein in its entirety. In this example, material is fed into a feeder 1804 and is thereby directed onto a top surface 1806 of screen assemblies 1802. The material travels in a flow direction 1808 toward an end 1810 of vibratory screening machine 1800. Material flowing in direction 1808 is contained within a concave configuration provided by the screen assemblies 1802 and is prevented from exiting the sides of screen assemblies 1802.

Material that is undersized and/or fluid passes through screen assemblies 1802 onto a separate discharge material flow path 1812 for further processing by another vibratory screening machine, by a centrifuge, etc. Materials that are oversized exit end 1810. The material to be screened may be dry, a slurry, etc., and screen assemblies 1802 may be pitched downwardly from the feeder 1804 toward opposite end 1810 in direction 1808 to assist with the feeding of the material. In further embodiments, screen assemblies 1802 may be pitched upwardly from feeder 1804 and/or feeder 1804 may provide material at a different location along screen assemblies 1802. For example, feeder 1804 may be positioned to deposit material in a middle portion of screen assemblies 1802 or to deposit material in another location on screen assemblies 1802 in other embodiments.

In this example, vibratory screening machine 1800 includes wall members 1814, concave support surfaces 1816, a central member 1818, a vibrational motor 1820, and compression assemblies 1822. Support surfaces 1816 may have a concave shape and may include similarly shaped mating surfaces 1824. Compression assemblies 1822, which in this example are attached to an exterior surface of wall members 1814, may impart a compressive force to screen assemblies 1802, to thereby hold screen assemblies 1802 in place, in contact with support surfaces 1816. Vibrational motor 1820 may impart a vibrational motion to screen assemblies 1802 that acts to enhance the screening process. Central member 1818 divides vibratory screening machine 1800 into two concave screening areas. In other embodiments, vibratory screening machines 1800 may have one concave screening area with compression assemblies 1822 arranged on one wall member as shown, for example, in FIG. 20 and described in greater detail below.

Figure 19:
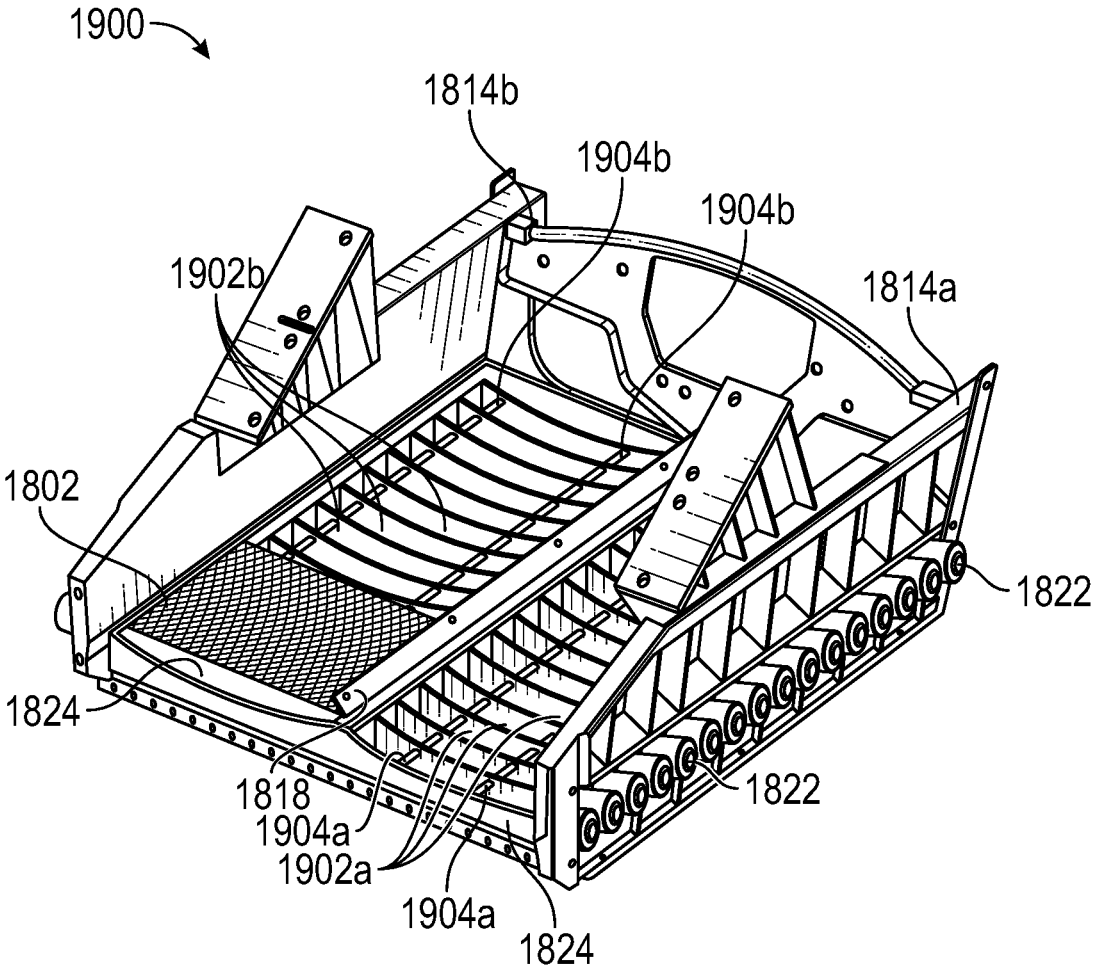
FIG. 19 illustrates a perspective view of a partially assembled vibratory screening machine, according to an example embodiment of the present disclosure.

FIG. 19 illustrates a perspective view of a partially assembled vibratory screening machine 1900, according to an example embodiment of the present disclosure. In this example, vibrational motor 1820, feeder 1804, and most of screen assemblies 1802, have been removed from vibratory screening machine 1800 to generate the view of partially assembled vibratory screening machine 1900 shown in FIG. 19. This view illustrates details of mating surfaces 1824 mentioned above with reference to FIG. 18. As shown, mating surfaces 1824 include a plurality of stringers 1902*a* and 1902*b*. In this way, stringers 1902*a* and 1902*b* provide the plurality of mating surfaces 1824 that form the concave support surfaces 1816 mentioned above with reference to FIG. 18.

In this example, stringers 1902*a* are supported by a plurality of ribs 1904*a*, while stringers 1902*b* are supported by a similar plurality of ribs 1904*b*. Stringers 1902*a* extend between wall member 1814*a* and central member 1818, and stringers 1902*b* extend between wall member 1814*b* and central member 1818. As shown in FIG. 19, ribs are positioned to be parallel with wall members 1814*a* and 1814*b*. In this example, stringers 1902*a* and 1902*b* have a concave shape to provide the concave support surfaces 1816 that support screen assemblies 1802 under compressive forces provided by compressive assemblies 1822, described above with reference to FIG. 18.

As with the examples of FIGS. 6 and 17, described above, stringers 1902*a* and 1902*b* may be replaceable units, and may be fastened to ribs 1904*a* and 1904*b*, respectively, rather than welded to ribs 1904*a* and 1904*b*. Various fasteners, such as bolts, may be used. This configuration eliminates closely spaced weld joints between ribs 1904*a*, 1904*b* and stringers 1902*a*, 1902*b*, respectively, eliminating shrink, heat distortion, and drop associated with closely spaced weld joints. Replaceable stringers 1902*a* and 1902*b* may include plastic, metal, and/or composite materials and may be constructed by casting and/or injection molding.

Figure 20:
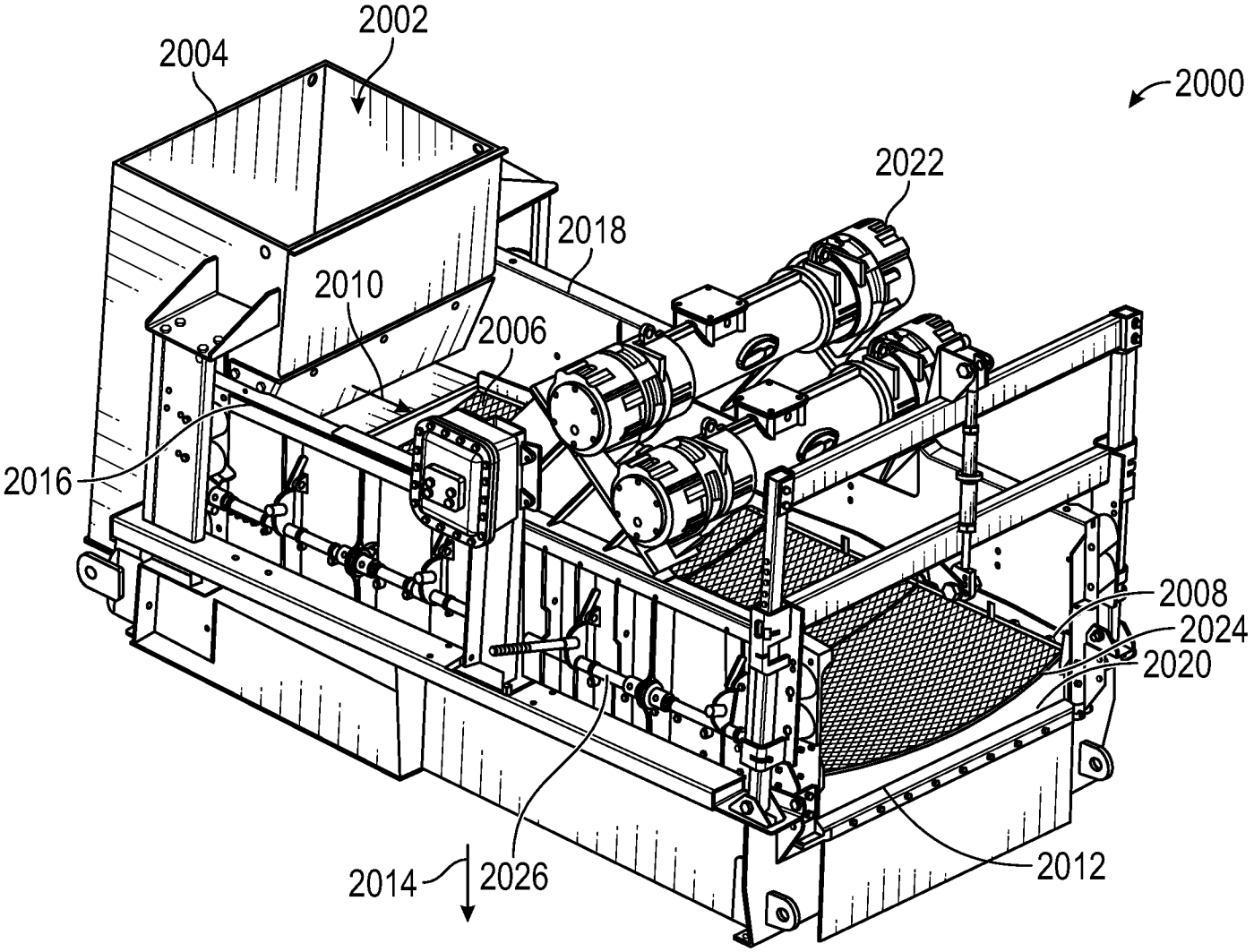
FIG. 20 shows a perspective view of a vibratory screening machine with installed replaceable screens assemblies having a single concave screening area, according to an example embodiment of the present disclosure.

FIG. 20 shows a perspective view of a vibratory screening machine 2000 with installed replaceable screening assemblies having a single concave screening area, according to an example embodiment of the present disclosure. Vibratory screening machine 2000 is described in greater detail, for example, in U.S. Pat. No. 9,027,760, the disclosure of which is incorporated by reference herein in its entirety. Material 2002 to be screened may be fed into a feeder 2004 which directs the material onto a top surface 2006 of screen assemblies 2008. Material deposited by feeder 2004 travels in flow direction 2010 toward an end 2012 of vibratory screening machine 2000. Material is prevented from exiting the sides of screen assemblies 2008 by the concave shape of screen assemblies 2008 and by wall members 2016, as described in greater detail below.

Material that is undersized and/or fluid passes through the screen assemblies 2008 onto a separate discharge material flow path 2014 for further processing. Materials that are oversized may exit end 2012. Material to be screened may be dry, a slurry, etc., and screen assemblies 2008 may be pitched downwardly from the feeder 2004 toward opposite end 2012 in the direction 2010 to assist with feeding of the material. In further embodiments, screen assemblies 2008 may be pitched upwardly from feeder 2004 and/or feeder 2004 may provide material at a different location along screen assemblies 2008. For example, feeder 2004 may be positioned to deposit material in a middle portion of screen assemblies 2008 or to deposit material in another location on screen assemblies 2008 in other embodiments.

Vibratory screening machine 2000 includes a first wall member 2016, a second wall member 2018, concave support surfaces 2020, a vibratory motor 2022, screen assemblies 2008, and a compression assembly 2026. Support surfaces 2020 have a concave shape and include mating surfaces 2024. Compression assemblies 2026, which in this example are attached to an exterior surface of wall member 2016, may impart a compressive force to screen assemblies 2008 to thereby hold screen assemblies 2008 in place in contact with mating surface 2024 of support surfaces 2020.

Vibratory motor 2022 may be configured to cause screen assemblies 2008 to vibrate to enhance screening. Compression assembly 2026 may be attached to an exterior surface of the first wall member 2016 or to second wall member 2018. Vibratory screening machine 2000, shown in FIG. 20, has a single concave screening area. In further embodiments, vibratory screening machines may have multiple concave screening areas. While vibratory screening machine 2000 is shown with multiple longitudinally oriented screen assemblies 2008 creating a concave material pathway, screen assemblies 2008 are not limited to such a configuration and may be otherwise oriented. Additionally, multiple screening assemblies 2008 may be provided to form a concave screening surface, as shown in FIG. 18 and described above.

Figures 21A, 21B:
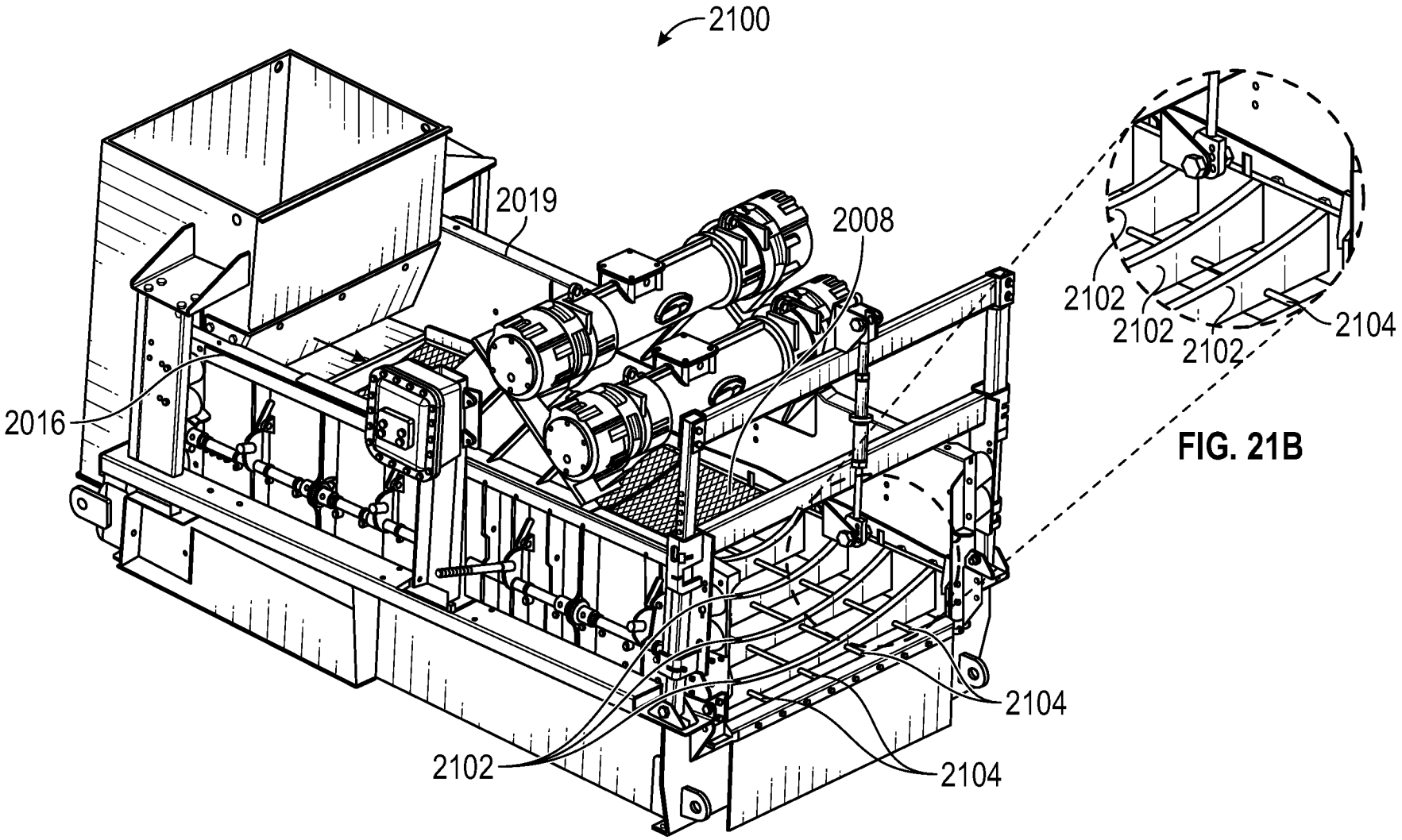
FIG. 21A illustrates a perspective view of a partially assembled vibratory screening machine, according to an example embodiment of the present disclosure.
FIG. 21B shows an enlarged view of stringers and one of a plurality of ribs shown in FIG. 21A, according to an example embodiment of the present disclosure.

FIG. 21A illustrates a perspective view of a partially assembled vibratory screening machine 2100, according to an example embodiment of the present disclosure. In this example, part of screening assemblies 2008 has been removed from vibratory screening machine 2000 to generate the view of partially assembled vibratory screening machine 2100 shown in FIG. 21A. In this view, concave-shaped support surfaces 2020 having mating surfaces 2024, mentioned above with reference to FIG. 20, are provided by a plurality of stringers 2102. As in previous examples, stringers 2102 are supported by a plurality of ribs 2104.

FIG. 21B shows an enlarged view of stringers 2102 and one of the plurality of ribs 2104. Stringers 2102 extend between first wall member 2016 and second wall member 2019, and ribs 2104 are configured to be positioned parallel to first wall member 2016 and second wall member 2019.

In this example, stringers 2102 have a concave shape to provide the concave support surfaces 2020 that support screen assemblies 2008 under compressive forces provided by compressive assemblies 2026, as described above with reference to FIG. 20. As with the examples of FIGS. 6 and 19, described above, stringers 2102 may be replaceable units, and may be fastened (e.g., bolted) to ribs 2104, respectively, rather than welded to ribs 2104. This configuration eliminates closely spaced weld joints between ribs 2104 and stringers 2102, eliminating shrink, heat distortion, and drop associated with closely spaced weld joints. Replaceable stringers 2102 may include plastic, metal, and/or composite materials and may be constructed by casting and/or injection molding.

Further embodiments may be configured for use with various vibratory screening machines and parts thereof, including machines designed for wet and dry applications, machines having multi-tiered decks and/or multiple screening baskets, and machines having various screen attachment arrangements such as tensioning mechanisms (e.g., under-mount and over-mount tensioning mechanisms), compression mechanisms, clamping mechanisms, magnetic mechanisms, etc. For example, embodiments may include vibratory screening machines as described in U.S. Pat. Nos. 7,578,394; 6,820,748; 6,669,027; 6,431,366; and 5,332,101.

Screen assemblies may include: side portions or binder bars including U-shaped members configured to receive over-mount type tensioning members, for example, as described in U.S. Pat. No. 5,332,101; side portions or binder bars including finger receiving apertures configured to receive under-mount type tensioning, for example, as described in U.S. Pat. No. 6,669,027; side members or binder bars for compression loading, for example, as described in U.S. Pat. No. 7,578,394; or may be configured for attachment and loading on multi-tiered machines, for example, such as the machines described in U.S. Pat. No. 6,431,366. Screen assemblies and/or screening elements may also be configured to include features described in U.S. Pat. No. 8,443,984, including guide assembly technologies described therein and pre-formed panel technologies described therein. Screen assemblies and screening elements may further be configured to be incorporated into embodiments including pre-screening technologies that are compatible with the mounting structures and screen configurations described in U.S. Pat. No. 8,439,203.

The disclosure of each of U.S. Pat. Nos. 8,439,984; 8,439,203; 7,578,394; 7,228,971; 6,820,748; 6,669,027; 6,431,366; 5,332,101; 4,882,054; and 4,857,176, and the patents and patent applications referenced in these documents, is hereby incorporated by reference in its entirety. Various other screening machines may be included in other embodiments as needed for specific applications.

Figure 22:
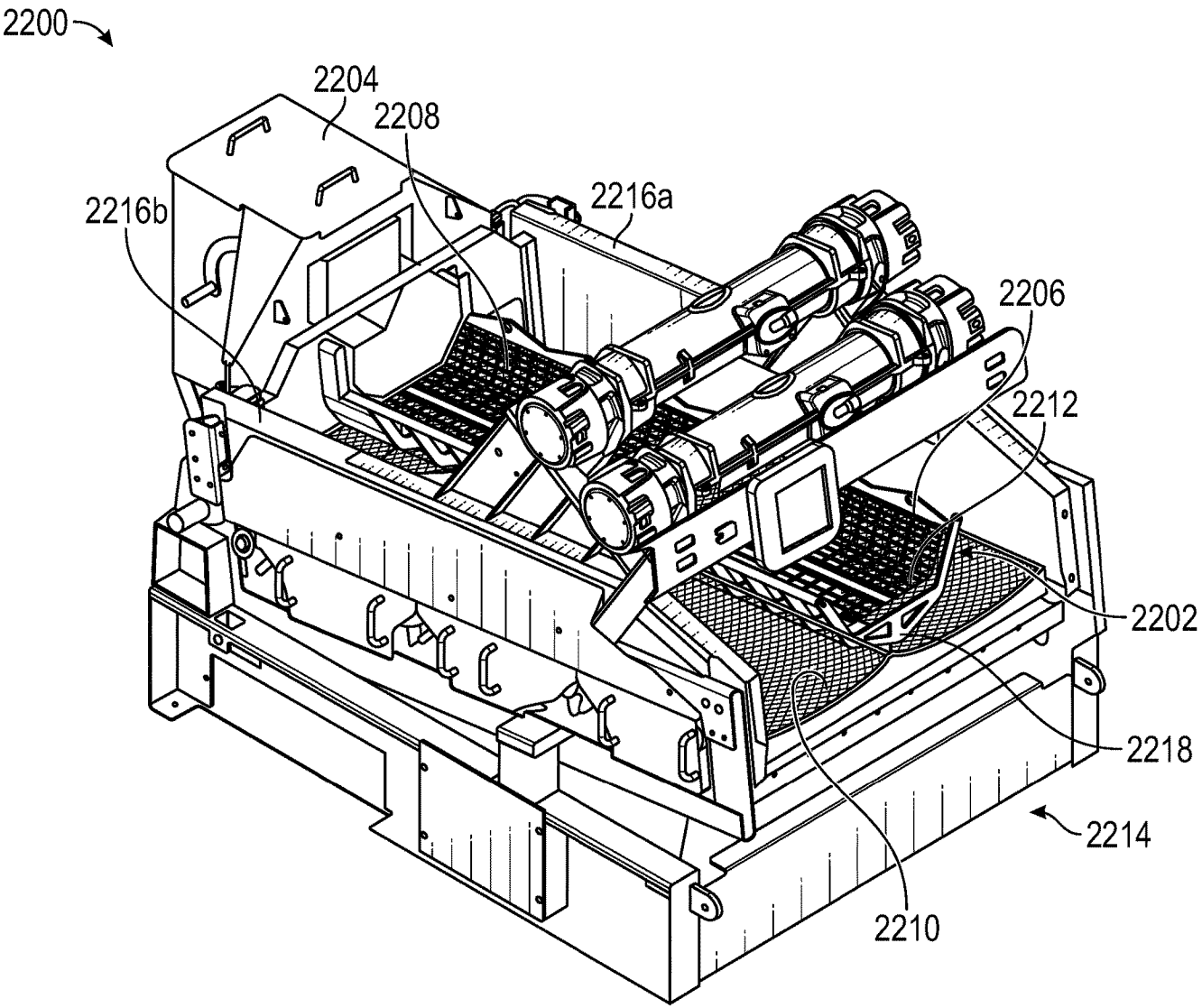
FIG. 22 illustrates a perspective view of a vibratory screening machine with installed replaceable screen assemblies and a pre-screening assembly, according to an example embodiment of the present disclosure.

FIG. 22 illustrates a perspective view of a vibratory screening machine 2200 with installed replaceable screen assemblies and a pre-screening assembly 2202, according to an example embodiment of the present disclosure. Vibratory screening machine 2200 is described in greater detail, for example, in U.S. Pat. No. 8,439,203, the disclosure of which is incorporated by reference herein in its entirety.

In this example, material is fed into a feeder 2204 and then directed onto a concave screening surface 2208 of pre-screening assembly 2202. Screen assemblies 2206 form concave screening surface 2208. Undersized material passes through screening surface 2208 and onto a primary screening surface 2210. Oversized materials are discharge from end 2212 of pre-screening assembly 2202. Material travels toward end 2214 of vibratory screening machine 2200. The material flowing inside pre-screening assembly 2202 is contained within concave screening surface 2208. The material may be dry, a slurry, etc.

Vibratory screening machine 2200 includes wall members 2216*a* and 2216*b*, a central member 2218 and an acceleration arrangement 2220. Central member 2218 divides vibratory screening machine 2200 into two screening areas. Vibratory screening machine 2200 may, however, have one or more concave screening areas.

Figure 23:
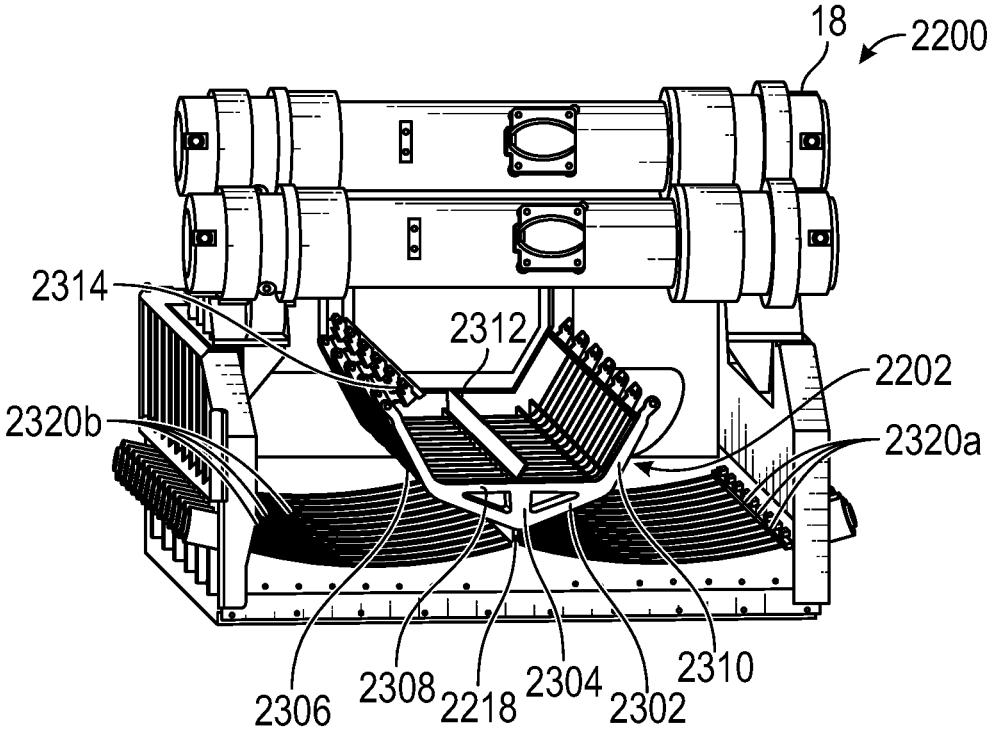
FIG. 23 shows the vibratory screening machine shown in FIG. 22 without feeder and without installed screen assemblies, according to an example embodiment of the present disclosure.

FIG. 23 shows vibratory screening machine 2200 shown in FIG. 22 without feeder 2204 and without installed screen assemblies 2206 and 2210. Pre-screen assembly 2202 includes a frame 2302 that includes a central spine 2304, ribs 2306, horizontal portions 2308, vertical portions 2310 and a bar 2312. Frame 2302 has a general hull type shape but may be configured in other arrangements suitable for pre-screening materials. Frame 2302 is configured to provide a generally concave surface to support screen assemblies 2206. Pre-screen assembly 2202 also includes screen assembly attachment arrangements 2314 configured to secure screen assemblies 2206 to frame 2302. Screen assembly attachment arrangements 2314 may include pre-tensioned spring clamps but may also include other screen securing mechanisms such as mechanical, electromechanical, pneumatic or hydraulic systems.

Vibratory screening machine 2200 may further include a first plurality of stringers 2320*a* and a second plurality of stringers 2320*b*. Stringers 2320*a* and 2320*b* may serve a similar purpose as stringers 1902*a* and 1902*b* described above with reference to FIG. 19. In this regard, stringers 2320*a* and 2320*b* may provide mechanical support for screening assemblies 2210 that may be held in position under compression.

In this example, stringers 2320*a* and 2320*b* have a concave shape to provide the concave support surfaces for screen assemblies 2210 under compressive forces, as described above with reference to FIG. 18. As with the examples of FIGS. 6, 19, and 21, described above, stringers 2320*a* and 2320*b* may be replaceable units, and may be fastened (e.g., bolted) to support ribs (not shown in this example). As described above, using such replaceable stringers 2320*a* and 2320*b* eliminates the need for welding stringers to ribs. As such, closely spaced weld joints between ribs and stringers are eliminated. Replaceable stringers 2320*a* and 2320*b* may include plastic, metal, and/or composite materials and may be constructed by casting and/or injection molding. In further embodiments, other structures such as pre-screen assembly 2202 may include replaceable elements such as frame 2302, central spine 2304, ribs 2306, horizontal portions 2308, vertical portions 2310, and bar 2312. Such elements may include plastic, metal, and/or composite materials and may be constructed by casting and/or injection molding.

Figure 24:
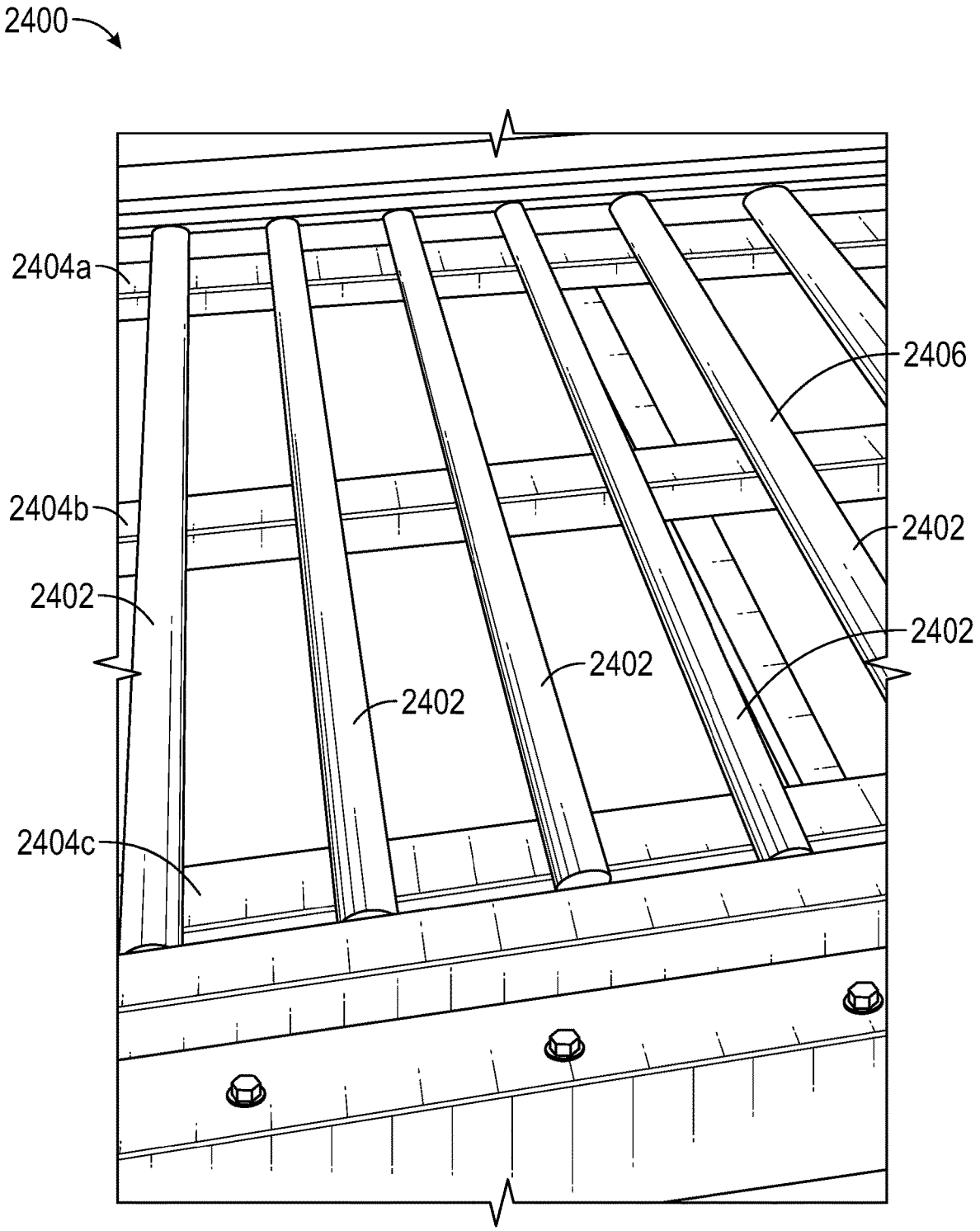
FIG. 24 shows a portion of a vibratory screening machine with replaceable support structures with wear protective coverings, according to an example embodiment of the present disclosure.

FIG. 24 shows a portion 2400 of a vibratory screening machine with replaceable stringers 2402, according to an example embodiment of the present disclosure. In this example, stringers 2402 are shown with a flexible wear protective cover that is described in further detail below. Stringers 2402 are fastened to support structures 2404*a*, 2404*b*, and 2404*c*. In this example, each of stringers 2402 may be fastened (e.g., bolted) to support structures 2404*a*, 2404*b*, and 2404*c*. Stringers 2402 may have a shape that is appropriate for a given application. For example, as described above, stringers 2402 may have a convex shape for supporting screening assemblies (not shown) that are held under tension. In other embodiments, stringers 2402 may have a concave shape when screening assemblies are held under compression. In other embodiments, stringers 2402 may have a substantially straight shape. Stringers 2402 may be configured to have a tapered or pyramidal cross-sectional shape providing a mating surface 2406 that has a smaller area than a base area of stringers 2402, as described in greater detail below with reference to FIG. 26. Other embodiments may include stringers 2402 having other shapes including ones with circular cross section, triangular cross section, rectangular cross section, square cross section, hexagonal cross section, etc., as needed for a given application.

Figure 25:
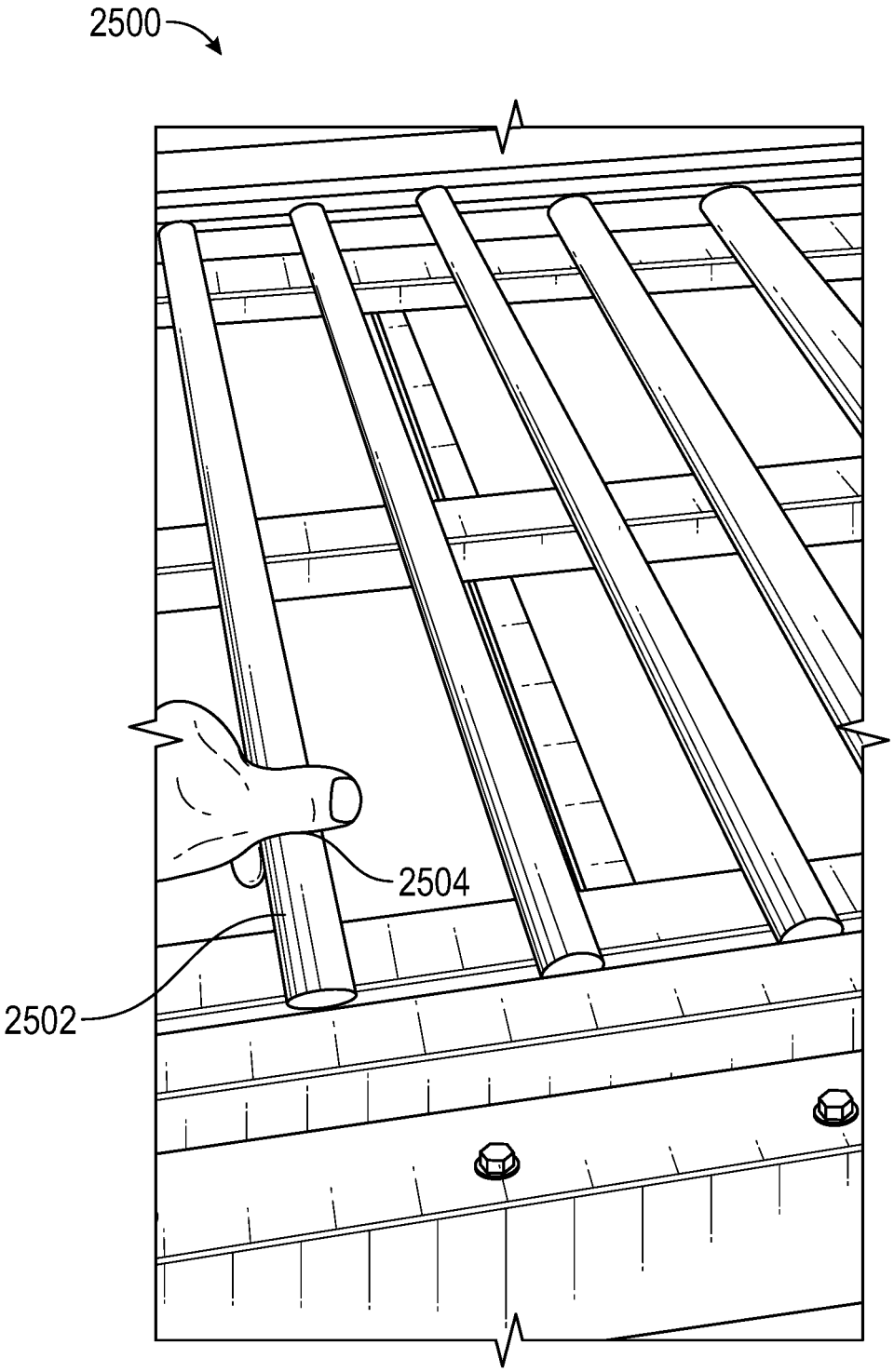
FIG. 25 shows a portion of a vibratory screening machine having replaceable support structures with wear protective coverings in which one wear protective covering is being removed, according to an example embodiment of the present disclosure.
Figure 26:
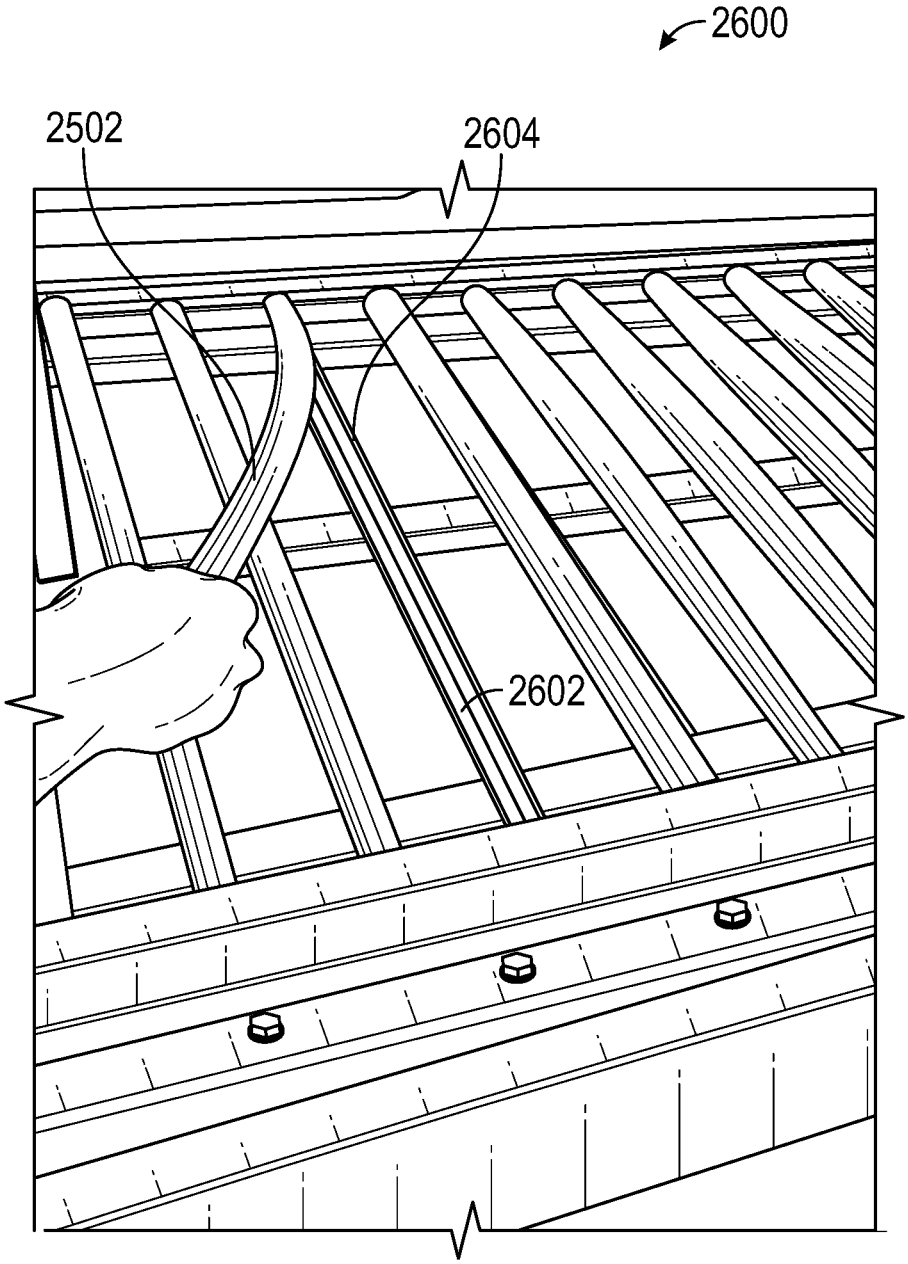
FIG. 26 shows a portion of a vibratory screening machine having replaceable support structures with wear protective coverings in which one wear protective covering has been removed revealing an uncovered support structure, according to an example embodiment of the present disclosure.

FIG. 25 shows a portion 2500 of a vibratory screening machine having replaceable stringers with wear protective coverings 2502, according to an example embodiment of the present disclosure. Wear protective covering 2502 may be made of a flexible plastic or rubber material that may be configured to provide wear protection for removable and replaceable stringers (e.g., as shown in FIG. 26). In this example, wear protective covering 2502 may be easily removed by grasping wear protective covering 2502, at a point 2504 along a length of wear protective covering 2502, and applying a force to wear protective covering 2502 to remove wear protective covering 2502. A wear protective covering 2502 that has been removed in this way is shown, for example, in FIG. 26.

FIG. 26 shows a portion 2600 of a vibratory screening machine having replaceable stringers 2602 with wear protective coverings 2502 in which one wear protective covering 2502 has been removed, according to an example embodiment of the present disclosure. In this example, wear protective covering 2502 is made of a flexible material that may easily be removed by grasping and pulling wear protective covering 2502, as described above with reference to FIG. 25. Wear protective covering 2502 may be made of a material that provides wear resistance to stringers, such as stringer 2602. As such, wear protective covering 2502 may be made of a material having a pre-determined scratch resistance, tear resistance, puncture resistance, etc. As mentioned above, wear protective covering 2502 may be configured to have a shape that conforms to a shape of a corresponding stringer 2602. In this example, stringer 2602 may have a tapered or pyramidal cross-sectional shape providing a mating surface 2604 that has a smaller area than a base area of stringers 2602. Other embodiments may include stringers 2602 having other shapes including ones with circular cross section, triangular cross section, rectangular cross section, square cross section, hexagonal cross section, etc., as needed for a given application.

Figure 27:
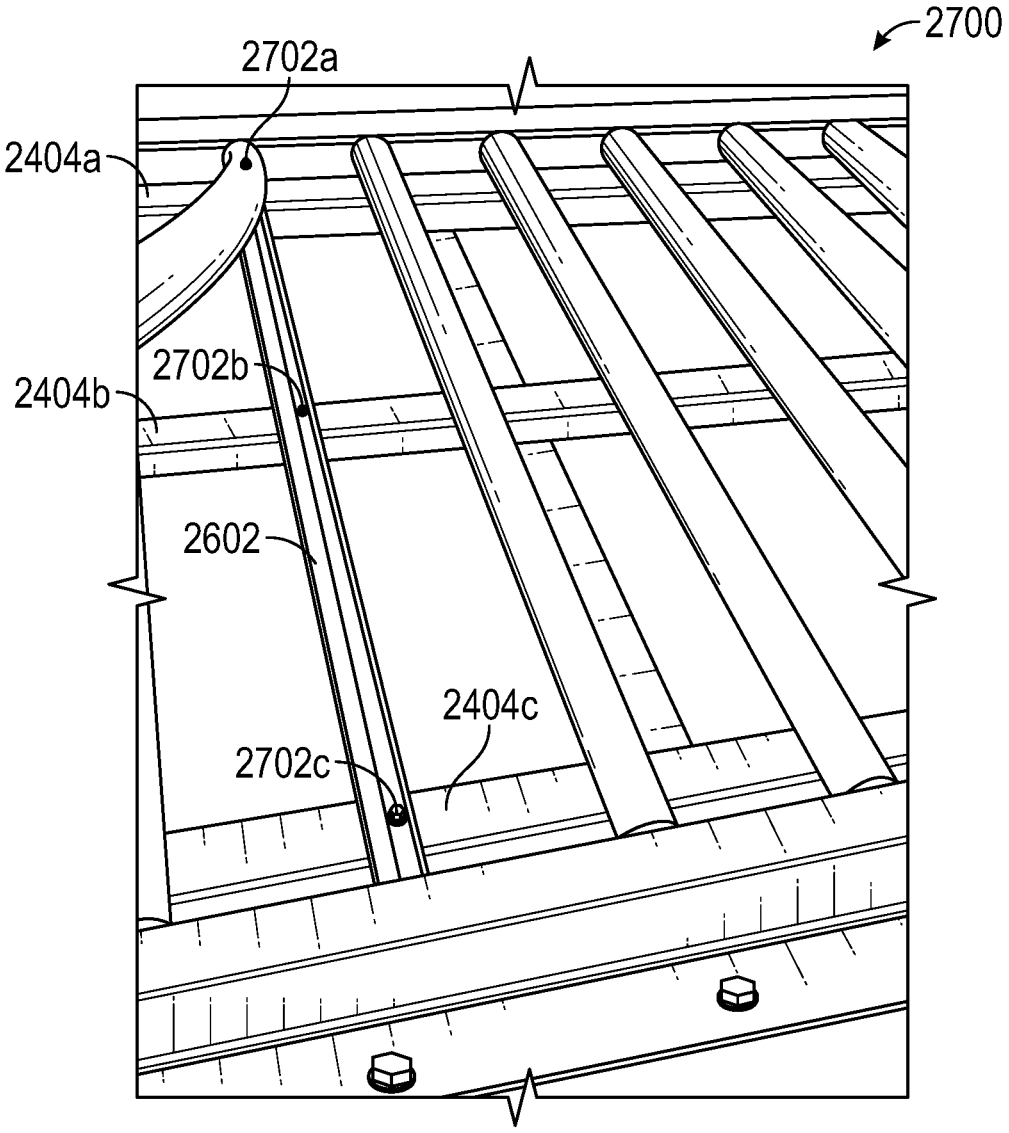
FIG. 27 shows an enlarged view of the uncovered support structure shown in FIG. 26, according to an example embodiment of the present disclosure.

FIG. 27 shows an enlarged view 2700 of the uncovered stringer 2602 shown in FIG. 26, according to an example embodiment of the present disclosure. As described above, stringer 2602 may be fastened (e.g., bolted) to support structures 2404*a*, 2404*b*, and 2404*c* at respective points 2702*a*, 2702*b*, and 2702*c* along a length of stringer 2602. Stringer 2602 may made of plastic, metal, and/or composite materials and may be constructed by casting and/or injection molding. For example, stringer 2602 may be a single injection molded piece made from nylon or reinforced nylon. For example, stringer 2602 may include a fiberglass reinforced material such as nylon or other material having similar properties.

As described above, using such replaceable stringers 2602 eliminates the need for welding stringers to ribs. As such, closely spaced weld joints between ribs and stringers are eliminated. Avoiding welding eliminates mechanical problems associated with welding. For example, conventional stringers that are welded to ribs (e.g., support structures 2404*a*, 2404*b*, and 2404*c* shown in FIG. 27) exhibit mechanical distortions induced by the welding process. Such distortions give rise to alignment errors that reduce the quality of the seal formed between the stringers and screens that are mounted to the stringers. The use of injection molded stringers 2602 and wear resistant covers 2502 (e.g., see FIG. 25) provides a more accurate shape of mating surfaces on which screens may be mounted. In this way, a tighter, more accurate seal may be formed between screens and mating surfaces. The use of injection molding allows nearly ideal shapes of stringers 2602 and wear resistant covers 2502 to be manufactured. Various concave, convex, and straight shapes may be generated as needed for various embodiments.

In addition to thermoplastic injection molded materials (e.g., nylon and reinforced nylon) used to manufacture stringers 2602 (e.g., see FIG. 27), other thermoplastic materials such as thermoplastic polyurethane (TPU) may have advantageous properties for wear resistant covers 2502 (e.g., see FIG. 25). TPU materials may be polyester based or poly-ether based. As opposed to thermoset type polymers, which frequently include liquid materials that chemically react and cure under temperature, use of thermoplastics is often simpler and may be provided, for example, by melting a homogeneous material (often in the form of solid pellets) and then injection molding the melted material. Not only are the physical properties of thermoplastics desirable for vibratory screening applications but the use of thermoplastic liquids provides an easier manufacturing processes. The use of thermoplastic materials provides excellent flexure and bending fatigue strength. Such materials are ideal for parts subjected to intermittent heavy loading or constant heavy loading as is encountered with vibratory screens used on vibratory screening machines.

Because vibratory screening machines are subject to motion, the low coefficient of friction of the thermoplastic injection molded materials provides desirable wear characteristics. Indeed, the wear resistance of certain thermoplastics is superior to many metals. The use of thermoplastics also provides resistance to stress cracking, aging, and extreme weathering. The heat deflection temperature of thermoplastics is approximately 200° F. With the addition of glass fibers, this temperature may increase to approximately 250° F., to approximately 300° F., or greater. Glass fibers may further increase rigidity, characterized by a flexural modulus, from approximately 400,000 PSI to over approximately 1,000,000 PSI. Such properties are desirable for the environment encountered when using vibratory screens on vibratory screening machines under the demanding conditions encountered in the field. In further embodiments, other (e.g., synthetic) materials may be used for wear resistant covers 2502 (e.g., see FIG. 25) as long as such materials are hydrophobic and include other desirable properties such as wear resistance, puncture/tear resistance, and abrasion resistance.

Figure 28:
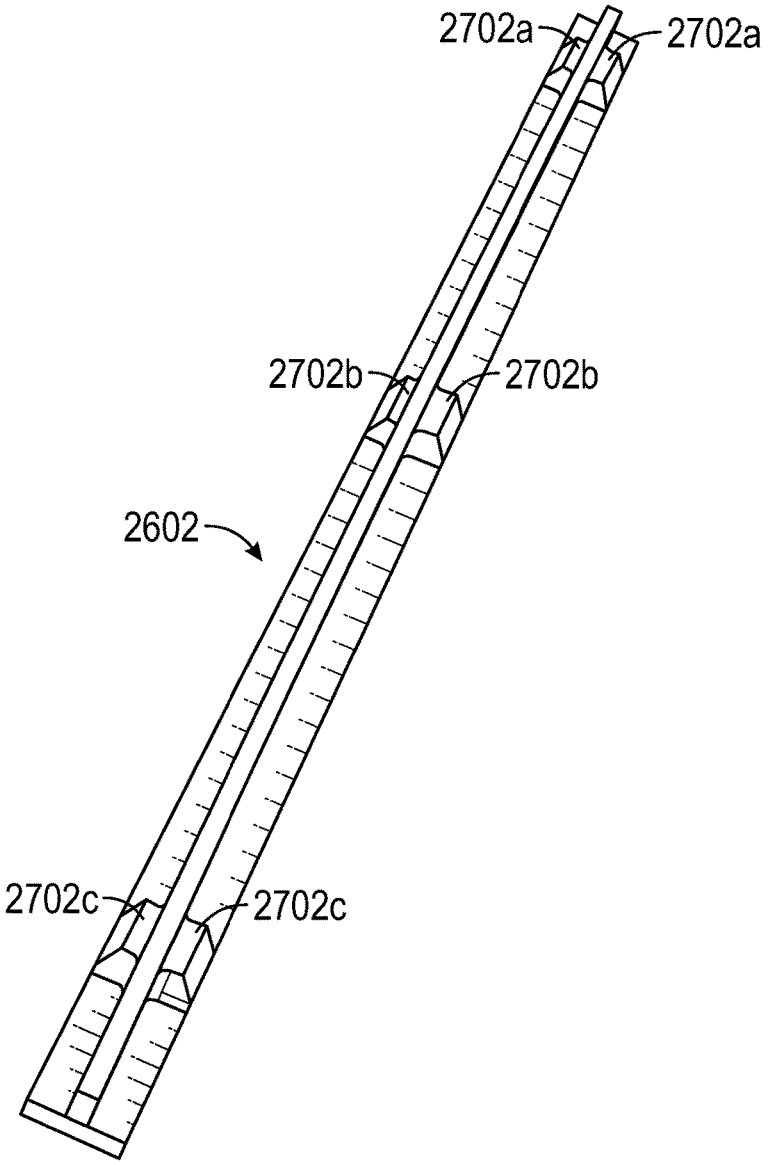
FIG. 28 shows a top perspective view of an uncovered isolated stringer, according to an example embodiment of the present disclosure.

FIG. 28 shows a top perspective view of an uncovered isolated stringer 2602, according to an example embodiment of the present disclosure. Stringer 2602 is shown as a single structure that is removed from the vibratory screening machine described above with reference to FIGS. 24 to 27. As shown, stringer 2602 may include housing structures 2702*a*, 2702*b*, and 2702*c* which may be configured to accommodate a fastener such as a bolt or screw, as described in greater detail below with reference to FIG. 30. As described above, stringer may be constructed of various materials including nylon, fiber (e.g., carbon-fiber, glass-fiber) reinforced nylon, and other thermoplastics.

Figure 29:
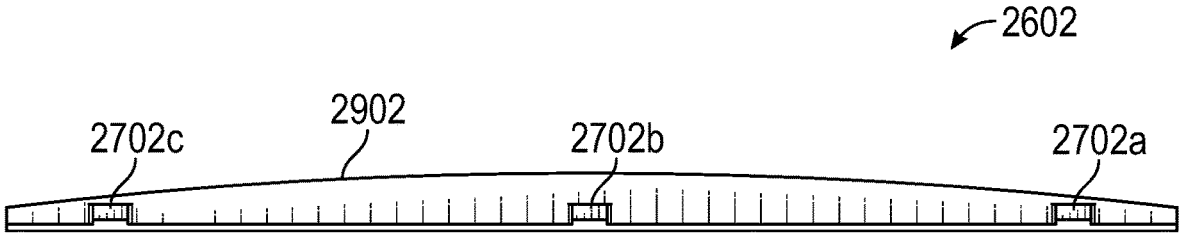
FIG. 29 shows a side perspective view of an uncovered isolated stringer with a convex shape, according to an example embodiment of the present disclosure.

FIG. 29 shows a side perspective view of an uncovered isolated stringer 2602 having a convex shape, according to an example embodiment of the present disclosure. As with FIG. 28, stringer 2602 is shown as a single structure that is removed from removed from the vibratory screening machine described above with reference to FIGS. 24 to 27. As described above (and further below with reference to FIG. 30), housing structures 2702*a*, 2702*b*, and 2702*c* may be configured to accommodate a fastener such as a bolt or screw. Stringer 2602 is shown having a convex curve support structure 2902. Such a convex curve support structure 2902 may be configured to support a screening structure under tension. In this example, support structure 2902 may have a tapered or pyramidal cross-sectional shape providing a mating surface that has a smaller area than a base area of stringer 2602 (e.g., see FIG. 28). Other stringer structures may also include other support structure shapes such as straight, concave, etc. Other embodiments may include stringers 2602 having other shapes including ones with circular cross section, triangular cross section, rectangular cross section, square cross section, hexagonal cross section, etc., as needed for a given application.

Figure 30:
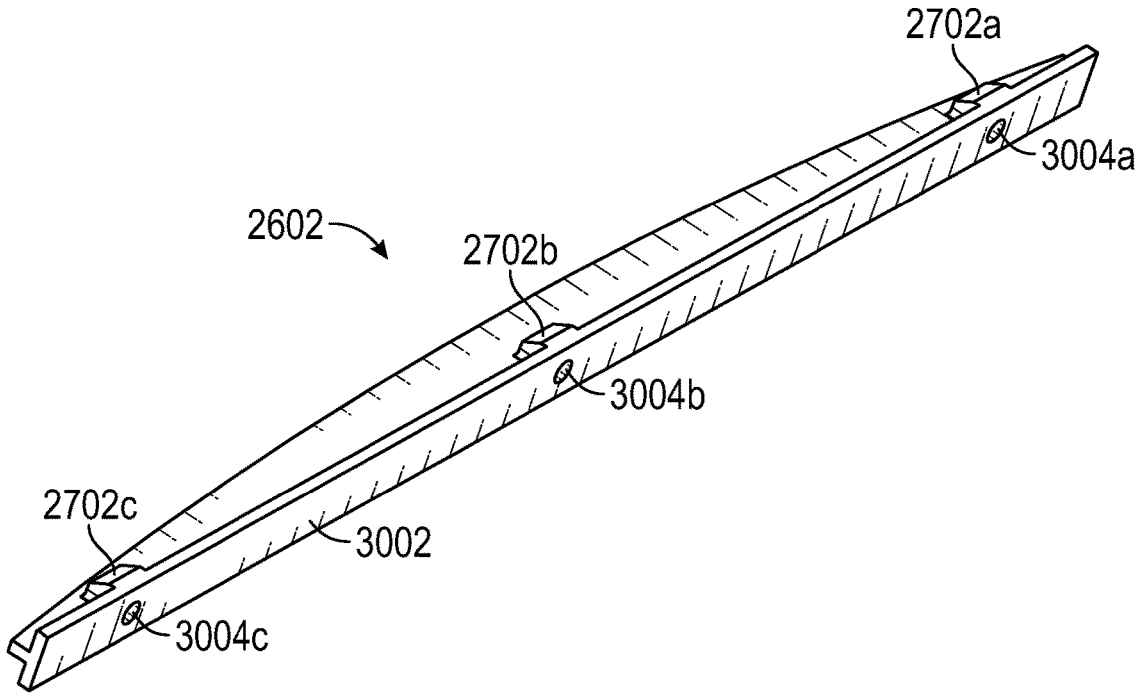
FIG. 30 shows a bottom perspective view of an uncovered isolated stringer with a convex shape, according to an example embodiment of the present disclosure.

FIG. 30 shows a bottom perspective view of an uncovered isolated stringer 2602 having a convex shape, according to an example embodiment of the present disclosure. This view illustrates a flat bottom surface 3002 of stringer 2602 that may be configured to be installed on corresponding flat support structures of a vibratory screening machine such as rib structure, described in greater detail above. In other embodiments, surface 3002 may have other shapes including curved shapes that may be concave or convex. FIG. 30 also shows holes 3004*a*, 3004*b*, and 3004*c* that may be configured to accommodate a fastener such as a screw or bolt. For example, holes 3004*a*, 3004*b*, and 3004*c* may be threaded and may penetrate through bottom surface 3002 of stringer 2602 into housing structures 2702*a*, 2702*b*, and 2702*c*, which may thereby provide structure support to a fastener that may be installed into holes 3004*a*, 3004*b*, and 3004*c*.

Figure 31:
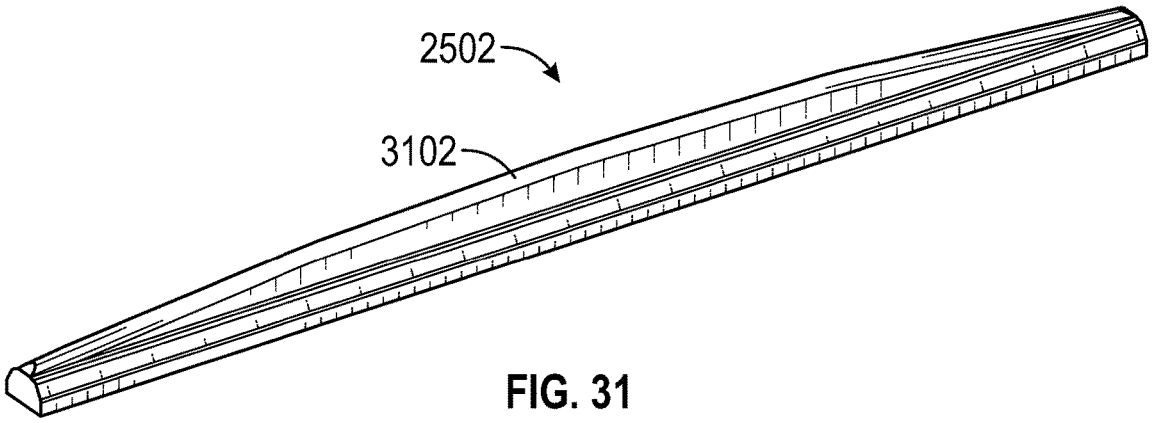
FIG. 31 shows a top perspective view of a wear protective covering for a stringer, according to an example embodiment of the present disclosure.

FIG. 31 shows a top perspective view of a wear protective covering 2502 for a stringer, according to an example embodiment of the present disclosure. Wear protective covering 2502 is shown as a single structure that is removed from stringer 2602 of the vibratory screening machine described above with reference to FIGS. 24 to 27. Wear protective covering 2502 is shown having a curved surface 3102 that is configured to cover and protect the convex curve support structure 2902 of stringer 2602 described above. As described above, wear protective covering 2502 is configured to snap onto a stringer 2602 and to conform tightly to the shape of the stringer 2602 to reduce or eliminate any vibration or relative motion between stringer 2602 and wear protective covering 2502. In this way, wear protective covering 2502 forms an abrasion resistant covering onto which a screen or screening assembly may be mounted.

Such a wear protective covering 2502 may be replaceable and may provide an ideal shape for mounting screens and screen assemblies.

Figure 32:
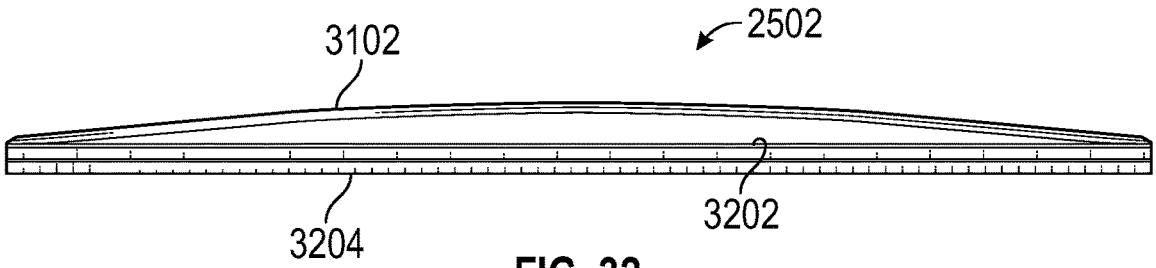
FIG. 32 shows a side perspective view of a wear protective covering for a stringer, according to an example embodiment of the present disclosure.

FIG. 32 shows a side perspective view of a wear protective covering 2502 for a stringer, according to an example embodiment of the present disclosure. As shown, wear protective covering 2502 includes curved surface 3102 described above. Wear protective covering 2502 further includes a flat edge portion 3202 and a flat bottom portion 3204. Each of the features 3102, 3202, and 3204 mirror similar features of stringer 2602 described above with reference to FIGS. 28 to 30. Further, wear protective covering 2502 is made of a wear-resistant flexible material that may be configured to be easily installed and un-installed on a stringer 2602.

Figure 33:
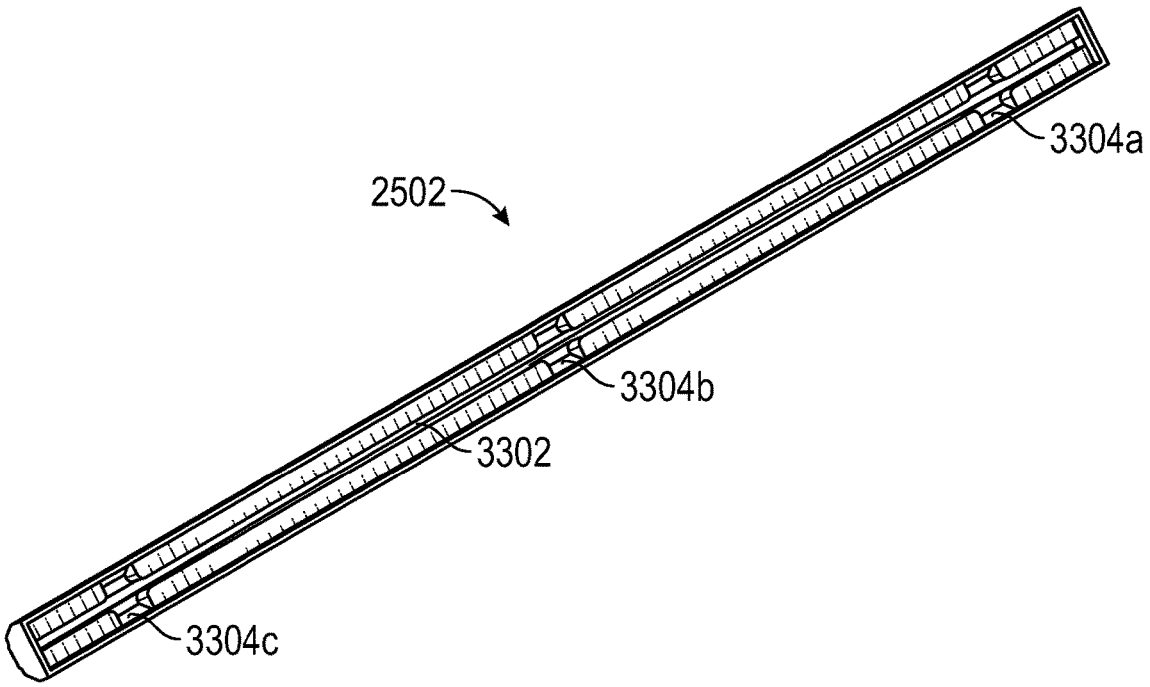
FIG. 33 shows a bottom perspective view of a wear protective covering for a stringer, according to an example embodiment of the present disclosure.

FIG. 33 shows a bottom perspective view of a wear protective covering 2502 for a stringer, according to an example embodiment of the present disclosure. As shown, wear protective covering 2502 includes a linear groove and three voids 3304*a*, 3304*b*, and 3304*c*. Linear groove 3302 may be configured to accommodate and to fit over curved surface 3102 of stringer 2602 described above with reference to FIGS. 28 to 30. Further, voids 3304*a*, 3304*b*, and 3304*c* may be configured to accommodate and to fit over housing structures 2702*a*, 2702*b*, and 2702*c*. In this way, wear protective covering 2502 may be configured to fit over stringer 2602 (e.g., see FIGS. 28 to 30) and to tightly conform to structural features of stringer 2602. In this way, wear protective covering 2502 may be held in place and to resist movement/vibration relative to stringer 2602 during operation of a vibratory screening machine. As such, wear protective covering 2502 provides abrasion and scratch resistance to removable stringer 2602 during operation of a vibratory screening machine. As described above, wear protective covering 2502 may also be replaced periodically due to routine wear as needed.

Figure 34:
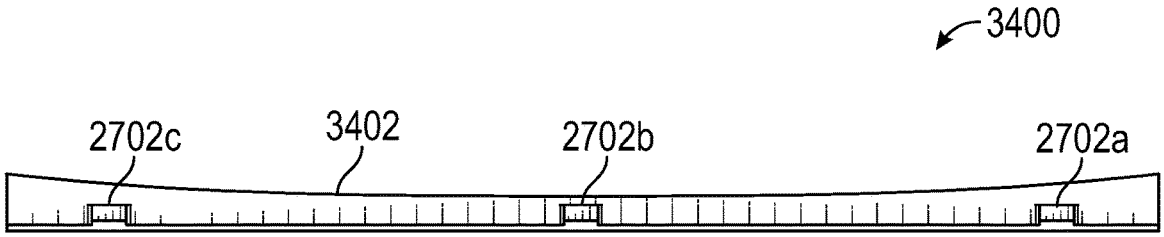
FIG. 34 shows a side perspective view of an uncovered isolated stringer with a concave shape, according to an example embodiment of the present disclosure.

FIG. 34 shows a side perspective view of an uncovered isolated stringer 3400 having a concave shape, according to an example embodiment of the present disclosure. As with FIGS. 28, 29, and 30, stringer 3400 is shown as a single structure that is removed from removed from the vibratory screening machine described above with reference to FIGS. 24 to 27. As described above (and further below with reference to FIG. 35), housing structures 2702*a*, 2702*b*, and 2702*c* may be configured to accommodate a fastener such as a bolt or screw. Stringer 3400 is shown having a concave curve support structure 3402. Such a concave curve support structure 3402 may be configured to support a screening structure under compression. In this example, support structure 3402 may have a tapered or pyramidal cross-sectional shape providing a mating surface that has a smaller area than a base area of stringer 3400. Other stringer structures may also include other support structure shapes such as straight, etc. Other embodiments may include stringers 3400 having other shapes including ones with circular cross section, triangular cross section, rectangular cross section, square cross section, hexagonal cross section, etc., as needed for a given application.

Figure 35:
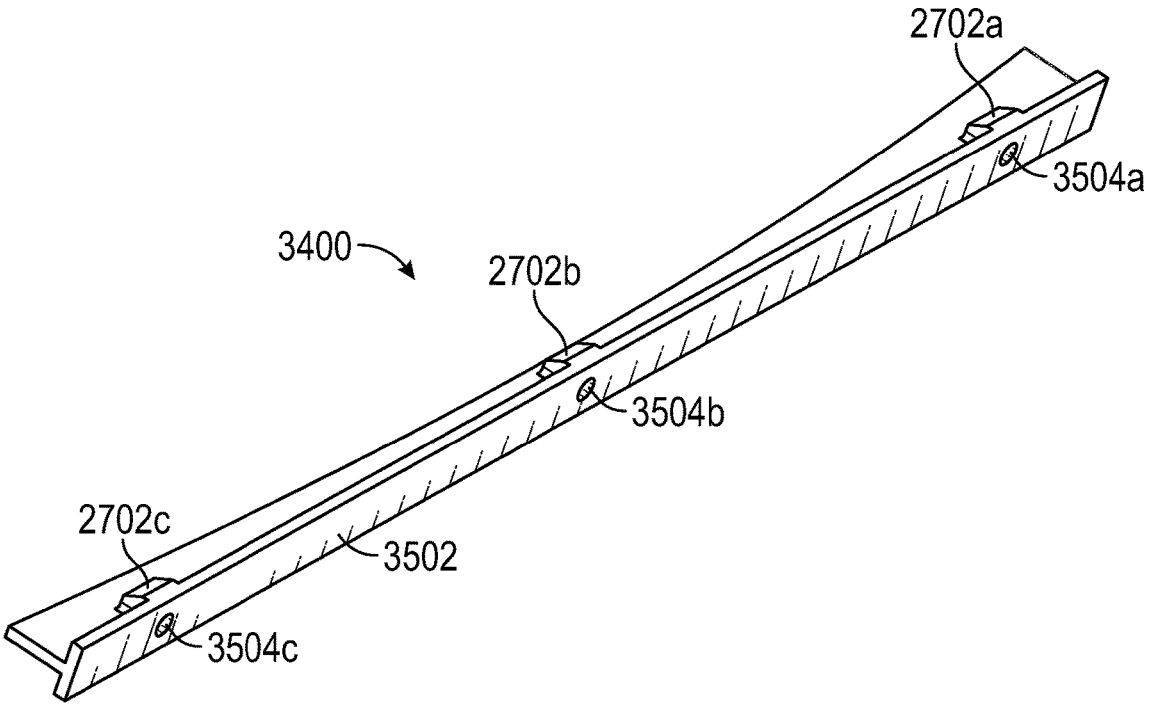
FIG. 35 shows a bottom perspective view of an uncovered isolated stringer with a concave shape, according to an example embodiment of the present disclosure.

FIG. 35 shows a bottom perspective view of an uncovered isolated stringer 3400 having a concave shape, according to an example embodiment of the present disclosure. This view illustrates a flat bottom surface 3502 of stringer 3400 that may be configured to be installed on corresponding flat support structures of a vibratory screening machine such as rib structure, described in greater detail above. In other embodiments, surface 3502 may have other shapes including curved shapes that may be concave or convex. FIG. 35 also shows holes 3504*a*, 3504*b*, and 3504*c* that may be configured to accommodate a fastener such as a screw or bolt. For example, holes 3504*a*, 3504*b*, and 3504*c* may be threaded and may penetrate through bottom surface 3502 of stringer 3400 into housing structures 2702*a*, 2702*b*, and 2702*c*, which may thereby provide structural support to a fastener that may be installed into holes 3504*a*, 3504*b*, and 3504*c*.

Figure 36:
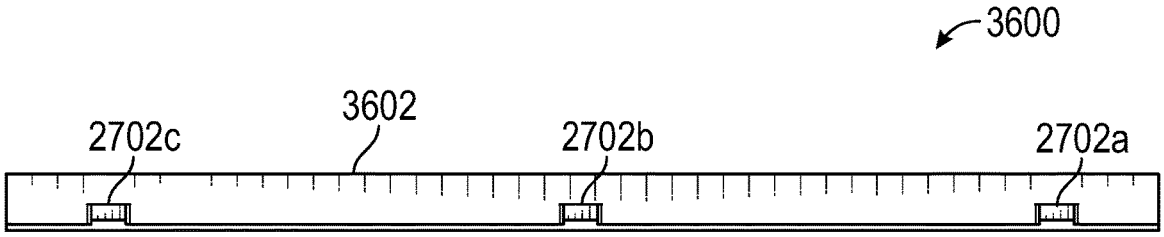
FIG. 36 shows a side perspective view of an uncovered isolated stringer with a straight shape, according to an example embodiment of the present disclosure.

FIG. 36 shows a side perspective view of an uncovered isolated stringer 3600 having a straight shape, according to an example embodiment of the present disclosure. As with FIGS. 28 to 35, stringer 3600 is shown as a single structure that is removed from removed from the vibratory screening machine described above with reference to FIGS. 24 to 27. As described above (and further below with reference to FIG. 37), housing structures 2702*a*, 2702*b*, and 2702*c* may be configured to accommodate a fastener such as a bolt or screw. Stringer 3600 is shown having a straight curve support structure 3602. Such a straight support structure 3602 may be configured to support a screening structure under tension, compression, or in a relaxed configuration having no tension or compression. In this example, support structure 3602 may have a tapered or pyramidal cross-sectional shape providing a mating surface that has a smaller area than a base area of stringer 3600. Other stringer structures may also include other support structure shapes. Other embodiments may include stringers 3600 having other shapes including ones with circular cross section, triangular cross section, rectangular cross section, square cross section, hexagonal cross section, etc., as needed for a given application.

Figure 37:
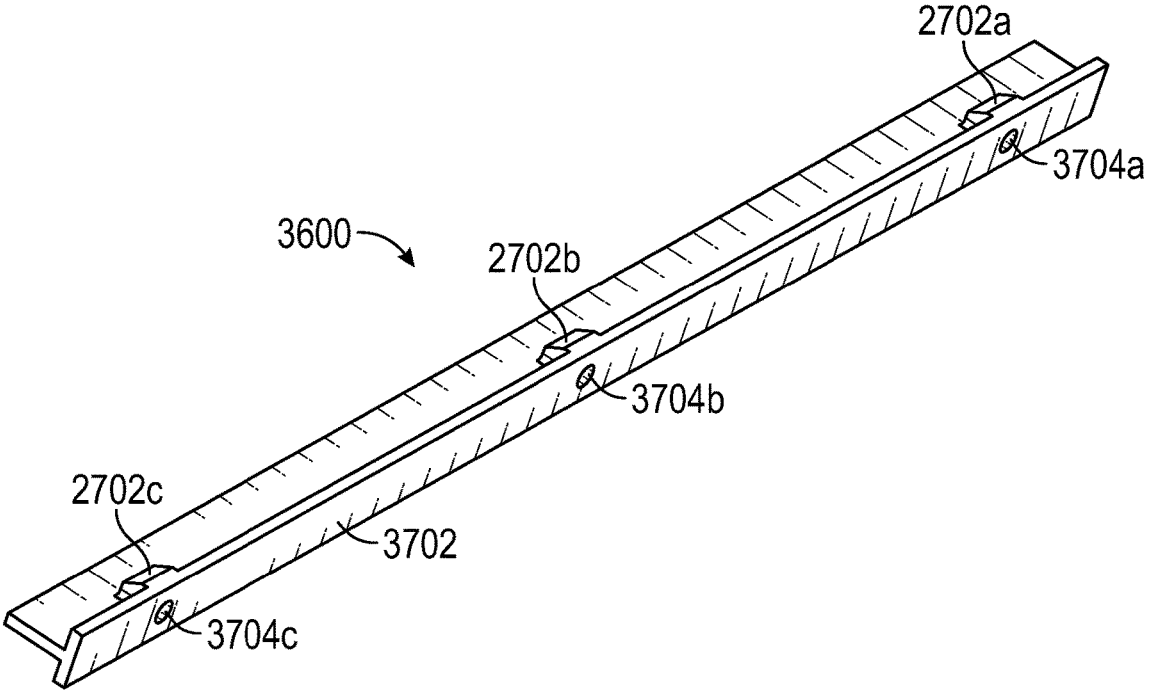
FIG. 37 shows a bottom perspective view of an uncovered isolated stringer with a straight shape, according to an example embodiment of the present disclosure.

FIG. 37 shows a bottom perspective view of an uncovered isolated stringer 3600 having a straight shape, according to an example embodiment of the present disclosure. This view illustrates a flat bottom surface 3702 of stringer 3600 that may be configured to be installed on corresponding flat support structures of a vibratory screening machine such as rib structure, described in greater detail above. In other embodiments, surface 3702 may have other shapes including curved shapes that may be concave or convex. FIG. 37 also shows holes 3704*a*, 3704*b*, and 3704*c* that may be configured to accommodate a fastener such as a screw or bolt. For example, holes 3704*a*, 3704*b*, and 3704*c* may be threaded and may penetrate through bottom surface 3702 of stringer 3600 into housing structures 2702*a*, 2702*b*, and 2702*c*, which may thereby provide structure support to a fastener that may be installed into holes 3704*a*, 3704*b*, and 3704*c*.

Each of stringers 3400 and 3600, respectively described above with reference to FIGS. 34 to 37 may also be provided with wear protective coverings, as described above with reference to FIGS. 31 and 32. In each case, a corresponding wear protective cover may be provided having a shape that confirms to the corresponding stringer. For example, stringer 3400 having a concave shape may be provided with a wear protective covering having a corresponding concave shape (not shown). Similarly, stringer 3600 having a straight shape may be provided with a wear protective covering having a corresponding straight shape (not shown).

Figure 38:
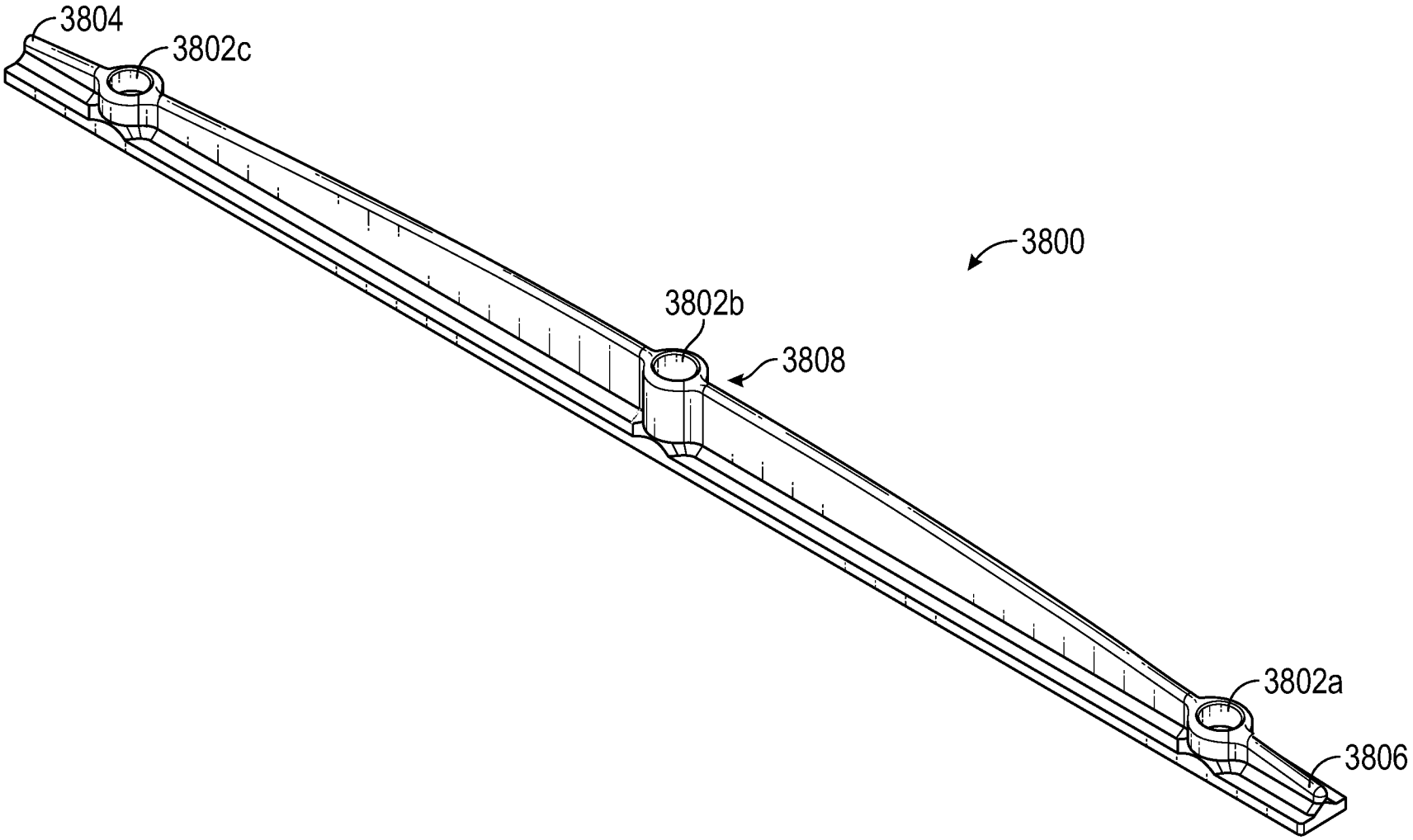
FIG. 38 shows a side perspective view of a stringer according to an additional embodiment.

FIGS. 38 to 44 show an additional embodiment of a stringer. FIG. 38 shows a side perspective view of a stringer 3800 shown as a single structure that is removable from a vibratory screening machine, such as the vibratory screening machine described above with reference to FIGS. 24 to 27. As shown, stringer 3800 includes housing structures 3802*a*, 3802*b*, and 3802*c* which may be configured to accommodate a fastener such as a bolt or screw, as described in greater detail below with reference to FIG. 44. Similar to the stringers described above, stringer 3800 may be constructed of various materials including nylon, fiber (e.g., carbon-fiber, glass-fiber) reinforced nylon, and other thermoplastics.

Figure 39:
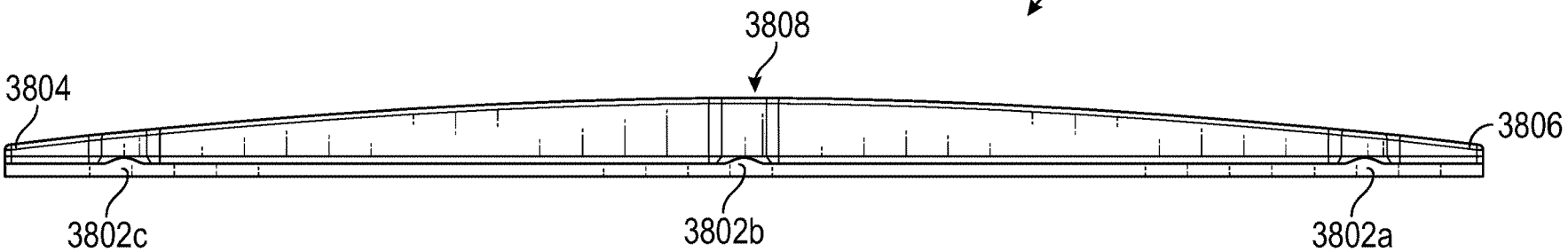
FIGS. 39 and 40 show left and right side perspective views of the stringer of FIG. 38 according to the additional embodiment.
Figure 40:
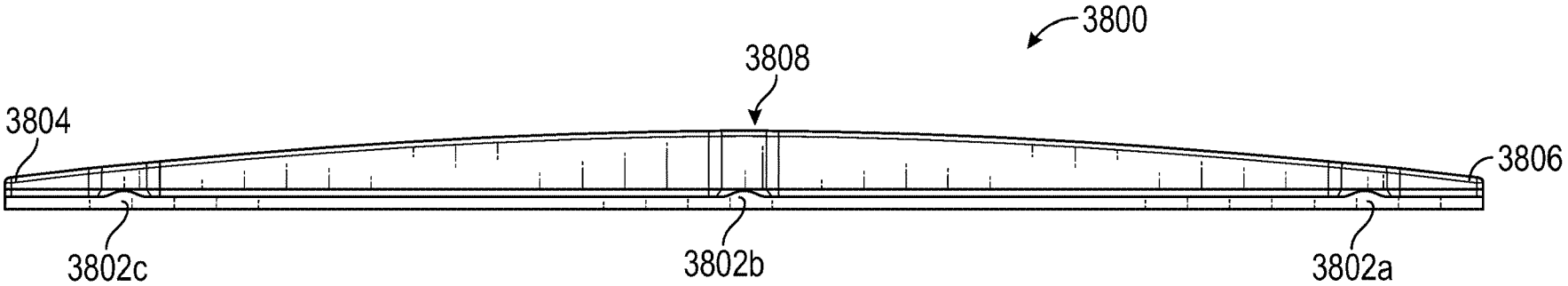
Figure 41:
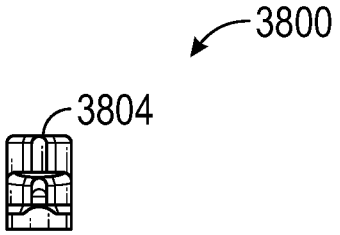
FIGS. 41 and 42 show end views of the stringer of FIG. 38 according to the additional embodiment.
Figure 42:
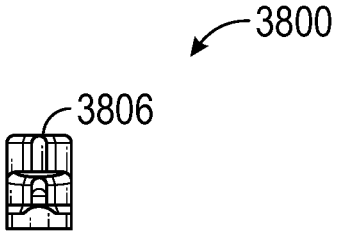

FIGS. 39 and 40 show left and right side perspective views of stringer 3800 having a convex shape. Stringer 3800 is shown having a convex curve support structure 3808 that extends in a convex direction from end 3804 to end 3806. Such a convex curve support structure 3808 may be configured to support a screening structure under tension. In this example, support structure 3808 may have a tapered or pyramidal cross-sectional shape providing a mating surface that has a smaller area than a base area of stringer 3800 (e.g., see FIG. 38). Other stringer structures may also include other support structure shapes such as straight, concave, etc. Other embodiments may include stringers 3800 having other shapes including ones with circular cross section, triangular cross section, rectangular cross section, square cross section, hexagonal cross section, etc., as needed for a given application. FIGS. 41 and 42 show end views of stringer 3800. FIG. 41 shows end 3804 and FIG. 42 shows end 3806.

Figure 43:
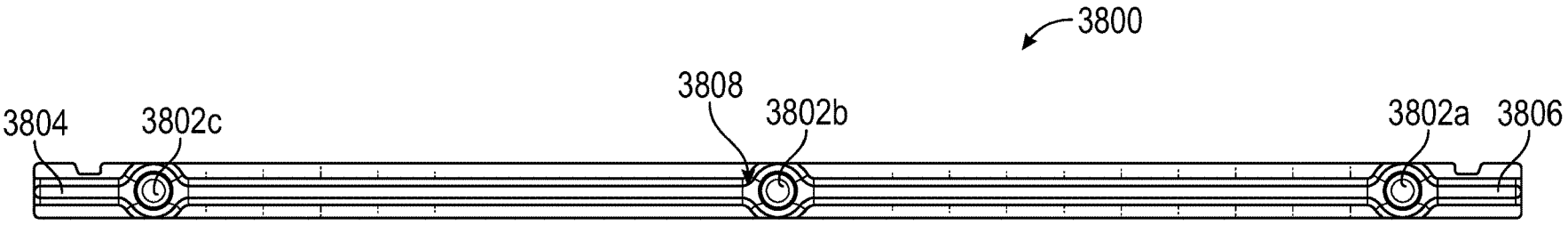
FIGS. 43 and 44 show top and bottom views of the stringer of FIG. 38 according to the additional embodiment.
Figure 44:
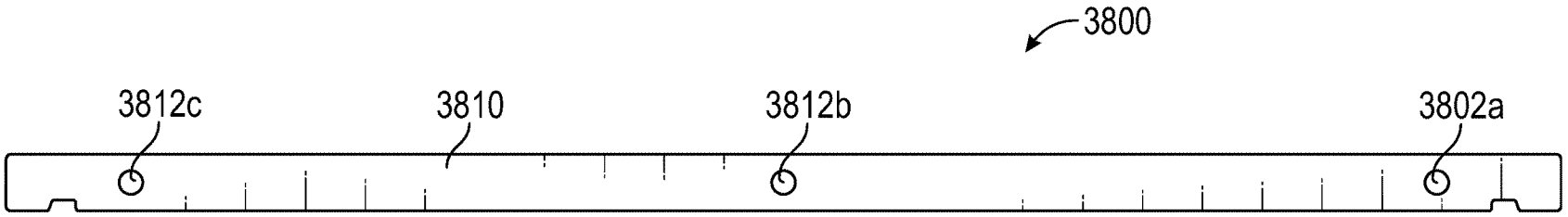

FIGS. 43 and 44 show top and bottom views of stringer 3800. The top view shown in FIG. 43 includes housing structures 3802*a*, 3802*b*, and 3802*c* and a tapered top view of support structure 3808 extending from end 3804 to 3806. The bottom view shown in FIG. 44 includes a substantially flat bottom surface 3810 of stringer 3800 that may be configured to be installed on corresponding flat support structures of a vibratory screening machine such as rib structure, described in greater detail above. In other embodiments, surface 3810 may have other shapes including curved shapes that may be concave or convex. FIG. 44 also shows holes 3812*a*, 3812*b*, and 3812*c* that may be configured to accommodate a fastener such as a screw or bolt. For example, holes 3812*a*, 3812*b*, and 3812*c* may be threaded and may penetrate through bottom surface 3810 of stringer 3800 into housing structures 3802*a*, 3802*b*, and 3802*c*, which may thereby provide structure support to a fastener that may be installed into holes 3812*a*, 3812*b*, and 3812*c*. Additionally, the housing structures 3802*a*, 3802*b*, 3802*c* and holes 3812*a*, 3812*b*, 3812*c* can accommodate fasteners, such as screws, rivets, nuts, etc. In at least one exemplary embodiment, the fasteners can be rivet-nut insert, which can, for example, be wedged into the screenframe's bulkhead. In at least one exemplary embodiment, a bolt can be inserted through housing structures 3802*a*, 3802*b*, 3802*c* through respective holes 3812*a*, 3812*b*, 3812*c*. Alternatively, one housing structure and respective hole could be omitted, such as 3802*b* and 3812*b* resulting in housing structures 3802*a* and 3802*c* and holes 3812*a* and 3812*c*.

Stringer 3800 may also be provided with wear protective coverings, as described above with reference to FIGS. 31 and 32. In each case, a corresponding wear protective cover may be provided having a shape that confirms to the corresponding stringer. For example, stringer 3800 having a concave shape may be provided with a wear protective covering having a corresponding concave shape (not shown).

Figure 45:
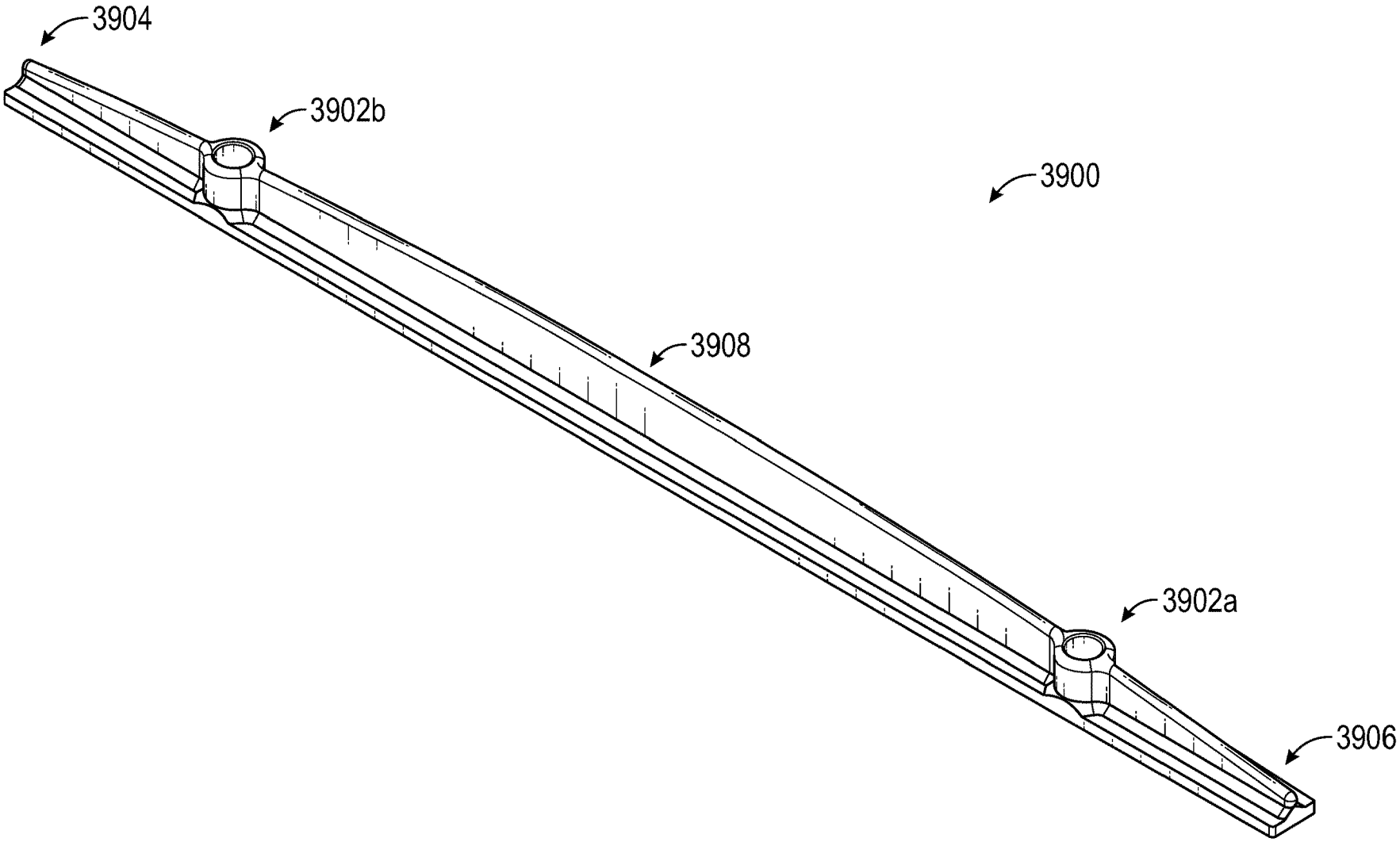
FIGS. 45 and 46 show perspective views of stringers with two housing structures according to additional embodiments.
Figure 46:
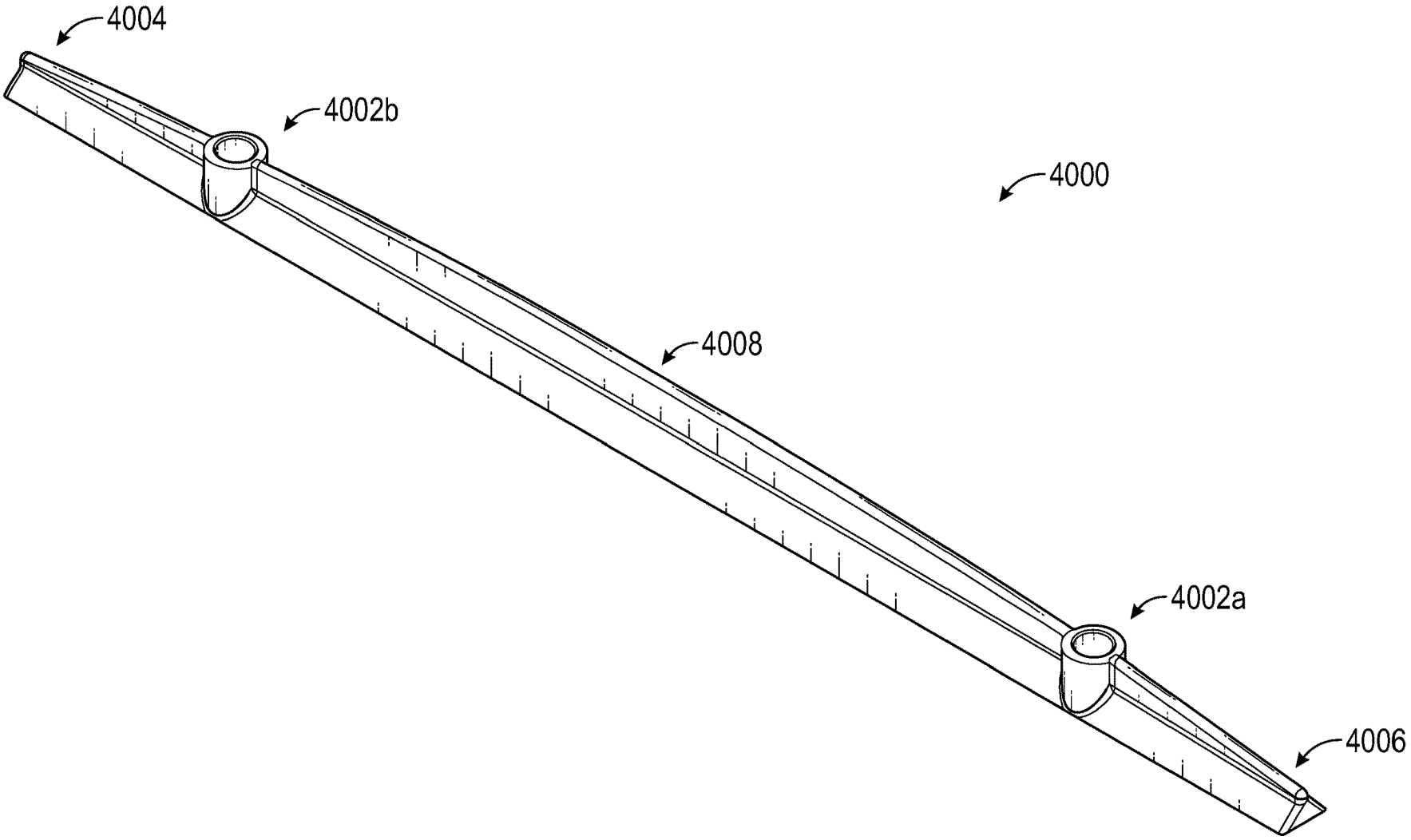

FIGS. 45 and 46 show perspective views of stringers 3900 and 4000 with two housing structures according to additional embodiments. The two housing structures 3902*a* and 3902*b*, and 4002*a* and 4002*b*, respectively shown in FIGS. 45 and 46, are similar to the housing structures 3902*a*, 3802*b*, and 3802*c* except attach at only two points. The two housing structures 3902*a* and 3902*b*, and 4002*a* and 4002*b* can include holes (not shown, but can include holes similar to holes 3812*a*, 3812*b*, 3812*c*) and can accommodate fasteners, such as screws, rivets, nuts, etc. In at least one exemplary embodiment, the fasteners can be rivet-nut insert, which can, for example, be wedged into the screenframe's bulkhead. In at least one exemplary embodiment, a bolt can be inserted through housing structures 3902*a* and 3902*b*, and 4002*a* and 4002*b* and through respective holes. The stringer can include a pyramid cross section, a tapered base, or a triangular base cross section as shown in FIG. 46.

Figure 47:
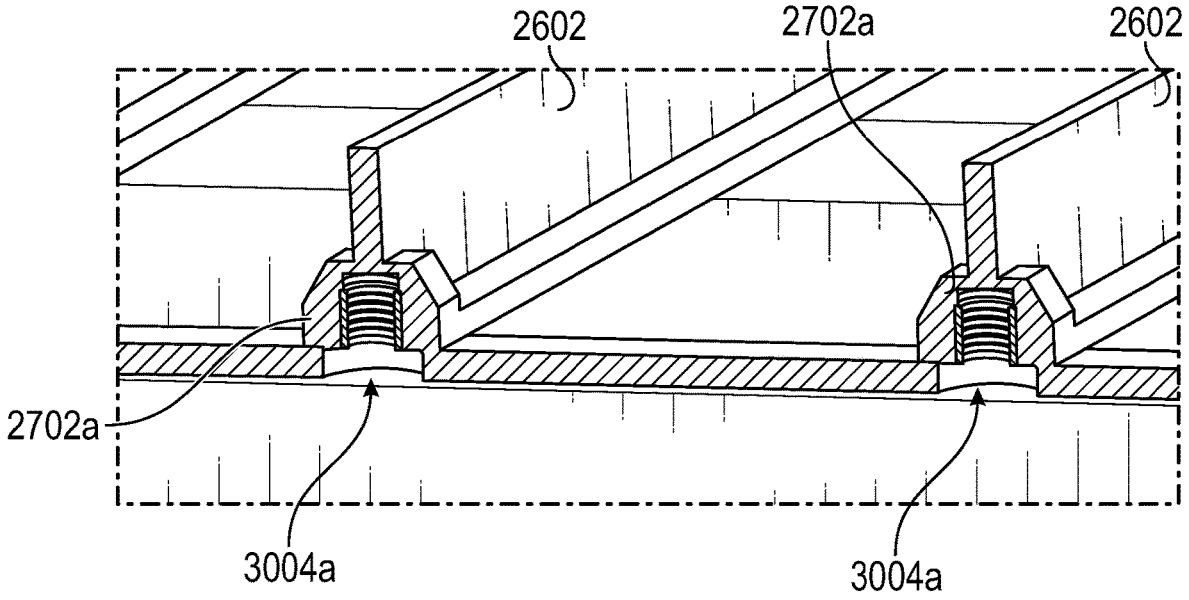
FIG. 47 shows a cross-section of a bolted joint with a bolt from the bottom.
Figure 48:
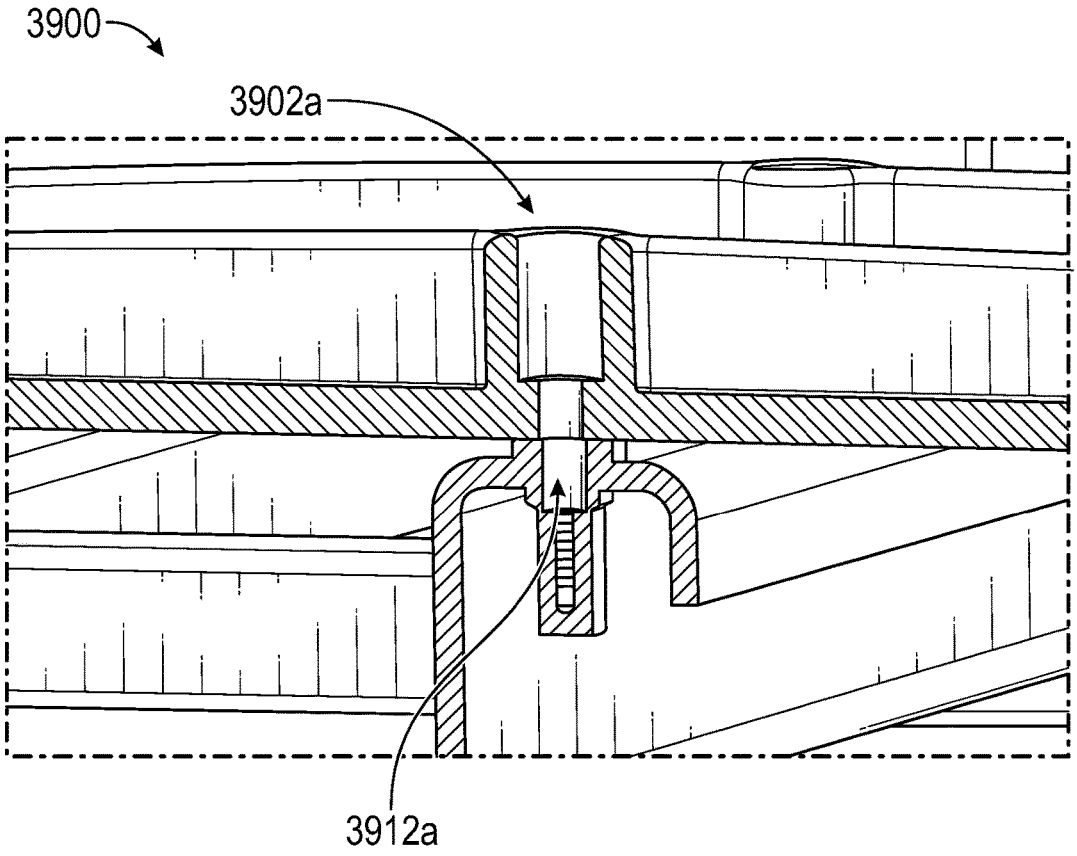
FIG. 48 shows a cross-section of a bolted joint with a bolt from the top according to the embodiments of FIGS. 45 and 46.

FIG. 47 shows a cross-section of a bolted joint with a bolt from the bottom, similar to the embodiment shown in FIG. 30. As shown in FIG. 47, stringer 2602 includes a bolted joint capable of receiving a bolt through housing structure 2702*a* and through hole 3004*a*. FIG. 48 shows a cross-section of a bolted joint with a bolt from the top according to the embodiments of FIGS. 45 and 46. As shown in FIG. 48, stringer 3900 includes a bolted joint capable of receiving a bolt through housing structure 3902*b* and through hole 3912*b*.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

While embodiments of this disclosure are described with reference to various embodiments, it is noted that such embodiments are illustrative and that the scope of the disclosure is not limited to them. Those of ordinary skill in the art may recognize that many further combinations and permutations of the disclosed features are possible. As such, various modifications may be made to the disclosure without departing from the scope or spirit thereof. In addition or in the alternative, other embodiments of the disclosure may be apparent from consideration of the specification and annexed drawings, and practice of the disclosure as presented herein. The examples put forward in the specification and annexed drawings are illustrative and not restrictive. Although specific terms are employed herein, they are used in a generic and descriptive sense only and not for purposes of limitation.

What is claimed is:

1. A vibratory screening machine, comprising:

one or more screening assemblies; and a plurality of injection molded removable support structures configured to provide mechanical support to the one or more screening assemblies, wherein each of the plurality of injection molded removable support structures have at least one housing structure configured to receive a fastener that is used to secure the support structure to the vibratory screening machine;

a plurality of removable wear protective covers configured to be installed on respective support structures and to provide wear and abrasion resistance to the removable support structures.

2. The vibratory screening machine of claim 1, wherein the removable support structures include one or more of plastic, metal, and composite materials.

3. The vibratory screening machine of claim 1, wherein the removable support structures include nylon.

4. The vibratory screening machine of claim 3, wherein the removable support structures include fiber-reinforced nylon.

5. The vibratory screening machine of claim 4, wherein the removable support structures include carbon or graphite.

6. The vibratory screening machine of claim 1, wherein the removable support structures have a convex shape and are configured to mechanically support screening assemblies held under tension.

7. The vibratory screening machine of claim 1, wherein the removable support structures are configured to be removably fastened to the screening machine.

8. The vibratory screening machine of claim 1, wherein the wear protective covers include thermoplastic polyurethane (TPU).

9. The vibratory screening machine of claim 8, wherein wear protective covers have a shape that conforms to a shape of the removable support structures.

10. The vibratory screening machine of claim 9, wherein the wear protective covers and the removable support structures each have a tapered or pyramidal cross-sectional shape.

11. The vibratory screening machine of claim 1, wherein the wear protective covers are made of a flexible material that provides scratch resistance, tear resistance, and puncture resistance.

12. A removable support structure for a vibratory screening machine, comprising:

a single structure including one or more of plastic, metal, and composite materials, wherein the removable support structure is configured to be removably fastened to the vibratory screening machine, wherein the single structure comprises at least one housing structure configured to receive a fastener that is used to secure the single structure to the vibratory screening machine, and wherein the single structure is configured to provide mechanical support to one or more screening assemblies of the vibratory screening machine.

13. The removable support structure of claim 12, wherein the single structure comprises a thermoplastic injection molded material.

14. The removable support structure of claim 12, wherein the single structure comprises one or more of nylon, carbon, and graphite.

15. The removable support structure of claim 12, wherein the single structure has a convex shape that is configured to mechanically support a screening assembly held under tension.

16. A method of fabricating a removable support structure for a vibratory screening machine, the method comprising:

injection molding the removable support structure as a single structure having at least one housing structure that is configured to receive a fastener used to secure the removable support structure to a vibratory screening machine, wherein the removable support structure is configured to be removably fastened to the vibratory screening machine, and is configured to provide mechanical support to one or more screening assemblies of the vibratory screening machine.

17. The method of claim 16, wherein the removable support structure comprises one or more of thermoplastic, nylon, carbon, and graphite.

18. The method of claim 16, wherein the removable support structure has a convex shape that is configured to mechanically support a screening assembly held under tension.

19. A removable support structure for a vibratory screening machine, comprising:

a single support structure including one or more of plastic, metal, and composite materials, the single support structure comprising at least one housing structure configured to receive a fastener used to secure the single support structure to a vibratory screening machine; and a wear protective covering, wherein the support structure is configured to be removably fastened to the vibratory screening machine and is configured to provide mechanical support to one or more screening assemblies of the vibratory screening machine, and wherein the wear protective covering provides wear resistance to the support structure and is configured to be removably installed on the support structure.

20. The support structure of claim 19, wherein the removable support structure comprises one or more of thermoplastic, nylon, carbon, and graphite.

21. The support structure of claim 20, wherein the removable support structure comprises glass-fiber or carbon-fiber reinforced nylon.

22. The support structure of claim 19, wherein the removable support structure has a convex shape that is configured to mechanically support a screening assembly held under tension.

23. The support structure of claim 19, wherein the wear protective covering comprises a hydrophobic abrasion resistant material.

24. The support structure of claim 19, wherein the wear protective covering comprises a thermoplastic polyurethane (TPU).

25. The support structure of claim 19, wherein the wherein the wear protective covering is configured to snap onto the support structure and closely conform to an external shape of the support structure.

26. A method of screening a material, the method comprising:

installing removable support structures on a vibratory screening machine, wherein each support structure comprises at least one housing structure configured to receive a fastener used to secure the support structure to the vibratory screening machine;

installing wear protective coverings on the support structures;

mounting a screening assembly on the vibratory screening machine so that the screening assembly is supported by the covered removable support structures; and screening the material.

27. The method of claim 26, wherein each removable support structure is a single injection molded piece.

28. The method of claim 26, wherein each removable support structure comprises one or more of thermoplastic, nylon, carbon, and graphite.

29. The method of claim 28, wherein each removable support structure comprises glass-fiber or carbon-fiber reinforced nylon.

30. The method of claim 26, wherein each removable support structure has a concave or convex shape that is configured to mechanically support a screening assembly held under compression or under tension, respectively.

31. The method of claim 26, wherein the wear protective covering further comprises a hydrophobic abrasion resistant material.

32. The support structure of claim 31, wherein each wear protective covering comprises a thermoplastic polyurethane (TPU).

33. The support structure of claim 26, wherein each wear protective covering is configured to snap onto a support structure and closely conform to an external shape of the support structure.

34. The support structure of claim 33, wherein the each at least one housing structure comprises a hollow passageway extending through a portion of a support structure located along a longitudinal centerline of the support structure.

35. The vibratory screening machine of claim 1, wherein each at least one housing structure comprises a hollow passageway extending through a portion of one of the plurality of injection molded removable support structures located along a longitudinal centerline of the removable support structure.

36. The removable support structure of claim 12, wherein each at least one housing structure comprises a hollow passageway extending through a portion of the single structure located along a longitudinal centerline of the single structure.

37. The method of claim 16, wherein the injection molding step results in each at least one housing structure comprising a hollow passageway extending through a portion of the support structure located along a longitudinal centerline of the support structure.

38. The removable support structure of claim 19, wherein each at least one housing structure comprises a hollow passageway extending through a portion of the support structure located along a longitudinal centerline of the support structure.

* * * * *